US007393625B2

(12) United States Patent
Sakai et al.

(10) Patent No.: US 7,393,625 B2
(45) Date of Patent: Jul. 1, 2008

(54) PHOTOTHERMOGRAPHIC MATERIAL

(75) Inventors: Minoru Sakai, Kanagawa (JP); Seiichi Yamamoto, Kanagawa (JP); Takayoshi Oyamada, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/717,193

(22) Filed: Mar. 13, 2007

(65) Prior Publication Data

US 2007/0224555 A1 Sep. 27, 2007

(30) Foreign Application Priority Data

Mar. 27, 2006 (JP) ..... 2006-086714
Mar. 27, 2006 (JP) ..... 2006-086716

(51) Int. Cl.
*G03C 1/00* (2006.01)

(52) U.S. Cl. ..... 430/617; 430/618; 430/619; 430/620

(58) Field of Classification Search ..... 430/617–620
See application file for complete search history.

(56) References Cited

U.S. PATENT DOCUMENTS 6,165,707 A 12/2000 Hirano et al.
7,135,277 B2 * 11/2006 Ohzeki ..... 430/619
2005/0277072 A1 12/2005 Ohzeki
2007/0065763 A1 * 3/2007 Fukui ..... 430/619

FOREIGN PATENT DOCUMENTS

| | | |
|---|---|---|
| EP | 0996032 | 4/2000 |
| EP | 1014178 | 6/2000 |
| EP | 1582919 | 10/2005 |
| JP | A 2000-010229 | 1/2000 |
| JP | A 2002-258435 | 9/2002 |
| JP | A 2002-296724 | 10/2002 |

* cited by examiner

*Primary Examiner*—Geraldina Visconti
(74) *Attorney, Agent, or Firm*—Margaret A. Burke; Sheldon J. Moss

(57) ABSTRACT

The present invention provides a photothermographic material having, on one side of a support, an image forming layer including at least a photosensitive silver halide, a non-photosensitive organic silver salt, a reducing agent for the organic silver salt, and a binder, and at least one non-photosensitive layer and, on the other side of the support, a non-photosensitive back layer, wherein a total amount of ammonia contained in the two sides is from $5\times10^{-4}$ mol/m$^2$ to $2\times10^{-2}$ mol/m$^2$, and a molar ratio (A2/A1) of an ammonia content of the non-photosensitive back layer (A2) to an ammonia content of the layer on the image forming layer side (A1) is from 0.3 to 5.0; or a photothermographic material according to the above, wherein the non-photosensitive back layer includes an ammonium salt, and an ammonia content of the non-photosensitive back layer is from 2 mg/m$^2$ to 100 mg/m$^2$.

26 Claims, No Drawings

PHOTOTHERMOGRAPHIC MATERIAL

CROSS-REFERENCE TO RELATED APPLICATION

This application claims priority under 35 USC 119 from Japanese Patent Application Nos. 2006-086714 and 2006-086716, the disclosures of which are incorporated by reference herein.

BACKGROUND OF THE INVENTION

1. Field of the Invention

The present invention relates to a photothermographic material. More specifically, the invention relates to a photothermographic material which is suitable for recording images for medical use.

2. Description of the Related Art

In recent years, in the field of films for medical imaging, there has been a strong desire for decreasing the amount of processing liquid waste from the viewpoints of protecting the environment and economy of space. Technology is therefore required for light-sensitive photothermographic materials which can be exposed effectively by laser image setters or laser imagers and thermally developed to obtain clear black-toned images of high resolution and sharpness, for use in medical diagnostic applications and for use in photographic technical applications. The light-sensitive photothermographic materials do not require liquid processing chemicals and can therefore be supplied to customers as a simpler and environmentally friendly thermal processing system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal image forming systems utilizing organic silver salts are known. In particular, photothermographic materials generally have an image forming layer in which a catalytically active amount of a photocatalyst (for example, silver halide), a reducing agent, a reducible silver salt (for example, an organic silver salt), and if necessary, a toner for controlling the color tone of developed silver images are dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. This system has been described in many documents. Further, the Fuji Medical Dry Imager FM-DPL is an example of a medical image forming system using photothermographic materials that has been made commercially available.

Photothermographic materials are classified into two types according to the production process thereof. One is a solvent coated-type photothermographic material which is produced by organic solvent coating, and the other is an aqueous coated-type photothermographic material which is produced by using an aqueous solvent and polymer latex as a main binder. The latter process is advantageous with respect to environmental suitability and mass production, because it does not require a step for recovering used solvent or the like and does not require a complicated production apparatus therefore. In the case of the solvent coated-type photothermographic material, vaporization of organic solvent remaining in the material often occurs during thermal development accompanied by deterioration of a working environment thereby. In contrast, the aqueous coated-type photothermographic material does not have such a problem.

Thermal developing processing does not require the processing solutions used in wet developing processing, and has an advantage in that processing can be carried out easily and rapidly. However, on the other hand, the photothermographic materials contain all chemicals necessary for image formation in coated layers in advance, and therefore, these chemicals may be degraded by reacting with each other, or with oxygen or water in the air. Therefore, there are problems such as deterioration in performance during storage after production of the photothermographic material and prior to use.

Especially, with respect to photothermographic materials used for medical use, it is an important task to obtain favorable color tone stably because image tone exerts influences on diagnostic ability.

To adjust the image tone, it is known in the art to use a dye or pigment in the image forming layer or back layer.

It is well-known in the art that the polymer latex used for the aqueous coated-type photothermographic material contains a small amount of ammonium, because an ammonium compound such as ammonium persulfate is commonly used for a polymerization initiator, and after the polymerization process, an ammonium compound is used as a pH adjusting agent to improve storage stability of the latex liquid. It is disclosed in Japanese Patent Application Laid-Open (JP-A) Nos. 2000-010229, 2002-296724, and 2002-258435 that photographic performance is improved when the ammonium salt included in the polymer latex is reduced or eliminated. All patents, patent publications, and non-patent literature cited in this specification are hereby expressly incorporated by reference herein.

SUMMARY OF THE INVENTION

The present invention has been made in view of the above circumstances and provides a photothermographic material with the following aspects.

A first aspect of the invention is to provide a photothermographic material comprising, on one side of a support, an image forming layer comprising at least a photosensitive silver halide, a non-photosensitive organic silver salt, a reducing agent for the organic silver salt, and a binder, and at least one non-photosensitive layer and, on the other side of the support, a non-photosensitive back layer, wherein both of at least one layer on the side having the image forming layer and the non-photosensitive back layer comprise an ammonium salt, a total amount of ammonia contained in the two sides is from $5\times10^{-4}$ mol/m$^2$ to $2\times10^{-2}$ mol/m$^2$, and a molar ratio (A2/A1) of an ammonia content of the non-photosensitive back layer (A2) relative to an ammonia content of the at least one layer on the side having the image forming layer (A1) is from 0.3 to 5.0.

A second aspect of the invention is to provide a photothermographic material comprising, on one side of a support, an image forming layer comprising at least a photosensitive silver halide, a non-photosensitive organic silver salt, a reducing agent for the organic silver salt, and a binder, and a non-photosensitive back layer on the other side of the support, wherein the non-photosensitive back layer comprises an ammonium salt, and an ammonia content of the non-photosensitive back layer is from 2 mg/m$^2$ to 100 mg/m$^2$.

DETAILED DESCRIPTION OF THE INVENTION

An object of the present invention is to provide a photothermographic material which exhibits excellent storage stability and provides images with preferable color tone.

In particular, color tone of an image is a significant characteristic of an image recording material used for medical diagnostic applications, and therefore, it is always demanded to obtain favorable color tone stably. The present inventors have intensely analyzed the factors exerting influences on the image tone of the photothermographic material, and as a result, the present inventors found that a small amount of ammonia included in the image forming layer does play an important role and also found that it is important to control the ammonia content to within a specific range. Moreover, the inventors found that the decrease in the ammonia content caused by vaporization during storage, transfer of ammonia to the back layer upon overlapping of the sheets, or the like results in image tone fluctuation. The present inventors have intensively researched means for improvement based on the above analytical result, and thereby arrived at the present invention.

A first embodiment of the photothermographic material of the present invention is a photothermographic material having, on one side of a support, an image forming layer including at least a photosensitive silver halide, a non-photosensitive organic silver salt, a reducing agent for the organic silver salt, and a binder, and at least one non-photosensitive layer and, on the other side of the support, a non-photosensitive back layer, wherein both of at least one layer on the side having the image forming layer and the non-photosensitive back layer contain an ammonium salt, a total amount of ammonia contained in the two sides is from $5\times10^{-4}$ mol/m$^2$ to $2\times10^{-2}$ mol/m$^2$, and a molar ratio (A2/A1) of an ammonia content of the non-photosensitive back layer (A2) relative to an ammonia content of the at least one layer on the side having the image forming layer (A1) is from 0.3 to 5.0. Preferably, the ammonia content of the non-photosensitive back layer is from 5 mg/m$^2$ to 50 mg/m$^2$.

Preferably, the total amount of ammonia is from $1\times10^{-3}$ mol/m$^2$ to $1\times10^{-2}$ mol/m$^2$, and more preferably from $2\times10^{-3}$ mol/m$^2$ to $5\times10^{-3}$ mol/m$^2$.

Preferably, the ratio of ammonia (A2/A1) is from 0.5 to 4.0, and more preferably from 0.7 to 3.0.

When the total amount of ammonia is less than $5\times10^{-4}$ mol/m$^2$, the material provides undesirable results such as yellowish color tone of developed silver images. On the other hand, when the total amount of ammonia exceeds $2\times10^{-2}$ mol/m$^2$, the material provides undesirable results such as in that fluctuation of sensitivity and change in color tone become great due to evaporation of ammonia during storage of the material.

When the ratio of ammonia (A2/A1) is less than 0.3, the material provides undesirable results such as in that fluctuation of sensitivity or fluctuation of color tone becomes great because ammonia transfer from the image forming layer side to the backside occurs during storage of the material. Further, when the ratio of ammonia (A2/A1) exceeds 5.0, the material provides undesirable results such as in that fluctuation of sensitivity or fluctuation of color tone becomes great because ammonia transfer from the backside to the image forming layer side occurs during storage of the material.

A second embodiment of the photothermographic material of the present invention is a photothermographic material having, on one side of a support, an image forming layer including at least a photosensitive silver halide, a non-photosensitive organic silver salt, a reducing agent for the organic silver salt, and a binder, and a non-photosensitive back layer on the other side of the support, wherein the non-photosensitive back layer contains an ammonium salt, and an ammonia content of the non-photosensitive back layer is from 2 mg/m$^2$ to 100 mg/m$^2$. Preferably, the ammonia content of the non-photosensitive back layer is from 5 mg/m$^2$ to 50 mg/m$^2$.

When the ammonia content is less than 2 mg/m$^2$, the material provides undesirable results such as in that change in color tone during raw stock storage of the material deteriorates. Further, when the ammonia content exceeds 100 mg/m$^2$, the material exhibits problems such as deterioration in sensitivity, increase in fog during raw stock storage of the material, or the like.

According to the present invention, a photothermographic material which exhibits excellent storage stability and provides images with preferable color tone is provided.

The ammonia content according to the present invention is a value measured by the following procedure.

<Measuring Method>

Photothermographic material of a size suitable to the measurement is prepared. Concerning the side of the support opposite from the side to be measured, film thereon is peeled off or the side is protected by an adhesive tape or the like. As an extracting solution, a solution obtained by diluting 1 g of acetic acid (90%) with 148 mL of water is prepared. The photothermographic material described above is soaked in the extracting solution for 2 hours to extract the ammonia contained therein. Thereafter, the amount of ammonia in the resulting solution after the extraction is determined by using ion chromatography.

The ammonium salt mentioned above may be either an organic ammonium salt or an inorganic ammonium salt.

As the organic ammonium salt, an ammonium salt of a carboxylic acid is preferable, and an ammonium salt of a dicarboxylic acid is more preferable. A monoammonium salt or a diammonium salt of a compound represented by the following formula (PA) is particularly preferable. A compound represented by the following formula (PM) is most preferable.

Formula (PA)

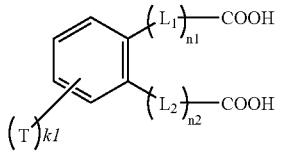

In formula (PA), $L_1$ and $L_2$ each independently represent a divalent linking group; n1 and n2 each independently represent an integer of from 0 to 30; T represents a monovalent substituent; k1 represents an integer of from 0 to 4; and when k1 is 2 or more, plural Ts may be identical or different from each other, or may bond to each other to form a ring.

Formula (PM)

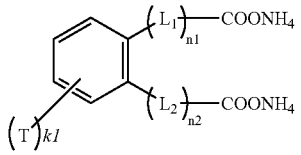

In formula (PM), $L_1$, $L_2$, n1, n2, T, and k1 each have the same meaning as in formula (PA).

As the inorganic ammonium salt, ammonium sulfate, ammonium nitrate, or ammonium phosphate is preferred.

The back layer according to the present invention preferably contains a metal phthalocyanine dye represented by formula (PC-1).

Formula (PC-1)

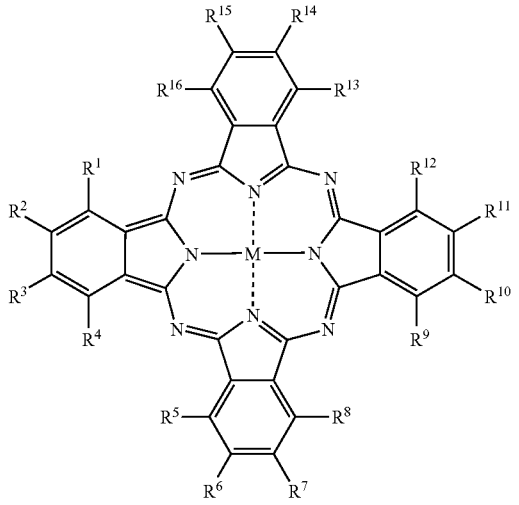

In formula (PC-1), M represents a metal atom. $R^1$, $R^4$, $R^5$, $R^8$, $R^9$, $R^{12}$, $R^{13}$, and $R^{16}$ each independently represent a hydrogen atom or a substituent, and at least one of $R^1$, $R^4$, $R^5$, $R^8$, $R^9$, $R^{12}$, $R^{13}$, and $R^{16}$ is an electron-attracting group. $R^2$, $R^3$, $R^6$, $R^7$, $R^{10}$, $R^{11}$, $R^{14}$ and $R^{15}$ each independently represent a hydrogen atom or a substituent.

Preferably, at least one of $R^1$, $R^4$, $R^5$, $R^8$, $R^9$, $R^{12}$, $R^{13}$, and $R^{16}$ in the metal phthalocyanine dye represented by formula (PC-1) described above is a group represented by formula (II).

$-L^1-R^{17}$ Formula (II)

In formula (II), $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*. ** denotes a bond with a phthalocyanine skeleton at this position, and * denotes a bond with $R^{17}$ at this position. $R_N$ represents a hydrogen atom, an alkyl group, an aryl group, a heterocyclic group, an acyl group, an alkoxycarbonyl group, a carbamoyl group, a sulfonyl group, or a sulfamoyl group. $R^{17}$ represents a hydrogen atom, an alkyl group, an aryl group, or a heterocyclic group.

More preferably, four or more from among $R^1$, $R^4$, $R^5$, $R^8$, $R^9$, $R^{12}$, $R^{13}$, and $R^{16}$ in the metal phthalocyanine dye represented by formula (PC-1) described above are each independently a group represented by formula (II).

Even more preferably, $R^2$, $R^3$, $R^6$, $R^7$, $R^{10}$, $R^{11}$, $R^{14}$, and $R^{15}$ are each a hydrogen atom, and four or more from among $R^1$, $R^4$, $R^5$, $R^8$, $R^9$, $R^{12}$, $R^{13}$, and $R^{16}$ are each independently a group represented by formula (II).

The present invention is explained below in detail.

(Ammonium Salt)

1) Organic Ammonium Salt

The organic ammonium salt used in the present invention is preferably a carboxy ammonium salt, and more preferably a dicarboxy ammonium salt. A monoammonium salt or a diammonium salt of a compound represented by the following formula (PA) is particularly preferred.

Formula (PA)

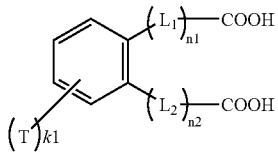

A diammonium salt represented by the following formula (PM) is most preferred.

Formula (PM)

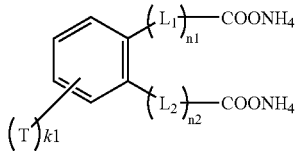

In the formulae, $L_1$ and $L_2$ each independently represent a divalent linking group; n1 and n2 each independently represent an integer of from 0 to 30; T represents a monovalent substituent; k1 represents an integer of from 0 to 4; and when k1 is 2 or more, plural Ts may be identical or different from each other, or may bond to each other to form a ring.

Examples of the monovalent substituent represented by T include an alkyl group (preferably having 1 to 20 carbon atoms, more preferably having 1 to 12 carbon atoms, and particularly preferably having 1 to 8 carbon atoms; for example, methyl, ethyl, n-propyl, iso-propyl, n-butyl, iso-butyl, tert-butyl, n-octyl, n-decyl, n-hexadecyl, cyclopropyl, cyclopentyl, cyclohexyl, and the like), an alkenyl group (preferably having 2 to 20 carbon atoms, more preferably having 2 to 12 carbon atoms, and particularly preferably having 2 to 8 carbon atoms; for example, vinyl, allyl, 2-butenyl, 3-pentenyl, and the like), an alkynyl group (preferably having 2 to 20 carbon atoms, more preferably having 2 to 12 carbon atoms, and particularly preferably having 2 to 8 carbon atoms; for example, propargyl, 3-pentynyl, and the like), an aryl group (preferably having 6 to 30 carbon atoms, more preferably having 6 to 20 carbon atoms, and particularly preferably having 6 to 12 carbon atoms; for example, phenyl, p-methylphenyl, naphthyl, and the like), an amino group (preferably having 0 to 20 carbon atoms, more preferably having 0 to 10 carbon atoms, and particularly preferably having 0 to 6 carbon atoms; for example, amino, methylamino, dimethylamino, diethylamino, dibenzylamino, and the like), an alkoxy group (preferably having 1 to 20 carbon atoms, more preferably having 1 to 12 carbon atoms, and particularly preferably having 1 to 8 carbon atoms; for example, methoxy, ethoxy, isopropoxy, butoxy, and the like), an aryloxy group (preferably having 6 to 20 carbon atoms, more preferably having 6 to 16 carbon atoms, and particularly preferably having 6 to 12 carbon atoms; for example, phenyloxy, 2-naphthyloxy, and the like), an acyl group (preferably having 1 to 20 carbon atoms, more preferably having 1 to 16 carbon atoms, and particularly preferably having 1 to 12 carbon atoms; for example, acetyl, benzoyl, formyl, pivaloyl, and the like), an alkoxycarbonyl group (preferably having 2 to 20 carbon atoms, more preferably having 2 to 16 carbon atoms, and particularly preferably having 2 to 12 carbon atoms; for example, methoxycarbonyl, ethoxycarbonyl, tetradecyloxycarbonyl, and the like), an aryloxycarbonyl group (preferably having 7 to 20 carbon atoms, more preferably having 7 to 16 carbon atoms, and particularly preferably having 7 to 10 carbon atoms; for example, phenyloxycarbonyl and the like), an acyloxy group (preferably having 2 to 20 carbon atoms, more preferably having 2 to 16 carbon atoms, and particularly preferably having 2 to 10 carbon atoms; for example, acetoxy, benzoyloxy, and the like), an acylamino group (preferably having 2 to 20 carbon atoms, more preferably having 2 to 16 carbon atoms, and particularly preferably having 2 to 10 carbon atoms; for example, acetylamino, propionylamino, benzoylamino, and the like), an alkoxycarbonylamino group (preferably having 2 to 20 carbon atoms, more preferably having 2 to 16 carbon atoms, and particularly preferably having 2 to 12 carbon atoms; for example, methoxycarbonylamino and the like), an aryloxycarbonylamino group (preferably having 7 to 20 carbon atoms, more preferably having 7 to 16 carbon atoms, and particularly preferably having 7 to 12 carbon atoms; for example, phenyloxycarbonylamino and the like), a sulfonylamino group (preferably having 1 to 20 carbon atoms, more preferably having 1 to 16 carbon atoms, and particularly preferably having 1 to 12 carbon atoms; for example, methanesulfonylamino, octanesulfonylamino, benzenesulfonylamino, and the like), a sulfamoyl group (preferably having 0 to 20 carbon atoms, more preferably having 0 to 16 carbon atoms, and particularly preferably having 0 to 12 carbon atoms; for example, sulfamoyl, methylsulfamoyl, dimethylsulfamoyl, phenylsulfamoyl, and the like), a carbamoyl group (preferably having 1 to 20 carbon atoms, more preferably having 1 to 16 carbon atoms, and particularly preferably having 1 to 12 carbon atoms; for example, carbamoyl, methylcarbamoyl, diethylcarbamoyl, phenylcarbamoyl, and the like), an alkylthio group (preferably having 1 to 20 carbon atoms, more preferably having 1 to 16 carbon atoms, and particularly preferably having 1 to 12 carbon atoms; for example, methylthio, ethylthio, and the like), an arylthio group (preferably having 6 to 20 carbon atoms, more preferably having 6 to 16 carbon atoms, and particularly preferably having 6 to 12 carbon atoms; for example, phenylthio and the like), a sulfonyl group (preferably having 1 to 20 carbon atoms, more preferably having 1 to 16 carbon atoms, and particularly preferably having 1 to 12 carbon atoms; for example, mesyl, tosyl, and the like), a sulfinyl group (preferably having 1 to 20 carbon atoms, more preferably having 1 to 16 carbon atoms, and particularly preferably having 1 to 12 carbon atoms; for example, methanesulfinyl, benzenesulfinyl, and the like), a ureido group (preferably having 1 to 20 carbon atoms, more preferably having 1 to 16 carbon atoms, and particularly preferably having 1 to 12 carbon atoms; for example, ureido, methylureido, phenylureido, and the like), an amidophosphate group (preferably having 1 to 20 carbon atoms, more preferably having 1 to 16 carbon atoms, and particularly preferably having 1 to 12 carbon atoms; for example, diethyl amidophosphate, phenyl amidophosphate, and the like), a hydroxy group, a carboxy group, a sulfo group, a sulfino group (a sulfinic acid group), a mercapto group, a halogen atom (for example, a fluorine atom, a chorine atom, a bromine atom, or an iodine atom), a cyano group, a nitro group, a hydroxamic acid group, a hydrazino group, a heterocyclic group (for example, imidazolyl, pyridyl, furyl, pyperidyl, morpholino, and the like), and the like.

As examples of the ring which is formed by bonding plural Ts to each other, any well-known condensed ring of phthalic acid can be used, and preferred examples include [3,4]-benzo, [4,5]-benzo, [4,5]-naphtho, [3,4]-methylenedioxy (namely, dioxolo), [4,5]-methylenedioxy, and the like. Moreover, when the substituent can form a salt with an alkali metal or the like, it may form a salt thereof. The substituent or the condensed ring may be further substituted. In the case where two or more substituents exist, these may be identical or different from each other. In the case where plural Ts do not form a ring, k1 is preferably 0, 1, or 2, and particularly preferably 0 or 1.

Preferred examples of the substituent represented by T include an alkyl group, an alkenyl group, an aryl group, an alkoxy group, an aryloxy group, an acyl group, an acyloxy group, an alkoxycarbonyl group, an acylamino group, an alkoxycarbonylamino group, an aryloxycarbonylamino group, a sulfonylamino group, a sulfamoyl group, a carbamoyl group, a ureido group, an amidophosphate group, a hydroxy group, a carboxy group, a sulfo group, a sulfino group, a sulfonyl group, a halogen atom, a cyano group, a nitro group, a heterocyclic group, [3,4]-benzo, [4,5]-benzo, [4,5]-naphtho, [3,4]-methylenedioxy, [4,5]-methylenedioxy. Among them, an alkyl group, an aryl group, an alkoxy group, an aryloxy group, an acyl group, an acylamino group, a sulfonylamino group, a sulfamoyl group, a carbamoyl group, a hydroxy group, a sulfonyl group, a halogen atom, a cyano group, [3,4]-benzo, [4,5]-benzo, [3,4]-methylenedioxy, and [4,5]-methylenedioxy are more preferable; and an alkyl group, an aryl group, an alkoxy group, [4,5]-benzo, and [4,5]-methylenedioxy are particularly preferable.

$L_1$ and $L_2$ each independently represent a divalent linking group, preferably a divalent linking group having a length of 1 atom to 4 atoms, and each may be further substituted. Preferred examples include —$CH_2$—, —$CH_2CH_2$—, —C(=O)—, —CONH—, and —$SO_2NH$—.

n1 and n2 each independently represent an integer of from 0 to 30. As favorable combinations of $L_1$, $L_2$, n1, and n2, when $L_1$ and $L_2$ each represent a linking group having a length of 0 atoms to 2 atoms, n1 and n2 each represent an integer of from 0 to 10, and more preferably from 0 to 6; and when $L_1$ and $L_2$ each represent a linking group having a length of 3 atoms or 4 atoms, n1 and n2 each represent an integer of from 0 to 6.

As more preferred combinations, $L_1$ and $L_2$ each represent —$CH_2$—, —$CH_2CH_2$—, —C(=O)—, —CONH—, or —$SO_2NH$—, and n1 and n2 each represent an integer of from 0 to 2.

The organic acid compounds represented by formula (PA) can be synthesized by a method described in, for example, "SHIN JIKKEN KAGAKU KOZA", vol. 14-III, chapter 5-1, (Maruzen), Organic Functional Group Preparations (Academic Press New York and London), chapter 1-9, Tetrahedron, vol. 31 (20), pages 2607 to 2619, (1975), Angewante Chem., vol. 86 (9), page 349, (1974), and references cited therein. Any commercially available compounds may be also employed.

Preferable examples of the organic acid compound represented by formula (PA) are described below, but the invention is not limited to these examples.

A-1

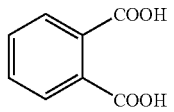

A-2

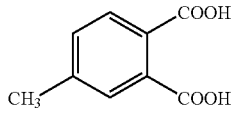

-continued
A-3
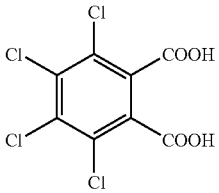
A-4
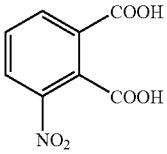
A-5
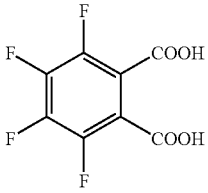
A-6
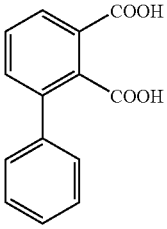
A-7
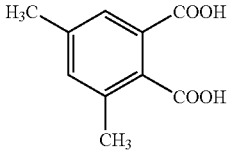
A-8
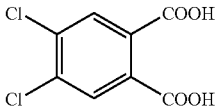
A-9
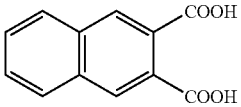
A-10
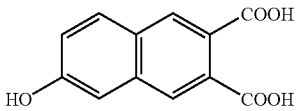
A-11
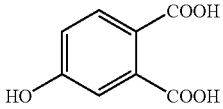
A-12
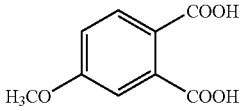
-continued
A-13
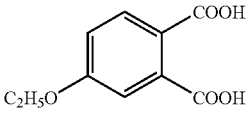
A-14
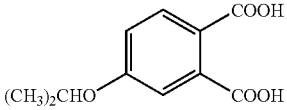
A-15
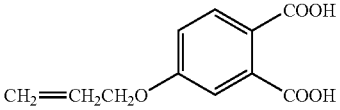
A-16
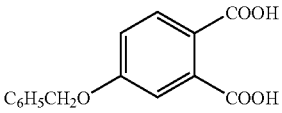
A-17
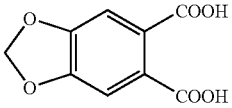
A-18
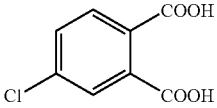
A-19
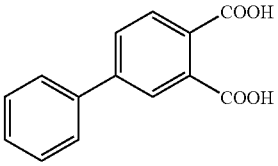
A-20
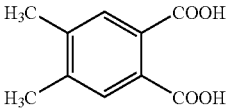
A-21
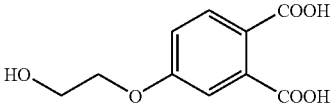
A-22
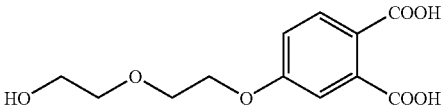
A-23
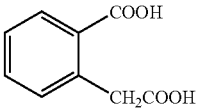
A-24
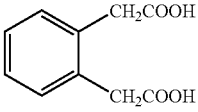

-continued

A-25

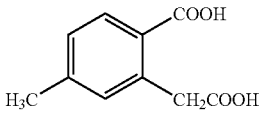

A-26

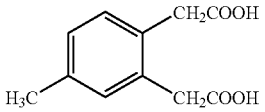

2) Inorganic Ammonium Salt

As the inorganic ammonium salt, a known ammonium salt of a strong acid or weak acid can be employed. Examples of the ammonium salt of a strong acid include ammonium sulfate, ammonium nitrate, ammonium chloride, ammonium phosphate, and the like. Examples of the ammonium salt of a weak acid include ammonium acetate.

3) Ammonium Salt Content

Ammonium Salt Content in the First Embodiment of the Invention

Both of the coated layer on the side having the image forming layer and the non-photosensitive back layer on the opposite side include an ammonium salt, a total amount of ammonia contained in the two sides is from $5\times10^{-4}$ mol/m$^2$ to $2\times10^{-2}$ mol/m$^2$, and a molar ratio (A2/A1) of an ammonia content of the non-photosensitive back layer (A2) relative to an ammonia content of the layer on the side having the image forming layer (A1) is from 0.3 to 5.0. Preferably, the ammonia content of the non-photosensitive back layer is from 5 mg/m$^2$ to 50 mg/m$^2$.

Preferably, the total amount of ammonia is from $1\times10^{-3}$ mol/m$^2$ to $1\times10^{-2}$ mol/m$^2$, and more preferably from $2\times10^{-3}$ mol/m$^2$ to $5\times10^{-3}$ mol/m$^2$.

Preferably, the ratio of ammonia (A2/A1) is from 0.5 to 4.0, and more preferably from 0.7 to 3.0.

As the coated layer on the side having the image forming layer described above, the ammonium salt can be added in at least one of the image forming layer and the non-photosensitive layer. Examples of the non-photosensitive layer include a surface protective layer and an intermediate layer between the surface protective layer and the image forming layer.

The ammonia content of the coated layer on the side having the image forming layer is preferably in a range of from $2.5\times10^{-4}$ mol/m$^2$ to $1\times10^{-2}$ mol/m$^2$, and more preferably from $5\times10^{-4}$ mol/m$^2$ to $5\times10^{-3}$ mol/m$^2$.

As the non-photosensitive back layer described above, the ammonium salt can be added in at least one of a back layer and a back surface protective layer. The ammonia content of the non-photosensitive back layer is preferably in a range of from $2.5\times10^{-4}$ mol/m$^2$ to $1\times10^{-3}$ mol/m$^2$, and more preferably from $5\times10^{-4}$ mol/m$^2$ to $5\times10^{-3}$ mol/m$^2$.

Ammonium Salt Content in the Second Embodiment of the Invention

In the second embodiment of the present invention, the ammonium salt content of the non-photosensitive back layer is from 2 mg/m$^2$ to 100 mg/m$^2$ preferably from 5 mg/m$^2$ to 50 mg/m$^2$, and more preferably from 8 mg/m$^2$ to 30 mg/m$^2$ on the basis of the ammonia amount.

The ammonium salt added in the coating solution may vaporize partially during a manufacturing process or storage of the photothermographic material. For the photothermographic material of the present invention, it is important to keep the ammonium salt content within the above range, and thus, the use of an ammonium compound which hardly evaporates from the film is preferred. As the ammonium compound which hardly evaporates, an organic ammonium salt, which has relatively large molecular weight and is represented by formula (PM), or an ammonium salt of a strong acid is preferred.

Further, the ammonium salt according to the invention may be used alone, or two or more of them may be used in combination. The ammonium salt according to the invention may be added by any method, such as in the form of a solution, powder, a solid fine particle dispersion, or the like. Solid fine particle dispersion can be performed by known means, for example, using a ball mill, a vibrating ball mill, a sand mill, a colloid mill, a jet mill, a roller mill, or the like. An auxiliary dispersing agent may be used when carrying out solid fine particle dispersion.

(Antihalation Dye)

The back layer according to the present invention preferably contains an antihalation dye.

The antihalation dye which can be used in the present invention is preferably a metal phthalocyanine dye, and particularly preferably a compound represented by the following formula (PC-1).

Formula (PC-1)

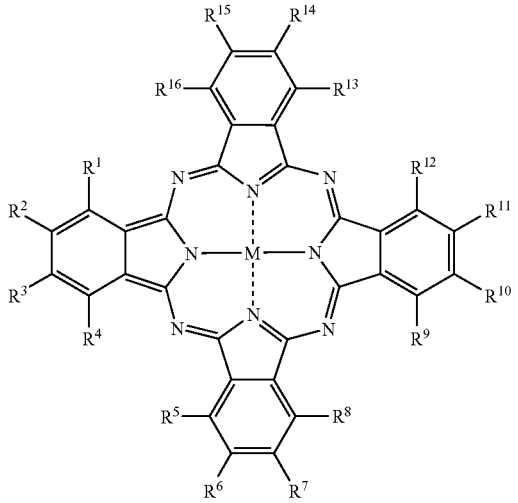

In formula (PC-1), M represents a metal atom. The metal atom may be any metal as long as it forms a stable complex, and a metal selected from the group consisting of Li, Na, K, Be, Mg, Ca, Ba, Al, Si, Cd, Hg, Cr, Fe, Co, Ni, Cu, Zn, Ge, Pd, Sn, Pt, Pb, Sr, and Mn can be used. Mg, Ca, Co, Zn, Pd, or Cu is preferably used, more preferably, Co, Pd, Zn, or Cu is used, and particularly preferably, Cu is used.

In formula (PC-1) described above, $R^1$, $R^4$, $R^5$, $R^8$, $R^9$, $R^{12}$, $R^{13}$, and $R^{16}$ each independently represent a hydrogen atom, a substituent, or an electron-attracting group, and at least one of $R^1$, $R^4$, $R^5$, $R^8$, $R^9$, $R^{12}$, $R^{13}$, and $R^{16}$ is an electron-attracting group.

The electron-attracting group herein is a group selected from the group consisting of a halogen atom, a cyano group, a nitro group, and groups represented by —C(=O)—R, —C(=O)—C(=O)—R, —S(=O)—R, —S(=O)$_2$—R, —C(=N—R')—R, —S(=NR')—R, —S(=NR')$_2$—R, —P(=O)$R_2$, —O—R", —S—R", —N(—R')—C(=O)—R, —N(—R')—S(=O)—R, —N(—R')—S(=O)$_2$—R, —N(—R')—C(=N—R')—R, —N(—R')—S(=NR')$_2$—R, or —N(—R')—P(=O)$R_2$.

Herein R represents a hydrogen atom, an alkyl group, an aryl group, a heterocyclic group, an amino group, an alkyloxy group, an aryloxy group, a heterocyclic oxy group, a hydroxy group, an alkylthio group, an arylthio group, a heterocyclic thio group, or an SH group. R' represents a hydrogen atom, an alkyl group, an aryl group, a heterocyclic group, an acyl group, a sulfonyl group, a sulfinyl group, or a phosphoryl group. R" represents a perfluoroalkyl group, a cyano group, an acyl group, a sulfonyl group, or a sulfinyl group.

The groups represented by R, R', or R" may be substituted by a substituent. Specific examples of the substituent include a halogen atom (a fluorine atom, a chlorine atom, a bromine atom, or an iodine atom), an alkyl group (including an aralkyl group, a cycloalkyl group, an active methine group, and the like), an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group , a heterocyclic amino group, an acylamino group, a sulfonamido group, a ureido group, a thioureido group, an imido group, an alkoxycarbonylamino group, an aryloxycarbonylamino group, a sulfamoylamino group, a semicarbazide group, a thiosemicarbazide group, a hydrazino group, an ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, a group containing an amidophosphate structure or a phosphate ester structure, a silyloxy group (for example, trimethylsilyloxy, or t-butyldimethylsilyloxy), a silyl group (for example, trimethylsilyl, t-butyldimethylsilyl, or phenyldimethylsilyl), and the like. These substituents may be further substituted by these substituents.

In formula (PC-1), a group represented by formula (II) is preferably used as an electron-attracting group.

$$-L^1-R^{17} \qquad \text{Formula (II)}$$

$L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*. ** denotes a bond with a phthalocyanine skeleton at this position. * denotes a bond with $R^{17}$ at this position. $R_N$ represents a hydrogen atom, an alkyl group, an aryl group, a heterocyclic group, an acyl group, an alkoxycarbonyl group, a carbamoyl group, a sulfonyl group, or a sulfamoyl group. $R_N$ may further be substituted by a substituent which $R^1$, $R^4$, $R^5$, $R^8$, $R^9$, $R^{12}$, $R^{13}$, or $R^{16}$ in formula (PC-1) can have. $L^1$ is preferably **—$SO_2$—*, **—$SO_2NR_N$—*, **—CO—*, **—$CONR_N$—*, or **—COO—*, more preferably **—$SO_2$—*, **—$SO_2NR_N$—*, or **—$CONR_N$—*, and particularly preferably **—$SO_2$—* or **—$SO_2NR_N$—*.

$R_N$ is preferably a hydrogen atom, an alkyl group, an aryl group, or a heterocyclic group, more preferably a hydrogen atom, an alkyl group having 1 to 20 carbon atoms, an aryl group having 6 to 20 carbon atoms, or a heterocyclic group having 1 to 20 carbon atoms, even more preferably a hydrogen atom, an alkyl group having 1 to 10 carbon atoms, an aryl group having 6 to 10 carbon atoms, or a heterocyclic group having 1 to 10 carbon atoms, and particularly preferably a hydrogen atom or an alkyl group having 1 to 6 carbon atoms.

$R^{17}$ represents a hydrogen atom, an alkyl group, an aryl group, or a heterocyclic group. In the case where $R^{17}$ represents an alkyl group, an aryl group or a heterocyclic group, these groups may be further substituted by substituents which $R^1$, $R^4$, $R^5$, $R^8$, $R^9$, $R^{12}$, $R^{13}$, or $R^{16}$ in formula (PC-1) can have. $R^{17}$ is preferably an alkyl group or an aryl group, and particularly preferably an alkyl group. $R^{17}$ has 1 to 30 carbon atoms, preferably 1 to 20 carbon atoms, and more preferably 1 to 10 carbon atoms.

$R^{17}$ is preferably substituted by a hydrophilic group. Herein, the hydrophilic group indicates a carboxy group, a sulfo group, a phosphoric acid group, a group having a structure of quaternary salt of nitrogen, a group having a structure of quaternary salt of phosphorus, or a poly(ethylene oxy) group. In the case where the hydrophilic group is a carboxy group, a sulfo group, or a phosphoric acid group, the hydrophilic group may have a counter cation, when necessary. As the counter cation, a metal cation, an ammonium ion, a group having a structure of quaternary salt of nitrogen, or a group having a structure of a quaternary salt of phosphorus is used.

In the case where W is a group having a structure of quaternary salt of nitrogen or a group having a structure of quaternary salt of phosphorus, W may have a counter anion, when necessary. As examples of the counter anion, a halogen ion, a sulfate ion, a nitrate ion, a phosphate ion, an oxalate ion, an alkanesulfonate ion, an arylsulfonate ion, an alkanecarboxylate ion, an arylcarboxylate ion, and the like can be described. The hydrophilic group is preferably a carboxy group, a sulfo group, or a phosphoric acid group, and more preferably a carboxy group or a sulfo group. In this case, as a counter cation, $Li^+$, $Na^+$, $K^+$, $Mg^{2+}$, $Ca^{2+}$ or $NH_4^+$ is preferably used, more preferably, $Li^+$, $Na^+$, $K^+$ or $NH_4^+$ is used, and particularly preferably, $Li^+$ or $Na^+$ is used.

In formula (PC-1), when $R^1$, $R^4$, $R^5$, $R^8$, $R^9$, $R^{12}$, $R^{13}$, or $R^{16}$ is a substituent, the substituent can be a substituent selected from the same group as R, R', or R" in formula (PC-1) can have. These substituents may be further substituted by these substituents.

The substituents are preferably a halogen atom, an alkyl group, an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a sulfonyloxy group, an imido group, a sulfamoylamino group, a semicarbazide group, a thiosemicarbazide group, a nitro group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, or a group containing an amidophosphate structure or a phosphate ester structure. More preferably, an alkyl group, an aryl group, a heterocyclic group, an acyl group, an alkoxycarbonyl group, a carbamoyl group, a carboxy group or a salt thereof, an oxalyl group, an oxamoyl group, a cyano group, an imido group, a sulfamoylamino group, an alkylsulfonyl group, an arylsulfonyl group, an alkylsulfinyl group, an arylsulfinyl group, a sulfo group or a salt thereof, a sulfamoyl group, an acylsulfamoyl group, or a sulfonylsulfamoyl group or a salt thereof is used.

Even more preferably, an aryl group, a heterocyclic group, an acyl group, an alkoxycarbonyl group, a carbamoyl group, a carboxy group or a salt thereof, an alkylsulfonyl group, an arylsulfonyl group, an alkylsulfinyl group, an arylsulfinyl group, a sulfo group or a salt thereof, or a sulfamoyl group is used.

In the compound represented by formula (PC-1), preferably, four or more from among $R^1$, $R^4$, $R^5$, $R^8$, $R^9$, $R^{12}$, $R^{13}$, and $R^{16}$ are each independently a group represented by formula (II), and more preferably, at least one of R in each combination of $R^1$ and $R^4$, $R^5$ and $R^8$, $R^9$ and $R^{12}$, and $R^{13}$ and $R^{16}$ is a group represented by formula (II). Particularly preferably, one of R in each combination of $R^1$ and $R^4$, $R^5$ and $R^8$, $R^9$ and $R^{12}$, and $R^{13}$ and $R^{16}$ is a group represented by formula (II), and the other is a hydrogen atom. When a plural number of groups represented by formula (II) are present in a same molecule, these may be identical or different from one another.

In formula (PC-1), $R^2$, $R^3$, $R^6$, $R^7$, $R^{10}$, $R^{11}$, $R^{14}$, and $R^{15}$ each independently represent a hydrogen atom or a substituent. Herein, the substituent is selected from the same range as $R^1$, $R^4$, $R^5$, $R^8$, $R^9$, $R^{12}$, $R^{13}$, and $R^{16}$ in formula (PC-1) can have.

$R^2$, $R^2$, $R^3$, $R^6$, $R^7$, $R^{10}$, $R^{11}$, $R^{14}$, and $R^{15}$ are preferably a hydrogen atom, a halogen atom, a carboxy group, an alkoxycarbonyl group, an acyl group, a sulfo group, a sulfamoyl group, a sulfonyl group, an alkyl group, an aryl group, or a heterocyclic group. More preferable are a hydrogen atom, a halogen atom, a sulfo group, a sulfamoyl group, and a sulfonyl group, and particularly preferable are a hydrogen atom, a sulfo group, and a halogen atom.

In general, phthalocyanine compounds having a plural number of substituents may have a regioisomer, in which the substituents have different bonding positions.

The compounds represented by formula (PC-1) in the invention are not exceptional. In some cases several regioisomers may be present. In the invention, the phthalocyanine compound may be used as a single compound but it may be used as a mixture of regioisomers. In the case where a mixture of regioisomers is used, any number of regioisomers, any substitution position in the isomer, and any ratio of isomers may be employed.

Examples of the compound represented by formula (PC-1) used in the present invention are shown below. However, the present invention is not limited by these examples. In the following examples of the compound, mixtures of regioisomers are described as a single compound.

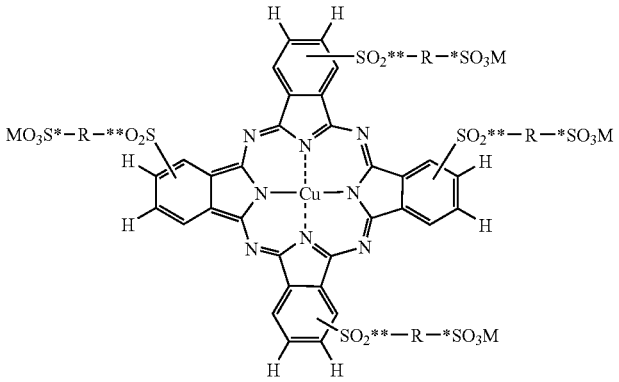

| | | Compound No. | | |
|---|---|---|---|---|
| | | M = Li | M = Na | M = K |
| **—R—* = | **—$CH_2CH_2$—* | 1 | 10 | 19 |
| | **—$CH_2CH_2CH_2$—* | 2 | 11 | 20 |
| | **—$CH_2CH_2CH_2CH_2$—* | 3 | 12 | 21 |
| | **—$CH_2CH_2CH_2CH_2CH_2$—* | 4 | 13 | 22 |
| | **—$CH_2CH_2$—$(OCH_2CH_2)n$—* | | | |
| | n = 1 | 5 | 14 | 23 |
| | 2 | 6 | 15 | 24 |
| | 3 | 7 | 16 | 25 |
| | 4 | 8 | 17 | 26 |
| | 5 | 9 | 18 | 27 |

| | Compound No. | |
|---|---|---|
| | M = Li | M = Na |
| 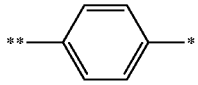 | 28 | 31 |

-continued

| | | |
|---|---|---|
| 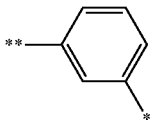 | 29 | 32 |
| 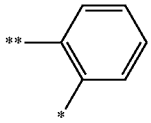 | 30 | 33 |

| | Compound No. | |
|---|---|---|
| | M = Li | M = Na |
| 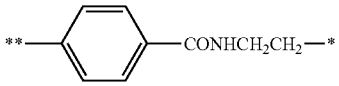 | 34 | 37 |
| 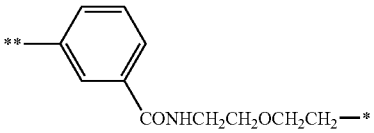 | 35 | 38 |
| 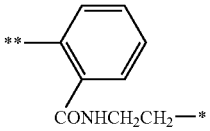 | 36 | 39 |

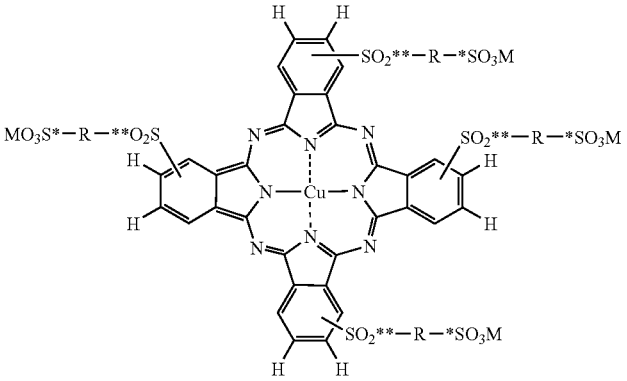

| | | Compound No. | |
|---|---|---|---|
| **—R—* = | **—$CH_2CH_2$—* | 40 | M = Li & $NH_4$ (Li/$NH_4$ = 3/1) |
| | | 41 | M = Li & $NH_4$ (Li/$NH_4$ = 2/2) |
| | | 42 | M = Na & $NH_4$ (Na/$NH_4$ = 3/1) |
| | | 43 | M = Na & $NH_4$ (Na/$NH_4$ = 2/2) |
| | | 44 | M = Na & $NH_4$ (Na/$NH_4$ = 1/3) |
| | **—$CH_2CH_2CH_2$—* | 45 | M = Li & $NH_4$ (Li/$NH_4$ = 3/1) |
| | | 46 | M = Li & $NH_4$ (Li/$NH_4$ = 2/2) |
| | | 47 | M = Li & $NH_4$ (Li/$NH_4$ = 1/3) |
| | | 48 | M = Na & $NH_4$ (Na/$NH_4$ = 3/1) |
| | | 49 | M = Na & $NH_4$ (Na/$NH_4$ = 2/2) |
| | | 50 | M = Na & $NH_4$ (Na/$NH_4$ = 1/3) |
| | | 51 | M = K & $NH_4$ (K/$NH_4$ = 3/1) |
| | | 52 | M = K & $NH_4$ (K/$NH_4$ = 2/2) |
| | | 53 | M = K & $NH_4$ (K/$NH_4$ = 1/3) |
| | | 54 | M = $Et_4N$ |
| | **—$CH_2CH_2CH_2CH_2$—* | 55 | M = Li & $NH_4$ (Li/$NH_4$ = 3/1) |
| | | 56 | M = Li & $NH_4$ (Li/$NH_4$ = 2/2) |
| | | 57 | M = Na & $NH_4$ (Na/$NH_4$ = 3/1) |
| | | 58 | M = Na & $NH_4$ (Na/$NH_4$ = 2/2) |
| | | 59 | M = Na & $NH_4$ (Na/$NH_4$ = 1/3) |

-continued
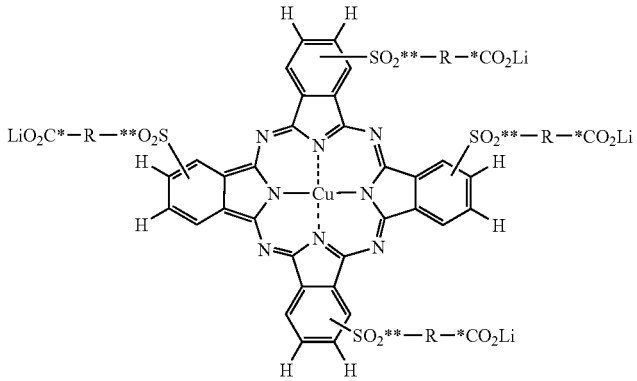
| | | Compound No. |
|---|---|---|
| **—R—* = | **—$CH_2CH_2$—* | 60 |
| | **—$CH_2CH_2CH_2$—* | 61 |
| | **—$CH_2CH_2CH_2CH_2$—* | 62 |
| | **—$CH_2CH_2CH_2CH_2CH_2$—* | 63 |
| | **—$CH_2CH_2$—$(OCH_2CH_2)n$—* | 64 |
| | n = 1 | 65 |
| | 2 | 66 |
| | 3 | 67 |
| | 4 | 68 |
| | 5 | 69 |
| Compound No. | | Compound No. | |
|---|---|---|---|
| 70 | 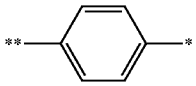 | 73 | 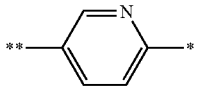 |
| 71 | 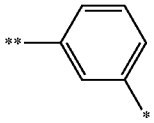 | 74 | 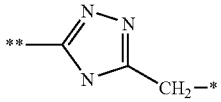 |
| 72 | 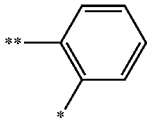 | 75 | 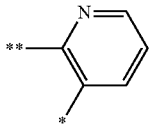 |
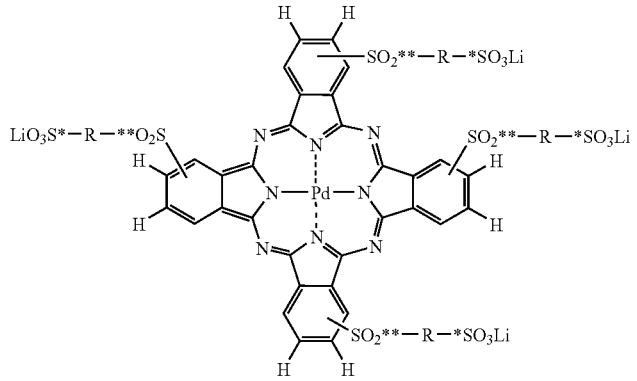
| | | Compound No. |
|---|---|---|
| **—R—* = | **—$CH_2CH_2$—* | 76 |
| | **—$CH_2CH_2CH_2$—* | 77 |
| | **—$CH_2CH_2CH_2CH_2$—* | 78 |
| | **—$CH_2CH_2CH_2CH_2CH_2$—* | 79 |
| | **—$CH_2CH_2$—$(OCH_2CH_2)n$—* | |

-continued
| | | |
|---|---|---|
| | n = 1 | 80 |
| | 2 | 81 |
| | 3 | 82 |
| | 4 | 83 |
| | 5 | 84 |
| | Compound No. | | Compound No. |
|---|---|---|---|
| 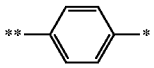 | 85 | 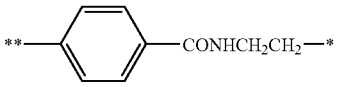 | 88 |
| 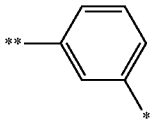 | 86 | 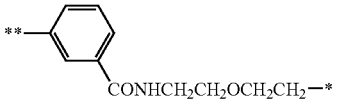 | 89 |
| 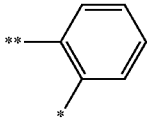 | 87 | 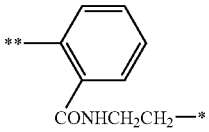 | 90 |
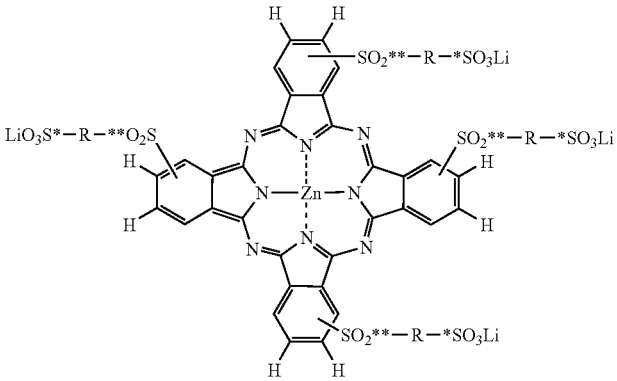
| | | Compound No. |
|---|---|---|
| **—R—* = | **—$CH_2CH_2$—* | 91 |
| | **—$CH_2CH_2CH_2$—* | 92 |
| | **—$CH_2CH_2CH_2CH_2$—* | 93 |
| | **—$CH_2CH_2CH_2CH_2CH_2$—* | 94 |
| | **—$CH_2CH_2$—$(OCH_2CH_2)n$—* | |
| | n = 1 | 95 |
| | 2 | 96 |
| | 3 | 97 |
| | 4 | 98 |
| | 5 | 99 |
| | Compound No. | | Compound No. |
|---|---|---|---|
| 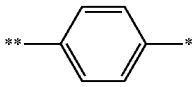 | 100 | 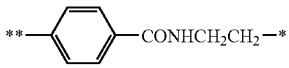 | 103 |
| 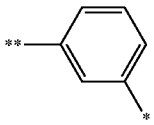 | 101 | 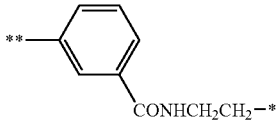 | 104 |

-continued
| 102 | 105 |
|---|---|
| 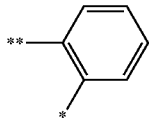 | 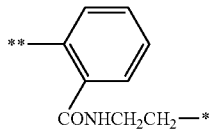 |
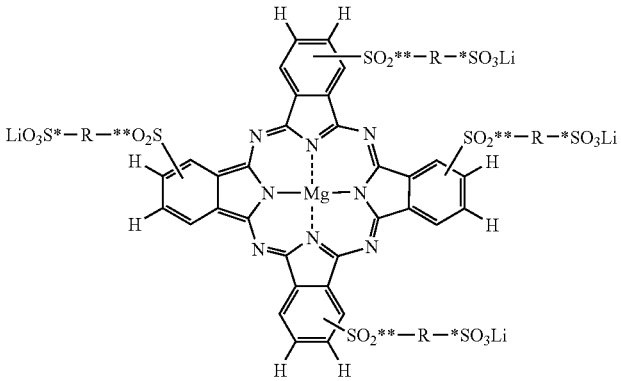
| | | Compound No. |
|---|---|---|
| **—R—* = | **—$CH_2CH_2$—* | 106 |
| | **—$CH_2CH_2CH_2$—* | 107 |
| | **—$CH_2CH_2CH_2CH_2$—* | 108 |
| | **—$CH_2CH_2CH_2CH_2CH_2$—* | 109 |
| | **—$CH_2CH_2$—$(OCH_2CH_2)n$—* | |
| | n = 1 | 110 |
| | 2 | 111 |
| | 3 | 112 |
| | 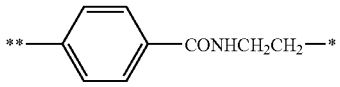 | 113 |
| | 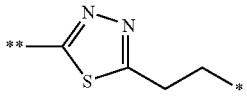 | 114 |
| | 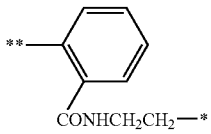 | 115 |
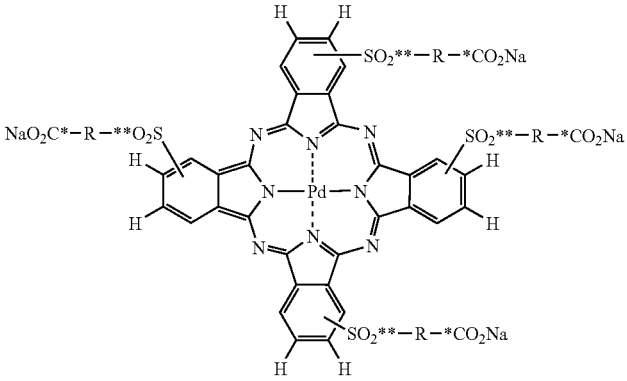
| | | Compound No. |
|---|---|---|
| **—R—* = | **—$CH_2CH_2CH_2$—* | 116 |
| | **—$CH_2CH_2CH_2CH_2$—* | 117 |
| | **—$CH_2CH_2CH_2CH_2CH_2$—* | 118 |

-continued
| | |
|---|---|
| **—$CH_2CH_2$—($OCH_2CH_2$)n—* | |
| n = 1 | 119 |
| 2 | 120 |
| 3 | 121 |
| Compound No. | | Compound No. | |
|---|---|---|---|
| 122 | 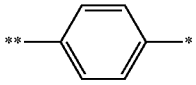 | 124 | 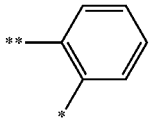 |
| 123 | 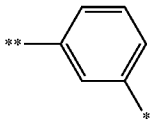 | 125 | 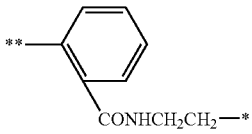 |
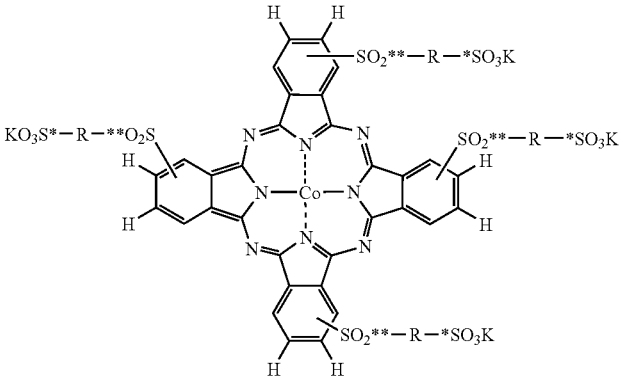
| | | Compound No. |
|---|---|---|
| **—R—* = | **—$CH_2CH_2CH_2$—* | 126 |
| | **—$CH_2CH_2CH_2CH_2$—* | 127 |
| | **—$CH_2CH_2CH_2CH_2CH_2$—* | 128 |
| | **—$CH_2CH_2$—($OCH_2CH_2$)n—* | |
| | n = 1 | 129 |
| | 2 | 130 |
| | 3 | 131 |
| Compound No. | | Compound No. | |
|---|---|---|---|
| 132 | 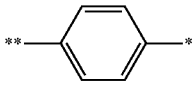 | 134 | 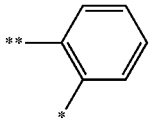 |
| 133 | 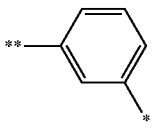 | 135 | 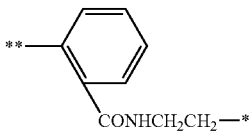 |

-continued
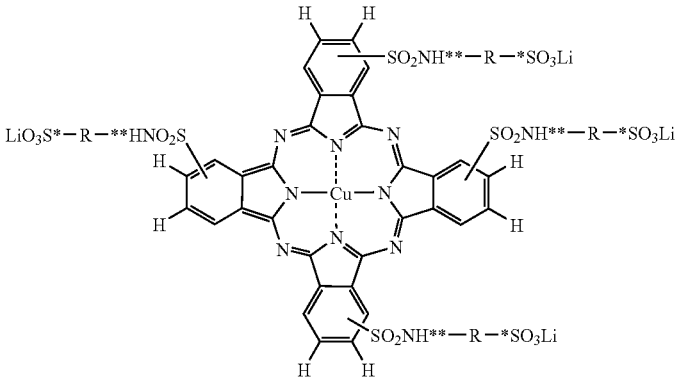
| | | Compound No. |
|---|---|---|
| **—R—* = | **—$CH_2CH_2$—* | 136 |
| | **—$CH_2CH_2CH_2$—* | 137 |
| | **—$CH_2CH_2CH_2CH_2$—* | 138 |
| | **—$CH_2CH_2CH_2CH_2CH_2$—* | 139 |
| | **—$CH_2CH_2$—$(OCH_2CH_2)n$—* | |
| | n = 1 | 140 |
| | 2 | 141 |
| | 3 | 142 |
| | Compound No. | | Compound No. |
|---|---|---|---|
| 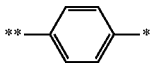 | 143 | 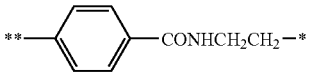 | 146 |
| 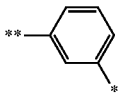 | 144 | 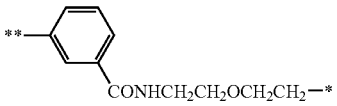 | 147 |
| 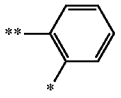 | 145 | 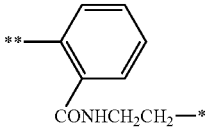 | 148 |
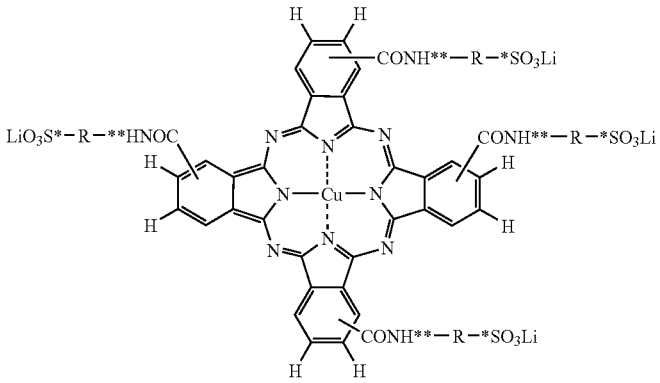
| | | Compound No. |
|---|---|---|
| **—R—* = | **—$CH_2CH_2$—* | 149 |
| | **—$CH_2CH_2CH_2$—* | 150 |
| | **—$CH_2CH_2CH_2CH_2$—* | 151 |
| | **—$CH_2CH_2CH_2CH_2CH_2$—* | 152 |
| | **—$CH_2CH_2$—$(OCH_2CH_2)n$—* | |
| | n = 1 | 153 |

-continued
| | |
|---|---|
| 2 | 154 |
| 3 | 155 |
| | Compound No. | | Compound No. |
|---|---|---|---|
| 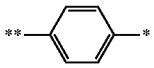 | 156 | 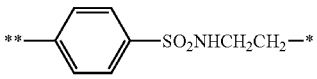 | 159 |
| 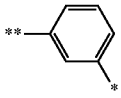 | 157 | 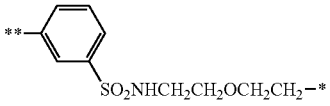 | 161 |
| 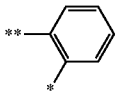 | 158 | 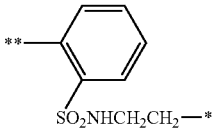 | 162 |
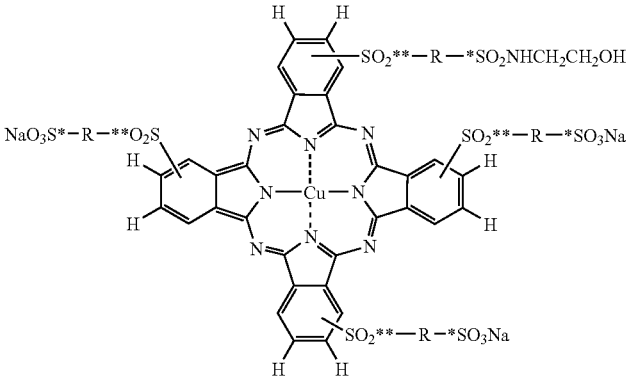
| | | Compound No. |
|---|---|---|
| **—R—* = | **—$CH_2CH_2CH_2$—* | 163 |
| | **—$CH_2CH_2CH_2CH_2$—* | 164 |
| | **—$CH_2CH_2CH_2CH_2CH_2$—* | 165 |
| | **—$CH_2CH_2$—$(OCH_2CH_2)n$—* | |
| | n = 1 | 166 |
| | 2 | 167 |
| | 3 | 168 |
| | Compound No. | | Compound No. |
|---|---|---|---|
| 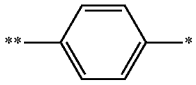 | 169 | 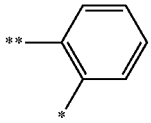 | 171 |
| 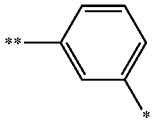 | 170 | 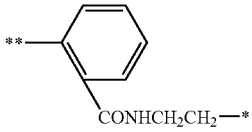 | 172 |

-continued
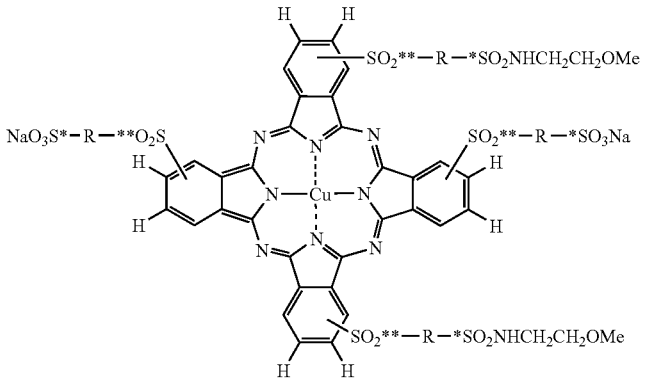
| | | Compound No. |
|---|---|---|
| **—R—* = | **—$CH_2CH_2CH_2$—* | 173 |
| | **—$CH_2CH_2CH_2CH_2$—* | 174 |
| | **—$CH_2CH_2CH_2CH_2CH_2$—* | 175 |
| | **—$CH_2CH_2$—$(OCH_2CH_2)n$—* | |
| | n = 1 | 176 |
| | 2 | 177 |
| | 3 | 178 |
| | 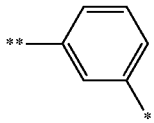 | 179 |
| | 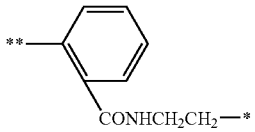 | 180 |
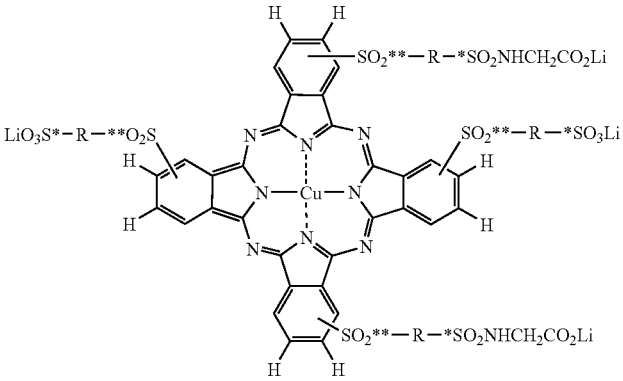
| | | Compound No. |
|---|---|---|
| **—R—* = | **—$CH_2CH_2CH_2$—* | 181 |
| | **—$CH_2CH_2CH_2CH_2$—* | 182 |
| | **—$CH_2CH_2CH_2CH_2CH_2$—* | 183 |
| | **—$CH_2CH_2$—$(OCH_2CH_2)n$—* | |
| | n = 1 | 184 |
| | 2 | 185 |
| | 3 | 186 |
| | 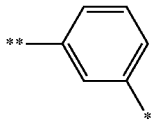 | 187 |

-continued
188
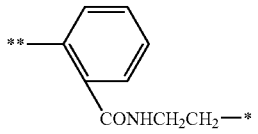
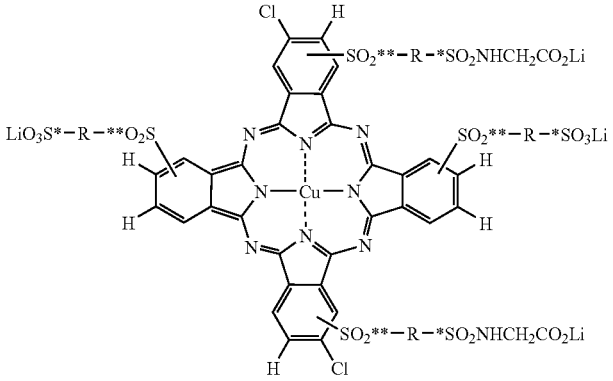
| | | Compound No. |
|---|---|---|
| **—R—* = | **—$CH_2CH_2CH_2$—* | 189 |
| | **—$CH_2CH_2CH_2CH_2$—* | 190 |
| | **—$CH_2CH_2CH_2CH_2CH_2$—* | 191 |
| | 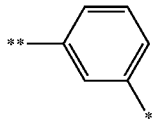 | 192 |
| | 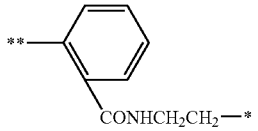 | 193 |
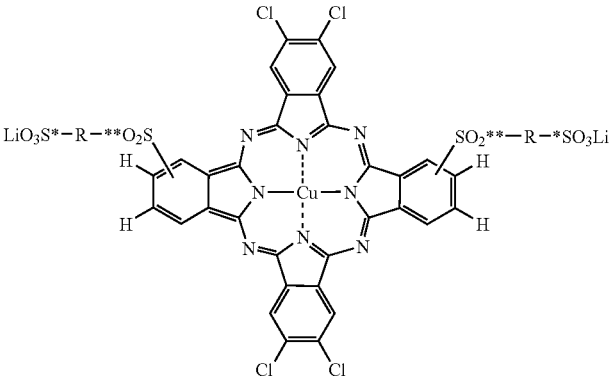
| | | Compound No. |
|---|---|---|
| **—R—* = | **—$CH_2CH_2CH_2$—* | 194 |
| | **—$CH_2CH_2CH_2CH_2$—* | 195 |
| | **—$CH_2CH_2CH_2CH_2CH_2$—* | 196 |
| | 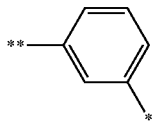 | 197 |

-continued
| | |
|---|---|
| 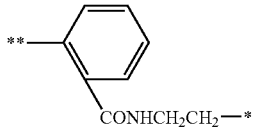 | 198 |
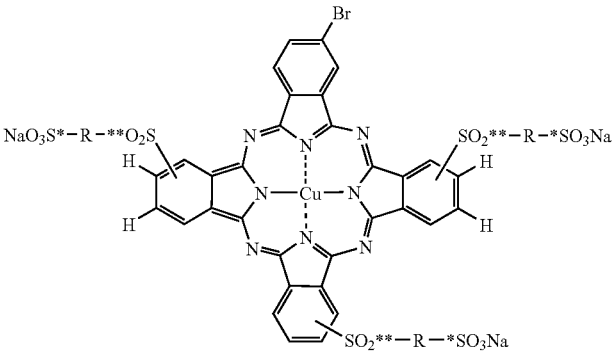
| | | Compound No. |
|---|---|---|
| **—R—* = | **—$CH_2CH_2CH_2$—* | 199 |
| | **—$CH_2CH_2CH_2CH_2$—* | 200 |
| | **—$CH_2CH_2CH_2CH_2CH_2$—* | 201 |
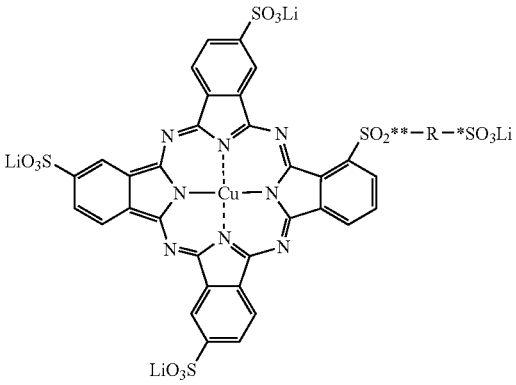
| | | Compound No. |
|---|---|---|
| **—R—* = | **—$CH_2CH_2CH_2$—* | 202 |
| | **—$CH_2CH_2CH_2CH_2$—* | 203 |
| | **—$CH_2CH_2CH_2CH_2CH_2$—* | 204 |
| 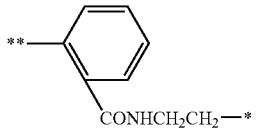 | | 205 |

-continued

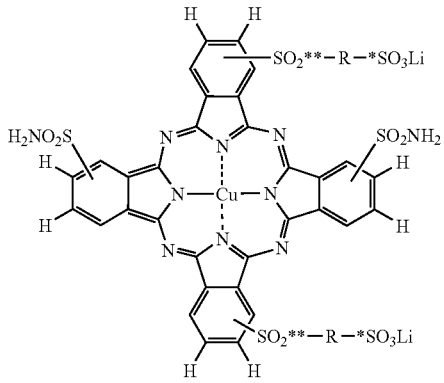

| | | Compound No. |
|---|---|---|
| **—R—* = | **—$CH_2CH_2$—* | 206 |
| | **—$CH_2CH_2CH_2$—* | 207 |
| | **—$CH_2CH_2CH_2CH_2$—* | 208 |
| | **—$CH_2CH_2CH_2CH_2CH_2$—* | 209 |
| | **—$CH_2CH_2$—$(OCH_2CH_2)n$—* | |
| | n = 1 | 210 |
| | 2 | 211 |
| | 3 | 212 |

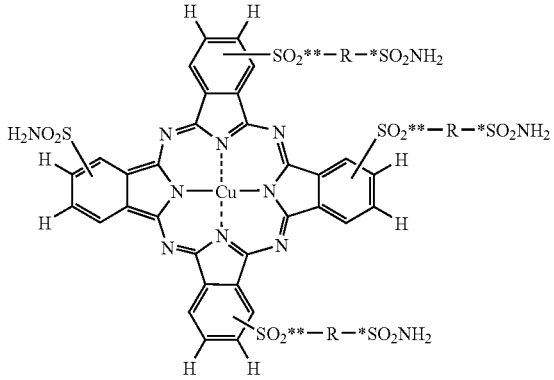

| | | Compound No. |
|---|---|---|
| **—R—* = | **—$CH_2CH_2$—* | 213 |
| | **—$CH_2CH_2CH_2$—* | 214 |
| | **—$CH_2CH_2CH_2CH_2$—* | 215 |
| | **—$CH_2CH_2CH_2CH_2CH_2$—* | 216 |
| | **—$CH_2CH_2$—$(OCH_2CH_2)n$—* | |
| | n = 1 | 217 |
| | 2 | 218 |
| | 3 | 219 |

<Adding Method>

The metal phthalocyanine dye according to the present invention may be used alone, or two or more of them may be used in combination, depending on needs, from the points of absorption density degree at the exposure wavelength, color tone, or the like. The metal phthalocyanine dye according to the present invention is preferably water soluble and is preferably used at the manufacturing of photothermographic material as an aqueous solution prepared in advance by water as a medium. In the said aqueous solution, the water-soluble phthalocyanine compound according to the present invention is contained in an amount of from 0.1% by weight to 30% by weight, preferably from 0.5% by weight to 20% by weight, and more preferably from 1% by weight to 8% by weight. The aqueous solution further may contain a water-soluble organic solvent or an auxiliary additive. The content of the water-soluble organic solvent is from 0% by weight to 30% by weight, and preferably from 5% by weight to 30% by weight. The content of the auxiliary additive is from 0% by weight to 5% by weight, and preferably from 0% by weight to 2% by weight.

At the preparation of an aqueous solution of the water-soluble phthalocyanine compound according to the present invention, as specific examples of the usable water-soluble organic solvent, alkanol having 1 to 4 carbon atoms such as methanol, ethanol, propanol, isopropanol, butanol, isobutanol, sec-butanol, tert-butanol, or the like; amidocarboxylate such as N,N-dimethylformamide, N,N-dimethylacetamide, or the like; lactams such as ε-caprolactam, N-methylpyrrolidin-2-one, or the like; urea; a cyclic urea such as 1,3-dimethylimidazolidin-2-one, 1,3-dimethylhexahydropyrimid-2-one, or the like; ketone or ketoalcohol such as acetone, methyl ethyl ketone, 2-methyl-2-hydroxypentan-4-one, or the like; ether such as tertahydrofuran, dioxane, or the like; mono-, oligo-, and polyalkylene glycol or thioglycol having an alkylene unit with 2 to 6 carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, polypropylene glycol, or the like; polyol (triol) such as glycerine, hexane-1,2,6-triol, or the like; alkyl ether with 1 to 4 carbon atoms of poly-alcohol such as ethylene glycol monomethyl ether, ethylene glycol monoethyl ether, diethylene glycol monomethyl ether, diethylene glycol monoethyl ether, triethylene glycol monomethyl ether, triethylene glycol monoethyl ether, or the like; γ-butylolactone, dimethylsulfoxide, and the like are described. Two or more of these water-soluble organic solvents may be used in combination.

Among the water-soluble organic solvents described above, urea, N-methylpyrrolidin-2-one, mono, di, or trialkylene glycol having an alkylene unit with 2 to 6 carbon atoms are preferable, and mono, di, or triethylene glycol, dipropylene glycol, dimethylsulfoxide, and the like are more preferable. Particularly, N-methlpyrrolidin-2-one, diethylene glycol, dimethyl sulfoxide, or urea is preferably used, and urea is most preferable. As the water-soluble phthalocyanine dye according to the invention is diluted by mixing the said aqueous solution with various chemicals at the production of photothermographic material, the method of containing a water-soluble organic solvent, besides the said aqueous solution, in an amount of from 1 mol to 500 mol per 1 mol of the water-soluble metal phthalocyanine compound is also preferably applied.

Examples of the auxiliary additive include an antiseptic, a pH adjusting agent, a chelating agent, a rust-preventing agent, a water-soluble ultraviolet absorber, a water-soluble polymer, a dye-solubilizing agent, a surfactant, and the like, and they are added if necessary.

Examples of the antiseptic include sodium dehydroacetate, sodium sorbinate, sodium 2-pyridinethiol-1-oxide, sodium benzoate, sodium pentachlorophenol, benzisothiazolinone and salts thereof, p-hydroxybenzoate esters, and the like.

As the pH adjusting agent, any compound can be applied as long as it can control the pH of the prepared aqueous solution within a range of from 4 to 11 without any adverse effect. Examples of the pH adjusting agent include an alkanolamine such as diethanolamine or triethanolamine; an alkali metal salt of hydroxide such as lithium hydroxide, sodium hydroxide, or potassium hydroxide; ammonium hydroxide; and an alkali metal salt of carbonic acid such as lithium carbonate, sodium carbonate, or potassium carbonate.

Examples of the chelating agent include a sodium salt of ethylenediaminetetraacetic acid, a sodium salt of nitrilotriacetic acid, a sodium salt of hydroxyethylethylenediaminetriacetic acid, a sodium salt of diethylenetriaminepentaacetic acid, a sodium salt of uracildiacetic acid, and the like. Examples of the rust-preventing agent include acid sulfite, sodium thiosulfate, thioglycolic acid ammonium salt, diisopropyl ammonium nitrite, pentaerythritol tetranitrate, dicyclohexylammonium nitrite, and the like. Examples of the water-soluble polymer include poly(vinyl alcohol), a cellulose derivative, polyamine, polyimine, and the like. Examples of the water-soluble ultraviolet absorber include a sulfonated benzophenone, a sulfonated benztriazole, and the like. Examples of the dye-solubilizing agent include ε-caprolactam, ethylene carbonate, urea, and the like. Examples of the surfactant include well-known surfactants of anionic, cationic, and nonionic surfactants and, for example, a surfactant of acetylene glycol type or the like is also preferably used.

<Layer to be Added>

The metal phthalocyanine dye according to the present invention is added into the coating solution for the back layer or the coating solution for the back protective layer. Preferably, the metal phthalocyanine dye is added into the coating solution for the back layer in combination with a mordant or the like, which has an electronic interaction with the metal phthalocyanine dye, and is used by fixing it to the mordant or the like.

<Range of Addition Amount>

The addition amount of the dye according to the present invention is determined by comprehensive property including additives such as photosensitive silver halide, organic silver salt, color-tone-adjusting agent, and the like. The dye according to the present invention is added in an amount as such that the optical density by the dye itself is preferably from 0.1 to 0.8, and more preferably from 0.2 to 0.6 when measured at the absorption maximum wavelength of the dye. To obtain the above optical density, the addition amount of the dye is generally from 5 $mg/m^2$ to 100 $mg/m^2$, and preferably from 10 $mg/m^2$ to 50 $mg/m^2$.

(Non-Photosensitive Organic Silver Salt)

1) Composition

The non-photosensitive organic silver salt which can be used in the present invention is relatively stable to light but serves to supply silver ions and forms silver images when heated to 80° C. or higher in the presence of an exposed photosensitive silver halide and a reducing agent. The organic silver salt may be any organic substance which supplies silver ions that are reducible by a reducing agent. Such a non-photosensitive organic silver salt is disclosed, for example, in JP-A No. 10-62899 (paragraph Nos. 0048 to 0049), European Patent (EP) No. 803,764A1 (page 18, line 24 to page 19, line 37), EP No. 962,812A1, JP-A Nos. 11-349591, 2000-7683, and 2000-72711, and the like. A silver salt of an organic acid, particularly, a silver salt of a long-chained aliphatic carboxylic acid (having 10 to 30 carbon atoms, and preferably having 15 to 28 carbon atoms) is preferable. Preferred examples of the silver salt of a fatty acid include silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably 0.85 mol % or higher, and even more preferably 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt that can be used in the invention, and it may be needle-like, rod-like, tabular, or flake shaped.

In the invention, a flake shaped organic silver salt is preferred. Short needle-like, rectangular, cubic, or potato-like indefinite shaped particles with a length ratio of major axis relative to minor axis being 5 or lower are also used preferably. Such organic silver salt particles suffer less from fogging during thermal development compared with long needle-like particles with the length ratio of major axis relative to minor axis being higher than 5. Particularly, a particle with the length ratio of major axis relative to minor axis being 3 or lower is preferred since it can improve mechanical stability of the coated film. In the present specification, the flake shaped organic silver salt is defined as described below. When an organic silver salt is observed under an electron microscope, calculation is made while approximating the shape of a particle of the organic silver salt to a rectangular body, designating respective sides of the rectangular body as a, b, c from the shortest side (c may be identical with b.), and determining x based on the numerical values a and b for the shorter sides as follows.

$$x=b/a$$

In this manner, x is determined for about 200 particles, and those satisfying the relationship of x (average)≧1.5 based on an average value x are defined as flake shaped. The relationship is preferably 30≧x (average)≧1.5, and more preferably, 15≧x (average)≧1.5. Incidentally, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm, and more preferably from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake shaped particle is preferably from 1.1 to 30, and more preferably from 1.1 to 15 with a viewpoint of causing less agglomeration in the photothermographic material and improving the image storability.

As the particle size distribution of the organic silver salt, mono-dispersion is preferred. In the mono-dispersion, the percentage for the value obtained by dividing the standard deviation for the lengths of the minor axis and the major axis by the minor axis and the major axis respectively is preferably 100% or less, more preferably 80% or less, and even more preferably 50% or less. The shape of the organic silver salt can be measured by analyzing a dispersion of an organic silver salt as transmission type electron microscopic images. Another method of measuring the mono-dispersion is a method of determining the standard deviation of the volume-weighted mean diameter of the organic silver salt in which the percentage for the value defined by the volume-weighted mean diameter (variation coefficient) is preferably 100% or less, more preferably 80% or less, and even more preferably 50% or less. The mono-dispersion can be determined from particle size (volume-weighted mean diameter) obtained, for example, by a measuring method of irradiating a laser beam to organic silver salts dispersed in a liquid, and determining a self correlation function of the fluctuation of scattered light with respect to the change in time.

3) Preparation

Methods known in the art can be applied to the method for producing the organic silver salt used in the invention and to the dispersing method thereof. For example, reference can be made to JP-A No. 10-62899, EP Nos. 803,763A 1 and 962, 812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution, and even more preferably, positive addition of the photosensitive silver salt is not conducted.

In the invention, the photothermographic material can be manufactured by mixing an aqueous dispersion of the organic silver salt and an aqueous dispersion of a photosensitive silver salt, and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably from 2 mol % to 20 mol % and, particularly preferably from 3 mol % to 15 mol %. A method of mixing two or more aqueous dispersions of organic silver salts and two or more aqueous dispersions of photosensitive silver salts upon mixing is used preferably for controlling photographic properties.

4) Addition Amount

While the organic silver salt according to the invention can be used in a desired amount, a total amount of coated silver including silver halide is preferably in a range of from 0.1 $g/m^2$ to 3.0 $g/m^2$, more preferably from 0.5 $g/m^2$ to 2.0 $g/m^2$, and even more preferably from 0.8 $g/m^2$ to 1.7 $g/m^2$. In particular, in order to improve image storability, the total amount of coated silver is preferably 1.5 $mg/m^2$ or less, and more preferably 1.3 $mg/m^2$ or less. In the case where a preferable reducing agent according to the invention is used, it is possible to obtain a sufficient image density by even such a low amount of silver.

(Reducing Agent)

The photothermographic material of the present invention preferably contains a reducing agent for silver ions as a thermal developing agent. The reducing agent may be any substance (preferably, organic substance) which reduces silver ions into metallic silver. Examples of the reducing agent are described in JP-A No. 11-65021 (column Nos. 0043 to 0045) and EP No. 803,764A1 (p. 7, line 34 to p. 18, line 12).

In the present invention, the reducing agent is preferably a so-called hindered phenol reducing agent or a bisphenol reducing agent having a substituent at the ortho-position with respect to the phenolic hydroxy group. It is more preferably a compound represented by the following formula (R).

Formula (R)

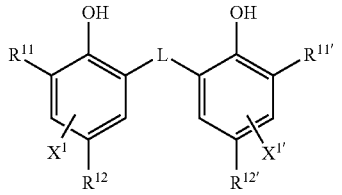

In formula (R), $R^{11}$ and $R^{11'}$ each independently represent an alkyl group having 1 to 20 carbon atoms. $R^{12}$ and $R^{12'}$ each independently represent a hydrogen atom or a substituent which substitutes for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group substituting for a hydrogen atom on a benzene ring.

Formula (R) is to be described in detail.

1) $R^{11}$ and $R^{11'}$ $R^{11}$ and $R^{11'}$ each independently represent a substituted or unsubstituted alkyl group having 1 to 20 carbon atoms. The substituent of the alkyl group has no particular restriction and include, preferably, an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a substituent which substitutes for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ include a methyl group, an ethyl group, a propyl group, a butyl group, a heptyl group, an undecyl group, an isopropyl group, a 1-ethylpentyl group, a 2,4,4-trimethylpentyl group, a cyclohexyl group, a 2,4-dimethyl-3-cyclohexenyl group, a 3,5-dimethyl-3-cyclohexenyl group, and the like. Examples of the substituent of the alkyl group include, similar to the substituent of $R^{11}$, a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms; and examples thereof include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are even more preferred and, a methyl group and a t-butyl group being most preferred.

$R^{12}$ and $R^{12'}$ are preferably an alkyl group having 1 to 20 carbon atoms; and examples thereof include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, groups which have a C=C bond in these alkyl groups are also preferably used. Preferable examples of the alkyl group include a methyl group, an ethyl group, a propyl group, an isopropyl group, a 2,4,4-trimethylpentyl group, a cyclohexyl group, a 2,4-dimethyl-3-cyclohexenyl group, a 3,5-dimethyl-3-cyclohexenyl group, and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ is preferably a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ is preferably a hydrogen atom.

In the case where $R^{11}$ and $R^{11'}$ are not a tertiary alkyl group, $R^{13}$ is preferably a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal development performance, color tone of developed silver images, or the like depending on the combination of $R^{11}$, $R^{11'}$, $R^{12}$, $R^{12'}$, and $R^{13}$. Since the performances can be controlled by using two or more reducing agents in combination, it is preferred to use two or more reducing agents in combination depending on the purpose.

Specific examples of the reducing agent according to the invention including the compounds represented by formula (R) according to the invention are shown below, but the invention is not restricted to these examples.

R-1

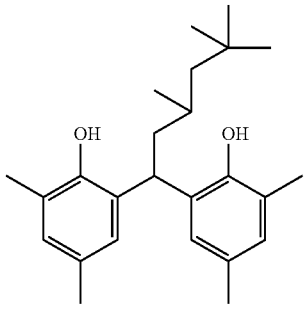

-continued
R-2
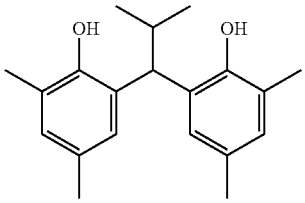
R-3
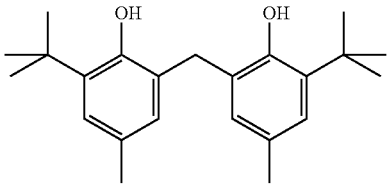
R-4
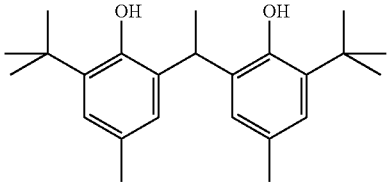
R-5
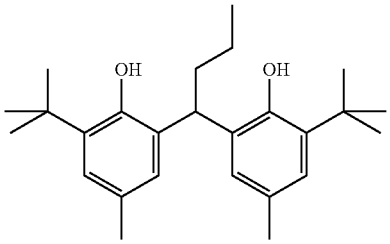
R-6
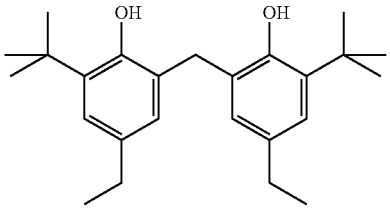
R-7
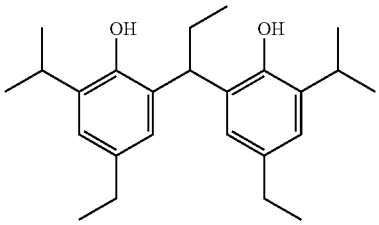
R-8
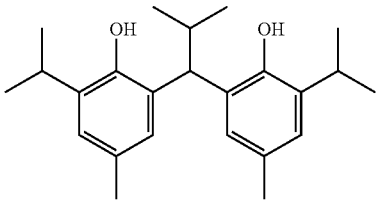
R-9
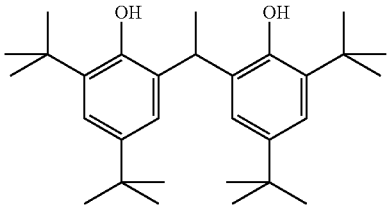
-continued
R-10
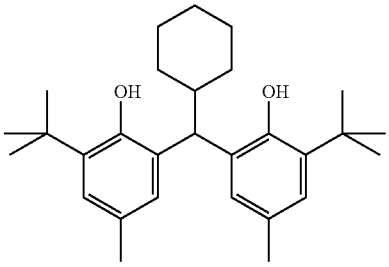
R-11
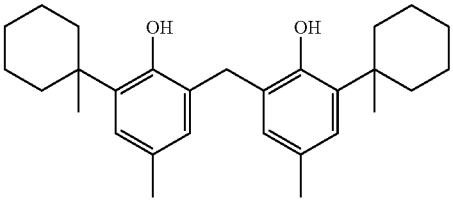
R-12
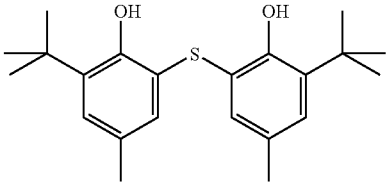
R-13
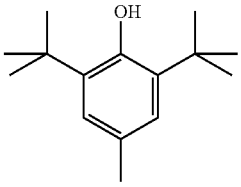
R-14
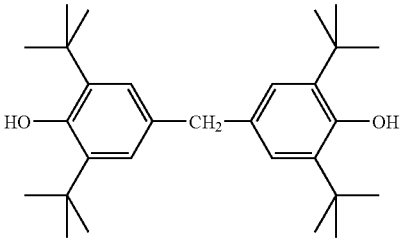
R-15
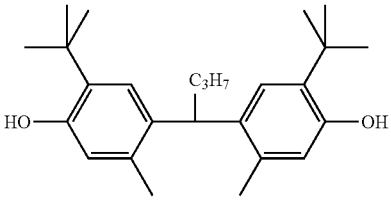
R-16
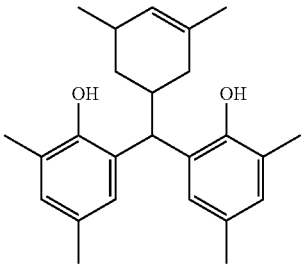

-continued

R-17

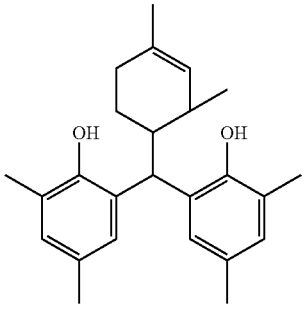

R-18

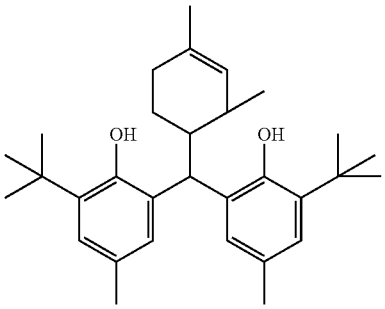

As preferred examples of the reducing agent according to the invention other than those above, there are mentioned compounds disclosed in JP-A Nos. 2001-188314, 2001-209145, 2001-350235, and 2002-156727, and EP No. 1,278,101A2.

In the present invention, the addition amount of the reducing agent is preferably from 0.1 g/m$^2$ to 3.0 g/m$^2$, more preferably from 0.2 g/m$^2$ to 1.5 g/m$^2$, and even more preferably from 0.3 g/m$^2$ to 1.0 g/m$^2$. It is preferably contained in a range of from 5 mol % to 50 mol %, more preferably from 8 mol % to 30 mol %, and even more preferably from 10 mol % to 20 mol %, per 1 mol of silver on the side having the image forming layer. The reducing agent is preferably contained in the image forming layer.

The reducing agent may be incorporated into the photothermographic material by being added into the coating solution by any method, such as in the form of a solution, an emulsified dispersion, a solid fine particle dispersion, or the like.

As an emulsified dispersing method that is well known in the technical field, there can be mentioned a method comprising dissolving the reducing agent in an oil such as dibutylphthalate, tricresylphosphate, glyceryl triacetate, diethyl phthalate, or the like, and an auxiliary solvent such as ethyl acetate, cyclohexanone, or the like, followed by mechanically preparing an emulsified dispersion.

As a solid fine particle dispersing method, there is mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining a solid dispersion. In this process, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in the photothermographic material in an amount of 0.5 mg or less per 1 g of silver.

Preferably, an antiseptic (for instance, benzisothiazolinone sodium salt) is added in an aqueous dispersion.

The reducing agent is particularly preferably used as a solid particle dispersion, and is added in the form of fine particles having a mean particle size of from 0.01 μm to 10 μm, preferably from 0.05 μm to 5 μm, and more preferably from 0.1 μm to 2 μm. In the invention, other solid dispersions are preferably used with this particle size range.

(Photosensitive Silver Halide)

1) Halogen Composition

For the photosensitive silver halide used in the invention, there is no particular restriction on the halogen composition, and silver chloride, silver bromochloride, silver bromide, silver iodobromide, silver iodochlorobromide, or silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure, and more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well known in the relevant art and, for example, methods described in Research Disclosure No. 17029, June 1978 and U.S. Pat. (USP) No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small for the purpose of suppressing clouding after image formation and, specifically, it is 0.20 μm or less, more preferably in a range of from 0.01 μm to 0.15 μm, and even more preferably from 0.02 μm to 0.12 μm. The grain size as used herein means a diameter of a circle converted such that it has the same area as a projected area of the silver halide grain (projected area of a major plane in a case of a tabular grain).

4) Grain Shape

The shape of the silver halide grain includes, for example, cubic, octahedral, tabular, spherical, rod-like, and potato-like shape. A cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably 65% or higher, and even more preferably 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain according to the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably ferrum, rhodium, ruthenium, or iridium. The metal complex may be used alone, or two or more complexes comprising identical or different species of metals may be used in combination. A preferred content is in a range of from $1\times10^{-9}$ mol to $1\times10^{-3}$ mol per 1 mol of silver. The heavy metals, metal complexes, and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3}$, $[Ru(CN)_6]^{4-}$, $[Os(CN)_6]^{4}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$.

In the invention, hexacyano Fe complex is preferred.

Since the hexacyano complex exists in an ionic form in an aqueous solution, counter cation is not important, but an alkali metal ion such as sodium ion, potassium ion, rubidium ion, cesium ion, or lithium ion, ammonium ion, or an alkyl ammonium ion (for example, tetramethyl ammonium ion, tetraethyl ammonium ion, tetrapropyl ammonium ion, or tetra (n-butyl)ammonium ion), each of which is easily miscible with water and suitable to precipitation operation of silver halide emulsion, is preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol, and more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation; before completion of an emulsion formation step prior to a chemical sensitization step of conducting chalcogen sensitization such as sulfur sensitization, selenium sensitization, or tellurium sensitization, or conducting noble metal sensitization such as gold sensitization or the like; during a washing step; during a dispersion step; and before a chemical sensitization step. In order not to grow fine silver halide grains, the hexacyano metal complex is preferably added rapidly after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complexes is added after addition of an aqueous solution of silver nitrate just prior to completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and, it becomes possible to prepare fine silver halide grains with smaller grain size.

Metal atoms that can be contained in the silver halide grain used in the invention (for example, $[Fe(CN)_6]^{4-}$), and desalting method and chemical sensitizing method of silver halide emulsion are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin which is contained in the photosensitive silver halide emulsion used in the invention, various types of gelatin can be used. It is necessary to maintain an excellent dispersion state of a photosensitive silver halide emulsion in the coating solution containing an organic silver salt, and gelatin having a molecular weight of 10,000 to 1,000,000 is preferably used. Phthalated gelatin is also preferably used. These gelatins may be used in a grain formation step or at the time of dispersion after desalting treatment, and it is preferably used in a grain formation step.

7) Sensitizing Dye

As the sensitizing dye applicable in the invention, a sensitizing dye which spectrally sensitizes the silver halide grains in a desired wavelength region upon adsorption to the silver halide grains and has spectral sensitivity suitable to the spectral characteristic of an exposure light source can be advantageously selected. The sensitizing dyes and the adding method are disclosed, for example, in JP-A No. 11-65021 (paragraph Nos. 0103 to 0109), as a compound represented by formula (II) in JP-A No. 10-186572, dyes represented by formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 803,764A1, and in JP-A Nos. 2001-272747, 2001-290238 and 2002-23306, and the like. The sensitizing dye may be used alone, or two or more of them may be used in combination. In the invention, the sensitizing dye is preferably added in the silver halide emulsion at the time after a desalting step and before coating, and more preferably at the time after desalting and before completion of chemical ripening.

In the invention, the sensitizing dye may be added at any amount according to the property of sensitivity or fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect.

The super sensitizers that can be used in the invention can include those compounds described in EP-A No. 587,338, U.S. Pat. Nos. 3,877,943 and 4,873,184, JP-A Nos. 5-341432, 11-109547, and 10-111543, and the like.

8) Chemical Sensitization

The photosensitive silver halide grain according to the invention is preferably chemically sensitized by sulfur sensitizing method, selenium sensitizing method, or tellurium sensitizing method. As the compound used preferably for sulfur sensitizing method, selenium sensitizing method, and tellurium sensitizing method, known compounds, for example, compounds described in JP-A No. 7-128768 and the like can be used. Particularly, tellurium sensitization is preferred in the invention, and compounds described in the literature cited in paragraph No. 0030 in JP-A No. 11-65021 and compounds represented by formula (II), (III), or (IV) in JP-A No. 5-313284 are more preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate, and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating, and it can be applied, after desalting, (1) before spectral sensitization, (2) simultaneously with spectral sensitization, (3) after spectral sensitization, (4) just prior to coating, or the like.

The amount of sulfur, selenium, or tellurium sensitizer used in the invention may vary depending on the silver halide grain used, the chemical ripening condition, and the like, and it is used in an amount of from $10^{-8}$ mol to $10^{-2}$ mol, and preferably from $10^{-7}$ mol to $10^{-3}$ mol, per 1 mol of silver halide.

The addition amount of the gold sensitizer may vary depending on various conditions, and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reduction sensitizer is preferably used for the photosensitive silver halide grain according to the invention. As the specific compound for the reduction sensitizing method, ascorbic acid or thiourea dioxide is preferred, as well as use of stannous chloride, aminoimino methane sulfinic acid, a hydrazine derivative, a borane compound, a silane compound, a polyamine compound, or the like is preferred. The reduction sensitizer may be added at any stage in the photosensitive emulsion production process from crystal growth to the preparation step just prior to coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that is One-Electron-Oxidized to Provide a One-Electron Oxidation Product which Releases One or More Electrons The photothermographic material of the present invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons, which is contained in the photothermographic material of the invention, is preferably a compound selected from the following Groups 1 or 2.

(Group 1) a compound that is one-electron-oxidized to provide a one-electron oxidation product which further releases one or more electrons due to being subjected to a subsequent bond cleavage reaction;

(Group 2) a compound that is one-electron-oxidized to provide a one-electron oxidation product which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786,692A1 (Compound INV 1 to 35); EP No. 893,732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). Preferable ranges of these compounds are the same as the preferable ranges described in the quoted specifications.

Formula (1)

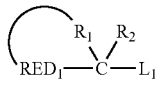

Formula (2)

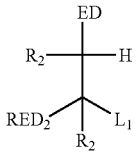

-continued

Formula (3)

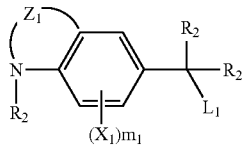

Formula (4)

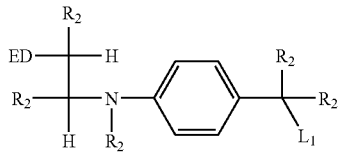

Formula (5)

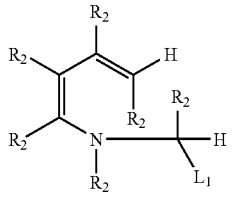

Formula (6)

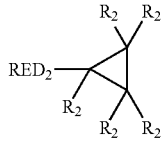

Formula (7)

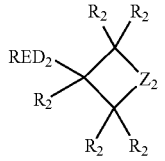

Formula (8)

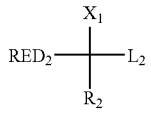

Chemical reaction formula (1)

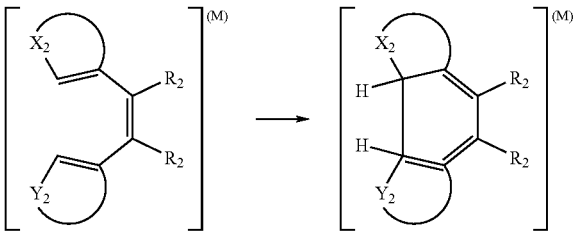

Formula (9)

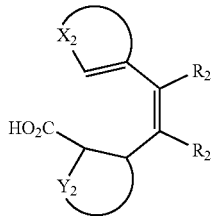

In the formulae, $RED_1$ and $RED_2$ represent a reducing group. $R_1$ represents a nonmetallic atomic group which forms a cyclic structure equivalent to a tetrahydro derivative or an octahydro derivative of a 5- or 6-membered aromatic ring (including an aromatic heterocycle) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group which forms a 6-membered ring with a nitrogen atom and two carbon atoms of the benzene ring. $X_1$ represents a substituent, and $m_1$ represents an integer of from 0 to 3. $Z_2$ represents one selected from —$CR_{11}R_{12}$—, —$NR_{13}$—, or —O—.

$R_{11}$ and $R_{12}$ each independently represent a hydrogen atom or a substituent. $R_{13}$ represents one selected from a hydrogen atom, an alkyl group, an aryl group, or a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxy group or a salt thereof, or a hydrogen atom. $X_2$ represents a group which forms a 5-membered heterocycle with C═C. $Y_2$ represents a group which forms a 5- or 6-membered aryl group or heterocyclic group with C═C. M represents one selected from a radical, a radical cation, or a cation.

Next, the compound of Group 2 is explained.

In the compound of Group 2, as a compound that is one-electron-oxidized to provide a one-electron oxidation product which further releases one or more electrons after being subjected to a subsequent bond formation reaction, specific examples include the compound represented by formula (10) (same as formula (1) described in JP-A No. 2003-140287), and the compound represented by formula (11) (same as formula (2) described in JP-A No. 2004-245929) which can undergo the chemical reaction represented by chemical reaction formula (1) (same as chemical reaction formula (1) described in JP-A No. 2004-245929). Preferable ranges of these compounds are the same as the preferable ranges described in the quoted specifications.

Formula (10)

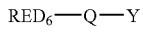

Chemical reaction formula (1)

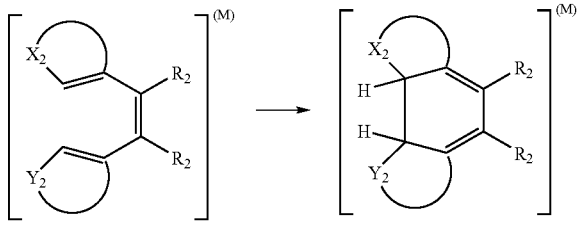

Formula (11)

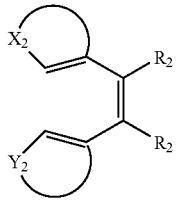

In the formulae described above, X represents a reducing group which is one-electron-oxidized. Y represents a reactive group containing a carbon-carbon double bond part, a carbon-carbon triple bond part, an aromatic group part, or a benzo-condensed non-aromatic heterocycle part, which reacts with one-electron-oxidized product formed by one-electron-oxidation of X to form a new bond. $L_2$ represents a linking group to link X and Y. $R_2$ represents a hydrogen atom or a substituent. In the case where plural $R_2$s exist in a same molecule, these may be identical or different from one another. $X_2$ represents a group which forms a 5-membered heterocycle with C═C. $Y_2$ represents a group which forms a 5- or 6-membered aryl group or heterocyclic group with C═C. M represents one selected from a radical, a radical cation, or a cation.

The compounds of Groups 1 or 2 are preferably "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. The partial structure of a spectral sensitizing dye means the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is even more preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having an —NH— group which forms silver iminate (—N(Ag)—), as a partial structure of heterocycle (e.g., a benzotriazole group, a benzimidazole group, an indazole group, or the like) are described. A 5-mercaptotetrazole group, a 3-mercapto-1,2,4-triazole group, and a benzotriazole group are particularly preferable, and a 3-mercapto-1,2,4-triazole group and a 5-mercaptotetrazole group are most preferable.

As the adsorptive group, the group which has two or more mercapto groups as a partial structure in a molecule is also particularly preferable. Herein, the mercapto group (—SH) may become a thione group in the case where it can tautomerize. Preferred examples of the adsorptive group having two or more mercapto groups as a partial structure (dimercapto-substituted nitrogen-containing heterocyclic group and the like) include a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as the adsorptive group. As the quaternary salt structure of nitrogen, specifically, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing a quaternary nitrogen atom are described. As the quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used, and a 5- or 6-membered nitrogen-containing aromatic heterocyclic group containing a quaternary nitrogen atom is even more preferably used. Particularly preferably, a pyridinio group, a quinolinio group, or an isoquinolinio group is used. These nitrogen-containing heterocyclic groups containing a quaternary nitrogen atom may have any substituent.

Examples of a counter anion of quaternary salt include a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group or the like exists in a molecule, an inner salt may be formed with it. As a counter anion outside of a molecule, chloro ion, bromo ion, or methanesulfonate ion is particularly preferable.

Preferred structure of the compound represented by Groups 1 or 2 having a quaternary salt structure of nitrogen or phosphorus as the adsorptive group is represented by formula (X).

Formula (X)

$$(P—Q_1)_i—R(—Q_2—S)_j$$

In formula (X), P and R each independently represent a quaternary salt structure of nitrogen or phosphorus, which is not a partial structure of a spectral sensitizing dye. $Q^1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected from within a range satisfying i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, even more preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added several times during these steps. The compound is preferably added after completion of the photosensitive silver halide grain formation step and before the desalting step; in the chemical sensitization step (just before initiation of the chemical sensitization to immediately after completion of the chemical sensitization); or before coating. The compound is more preferably added at the time from the chemical sensitization step to before being mixed with the non-photosensitive organic silver salt.

It is preferred that the compound of Groups 1 or 2 according to the invention is added by dissolving it in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused in the coating step.

The compound may be added before or after addition of a sensitizing dye.

The compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

10) Compound having Adsorptive Group and Reducing Group

The photothermographic material of the present invention preferably contains a compound having an adsorptive group to silver halide and a reducing group in a molecule. It is preferred that the compound is represented by the following formula (I).

$$A\text{-}(W)_n\text{—}B \qquad \text{Formula (I)}$$

In formula (I), A represents a group which adsorbs to a silver halide (hereafter, it is called an adsorptive group.); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a heterocyclic group comprising at least one atom selected from among nitrogen, sulfur, selenium, and tellurium, a sulfide group, a disulfide group, a cationic group, an ethynyl group, and the like are described.

The mercapto group (or the salt thereof) as the adsorptive group means a mercapto group (or a salt thereof) itself and simultaneously more preferably represents a heterocyclic group, aryl group, or alkyl group substituted by at least one mercapto group (or a salt thereof). Herein, the heterocyclic group is at least a 5- to 7-membered, monocyclic or condensed, aromatic or non-aromatic heterocyclic group; and examples thereof include an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$, or $Zn^{2+}$; an ammonium ion; a heterocyclic group containing a quaternary nitrogen atom; a phosphonium ion, or the like.

Further, the mercapto group as the adsorptive group may become a thione group by tautomerization.

The thione group used as the adsorptive group also includes a linear or cyclic thioamido group, thioureido group, thiourethane group, and dithiocarbamate ester group.

The heterocyclic group, as the adsorptive group, which comprises at least one atom selected from among nitrogen, sulfur, selenium, and tellurium, represents a nitrogen-containing heterocyclic group having —NH— group, which forms silver iminate (—N(Ag)—), as a partial structure of a heterocycle, or a heterocyclic group having an —S— group, a —Se— group, a —Te— group, or an ═N— group, each of which coordinates to a silver ion by a coordination bond, as a partial structure of a heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as the adsorptive group contains all groups having "—S—" or "—S—S—" as a partial structure.

The cationic group as the adsorptive group means a group containing a quaternary nitrogen atom, such as an ammonio group or a nitrogen-containing heterocyclic group containing a quaternary nitrogen atom. As examples of the nitrogen-containing heterocyclic group containing a quaternary nitrogen atom, a pyridinio group, a quinolinio group, an isoquinolinio group, an imidazolio group, and the like are described.

The ethynyl group as the adsorptive group means a —C≡CH group, in which the hydrogen atom may be substituted.

The adsorptive group described above may have any substituent.

Further, as typical examples of the adsorptive group, the groups described in pages 4 to 7 in the specification of JP-A No. 11-95355 are described.

As the adsorptive group represented by A in formula (I), a mercapto-substituted heterocyclic group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen-containing heterocyclic group having an —NH— group, which forms silver iminate (—N(Ag)—), as a partial structure of heterocycle (for example, a benzotriazole group, a benzimidazole group, an indazole group, or the like) are preferable, and more preferable as the adsorptive group are a 2-mercaptobenzimidazole group and a 3,5-dimercapto-1,2,4-triazole group.

In formula (I), W represents a divalent linking group. The said linking group may be any divalent linking group as long as it does not exert adverse influences on photographic performance. For example, a divalent linking group which includes a carbon atom, a hydrogen atom, an oxygen atom, a nitrogen atom, or a sulfur atom can be used. As typical examples, an alkylene group having 1 to 20 carbon atoms (for example, a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (for example, a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), the reducing group represented by B represents a group which reduces a silver ion. As examples thereof, a formyl group, an amino group, a triple bond group such as an acetylene group, a propargyl group, or the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, amino phenols, sulfonamido phenols, and polyphenols such as hydroquinones, catechols, resorcinols, benzenetriols, bisphenols are included), acylhydrazines, carbamoylhydrazines, 3-pyrazolidones, or the like are described. They may have any substituent.

The oxidation potential of the reducing group represented by B in formula (I) can be measured by using the measuring method described in Akira Fujishima, "DENKIKAGAKU SOKUTEIHO", pages 150 to 208, GIHODO SHUPPAN and The Chemical Society of Japan, "JIKKEN KAGAKU KOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas over 10 minutes, the voltamograph can be measured under conditions of 1000 rotations/minute, sweep rate of 20 mV/second, and at 25° C. by using a rotating disc electrode (RDE) made by glassy carbon as a working electrode, a platinum electrode as a counter electrode, and a saturated calomel electrode as a reference electrode. The half wave potential (E½) can be calculated by that obtained voltamograph.

When the reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (I), the reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (I) according to the present invention may have a ballast group or polymer chain, which are generally used in the non-moving photographic additives such as a coupler or the like, in it. And as a polymer, for example, the polymer described in JP-A No. 1-100530 is selected.

The compound of formula (I) according to the present invention may be bis or tris type of compound. The molecular weight of the compound represented by formula (I) according to the present invention is preferably within a range of from 100 to 10000, more preferably from 120 to 1000, and particularly preferably from 150 to 500.

Specific examples of the compound represented by formula (I) according to the present invention are shown below, but the present invention is not limited in these.

(1)

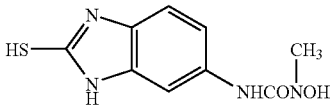

(2)

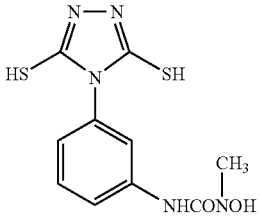

-continued (3)

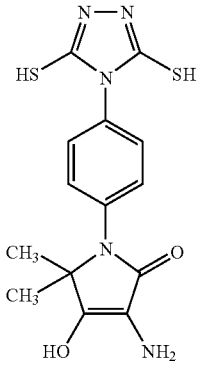

(4)

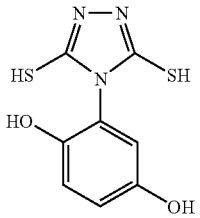

(5)

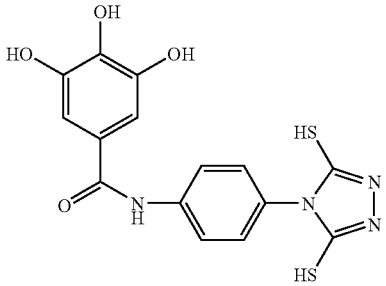

(6)

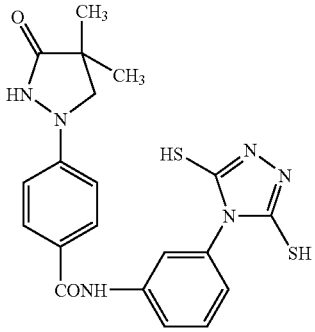

(7)

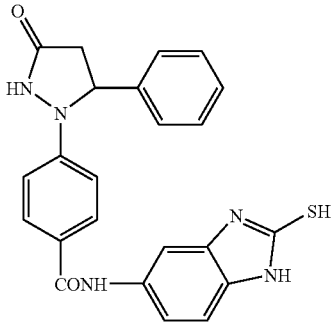

-continued (8)

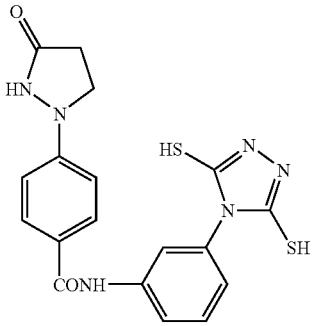

(9)

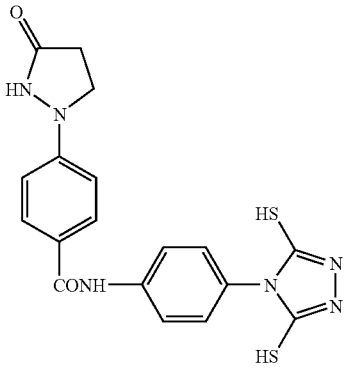

(10)

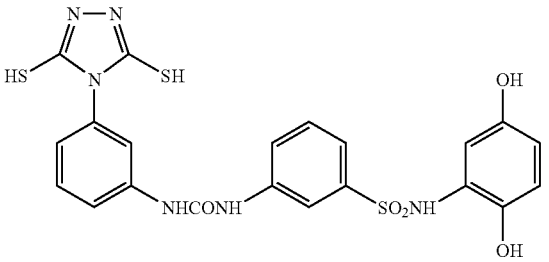

(11)

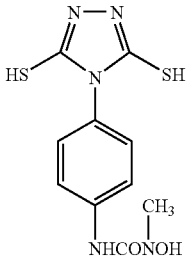

(12)

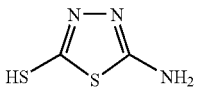

(13)

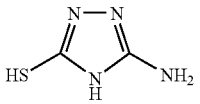

Further, example compounds 1 to 30 and 1"-1 to 1"-77 shown in EP No. 1,308,776A2, pages 73 to 87 are also described as preferable examples of the compound having an adsorptive group and a reducing group according to the invention.

These compounds can be easily synthesized by a known method. The compound of formula (I) according to the present invention may be used alone, but it is preferred to use two or more of the compounds in combination. When two or more of the compounds are used in combination, those may be added to the same layer or the different layers, whereby adding methods may be different from each other.

The compound represented by formula (I) according to the present invention is preferably added to the image forming layer, and more preferably, the compound represented by formula (I) is added in an emulsion preparation process. In the case where the compound is added in an emulsion preparation process, the compound can be added at any stage in the process. For example, the compound can be added during the silver halide grain formation step; before starting of desalting step; during the desalting step; before starting of chemical ripening; during the chemical ripening step; in the step before preparing a final emulsion, or the like. The compound can be added several times during these steps. It is preferred to use the compound in the image forming layer. But the compound may be added to a surface protective layer or an intermediate layer adjacent to the image forming layer, in combination with its addition to the image forming layer, to be diffused in the coating step.

The preferred addition amount is largely dependent on the adding method described above or the type of the compound, but is generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving it in water, a water-soluble solvent such as methanol, ethanol, or the like, or a mixed solution thereof. At this time, the pH may be arranged suitably by an acid or a base, and a surfactant may coexist. Further, these compounds can be added as an emulsified dispersion by dissolving them in an organic solvent having a high boiling point, and also can be added as a solid dispersion.

11) Combined Use of Silver Halides

The photosensitive silver halide emulsion in the photothermographic material used in the invention may be used alone, or two or more of them (for example, those having different mean grain sizes, different halogen compositions, different crystal habits, or different conditions for chemical sensitization) may be used together. Gradation can be controlled by using plural photosensitive silver halides each having different sensitivity. The relevant techniques include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably from 0.05 $g/m^2$ to 0.4 $g/m^2$ and, most preferably from 0.07 $g/m^2$ to 0.3 $g/m^2$. The photosensitive silver halide is used in a range of from 0.01 mol to 0.5 mol, preferably from 0.02 mol to 0.3 mol, and even more preferably from 0.03 mol to 0.2 mol, per 1 mol of the organic silver salt.

13) Mixing Photosensitive Silver Halide and Organic Silver Salt

The mixing method and mixing conditions of the separately prepared photosensitive silver halide and organic silver salt include a method of mixing respectively prepared photosensitive silver halide grains and organic silver salt by a high speed stirrer, ball mill, sand mill, colloid mill, vibration mill, homogenizer, or the like, and a method of mixing the photosensitive silver halide completed for preparation at any timing during the preparation of the organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts while caring out mixing is used preferably for controlling photographic properties.

14) Mixing Silver Halide into Coating Solution

In the invention, the time of adding silver halide to the coating solution for the image forming layer is preferably in a range of from 180 minutes before to just prior to coating, more preferably, 60 minutes before to 10 seconds before coating. But there is no restriction for mixing method and mixing conditions as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby, M. F. Edwards, and A. W. Nienow, translated by Koji Takahashi (Nikkan Kogyo Shinbunsha, 1989).

(Preferred Solvent of Coating Solution)

In the invention, a solvent of a coating solution for the image forming layer of the photothermographic material (wherein a solvent and disperse medium are collectively represented as a solvent for simplicity) is preferably an aqueous solvent containing water at 30% by weight or more. Examples of components other than water may include any of water-miscible organic solvents such as methyl alcohol, ethyl alcohol, isopropyl alcohol, methyl cellosolve, ethyl cellosolve, dimethylformamide and ethyl acetate. A water content in a solvent of a coating solution is more preferably 50% by weight or higher, and even more preferably 70% by weight or higher. Examples of a preferable solvent composition include, in addition to water, water/methyl alcohol=90/10, water/methyl alcohol=70/30, water/methyl alcohol/dimethylformamide=80/15/5, water/methyl alcohol/ethyl cellosolve=85/10/5, water/methyl alcohol/isopropyl alcohol=85/10/5, and the like (wherein the numerals presented above are values in % by weight.).

(Development Accelerator)

In the photothermographic material of the invention, as a development accelerator, sulfonamido phenol compounds described in the specification of JP-A No. 2000-267222, and represented by formula (A) described in the specification of JP-A No. 2000-330234; hindered phenol compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenol or naphthol compounds represented by formula (2) described in the specification of JP-A No. 2001-264929 are used preferably. The development accelerator is used in a range of from 0.1 mol % to 20 mol %, preferably, in a range of from 0.5 mol % to 10 mol %, and more preferably in a range of from 1 mol % to 5 mol %, with respect to the reducing agent. The introducing methods to the photothermographic material include similar methods as those for the reducing agent and, it is particularly preferred to add the development accelerator as a solid dispersion or an emulsified dispersion. In the case of adding the development accelerator as an emulsified dispersion, it is preferred to add it as an emulsified dispersion dispersed by using a solvent having a high boiling point which is solid at a normal temperature and an auxiliary solvent having a low boiling point, or to add it as a so-called oilless emulsified dispersion not using a solvent having a high boiling point.

In the present invention, among the development accelerators described above, it is more preferred to use hydrazine compounds represented by formula (D) described in the specification of JP-A Nos. 2002-156727 and phenol or naphthol compounds represented by formula (2) described in the specification of JP-A No. 2001-264929.

Particularly preferred development accelerators according to the invention are compounds represented by the following formulae (A-1) or (A-2).

$Q_1$-NHNH-$Q_2$ Formula (A-1)

In the formula, $Q^1$ represents an aromatic group or heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in the case where they have two or more substituents, the substituents may be identical or different from each other. Examples of the substituent include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may further have a substituent and examples of preferred substituent include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms, and more preferably having 6 to 40 carbon atoms; and examples thereof include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group preferably having 1 to 50 carbon atoms, and more preferably having 6 to 40 carbon atoms; and examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group preferably having 2 to 50 carbon atoms, and more preferably having 6 to 40 carbon atoms; and examples thereof include methoxycarbonyl, ethoxycarbonyl, isobutyloxycarbonyl, cyclohexyloxycarbonyl, dodecyloxycarbonyl, and benzyloxycarbonyl.

The aryloxycarbonyl group represented by $Q_2$ is an aryloxycarbonyl group preferably having 7 to 50 carbon atoms, and more preferably having 7 to 40 carbon atoms; and examples thereof include phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group preferably having 1 to 50 carbon atoms, and more preferably having 6 to 40 carbon atoms; and examples thereof include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

The sulfamoyl group represented by $Q_2$ is a sulfamoyl group preferably having 0 to 50 carbon atoms, and more preferably having 6 to 40 carbon atoms; and examples thereof include unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ described above at the position capable of substitution. In the case where the group represented by $Q_2$ has two or more substituents, such substituents may be identical or different from one another.

Next, preferred range for the compound represented by formula (A-1) is to be described. A 5- or 6-membered unsaturated ring is preferred for $Q^1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring, and a ring in which the ring described above is condensed with a benzene ring or unsaturated heterocycle are more preferred. Further, $Q_2$ is preferably a carbamoyl group and, particularly preferably a carbamoyl group having a hydrogen atom on the nitrogen atom.

Formula (A-2)

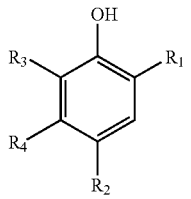

In formula (A-2), $R_1$ represents one selected from an alkyl group, an acyl group, an acylamino group, a sulfonamido group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent of formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphthol compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator according to the invention are to be described below. The invention is not restricted to these examples.

A-1

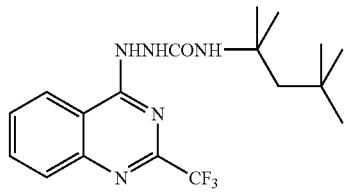

A-2

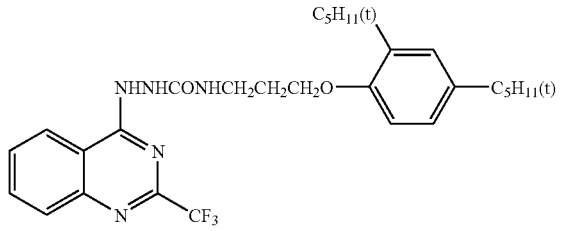

-continued

A-3

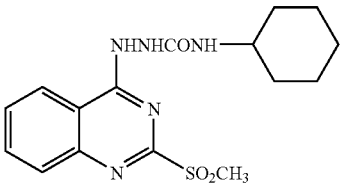

A-4

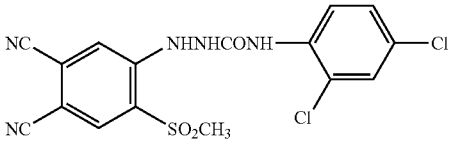

A-5

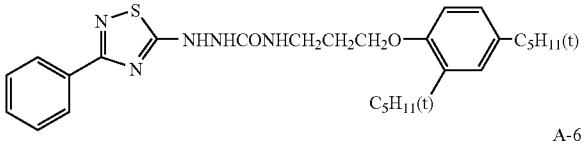

A-6

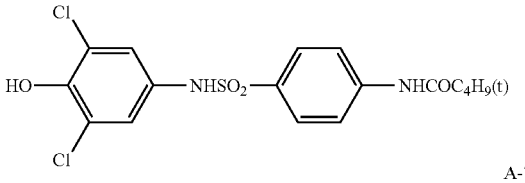

A-7

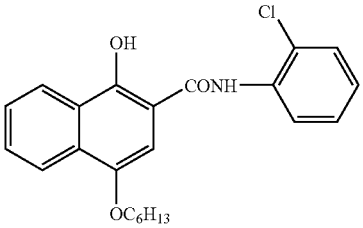

A-8

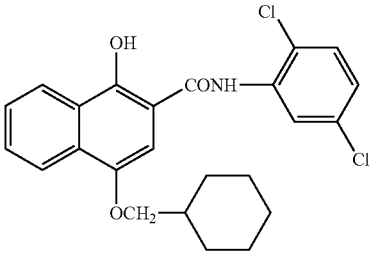

A-9

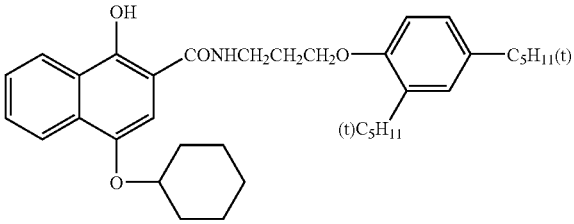

A-10

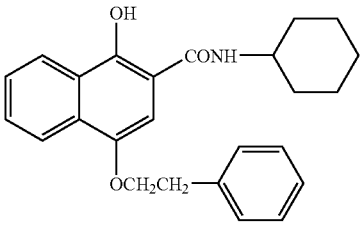

-continued

A-11

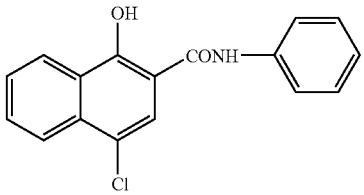

A-12

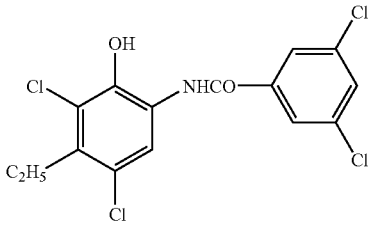

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination a non-reducing compound having a group which forms a hydrogen bond with these groups of the reducing agent.

As the group forming a hydrogen bond with a hydroxy group or an amino group, there are mentioned a phosphoryl group, a sulfoxide group, a sulfonyl group, a carbonyl group, an amido group, an ester group, a urethane group, a ureido group, a tertiary amino group, a nitrogen-containing aromatic group, and the like. Particularly preferred among them are a phosphoryl group, a sulfoxide group, an amido group (not having —N(H)— moiety but being blocked in the form of —N(Ra)— (where Ra represents a substituent other than H)), a urethane group (not having —N(H)— moiety but being blocked in the form of —N(Ra)— (where Ra represents a substituent other than H)), and a ureido group (not having —N(H)— moiety but being blocked in the form of —N(Ra)— (where Ra represents a substituent other than H)).

In the invention, particularly preferable as the hydrogen bonding compound is the compound represented by formula (D) shown below.

Formula (D)

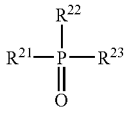

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group and an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, a 2-phenoxypropyl group, and the like.

As the aryl group, there are mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As the alkoxy group, there are mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As the aryloxy group, there are mentioned a phenoxy group, a cresyloxy group, an isopropylphenoxy group, a 4-t-butylphenoxy group, a naphthoxy group, a biphenyloxy group, and the like.

As the amino group, there are mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) according to the invention and others according to the invention are shown below, but the invention is not limited thereto.

D-1

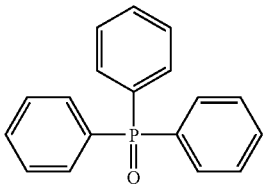

D-2

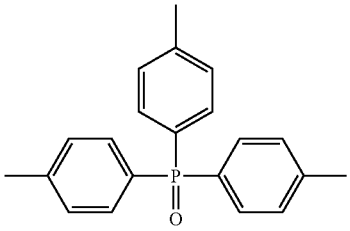

D-3

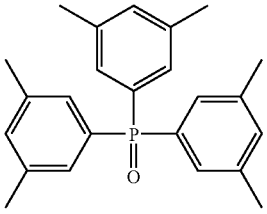

-continued

D-4

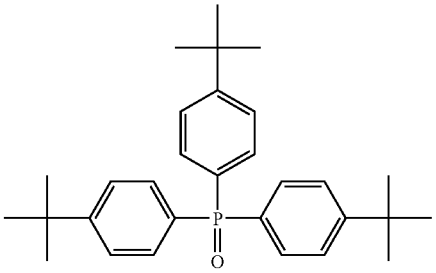

D-5

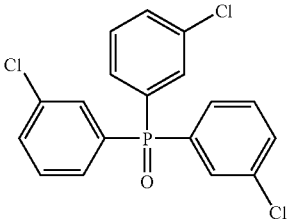

D-6

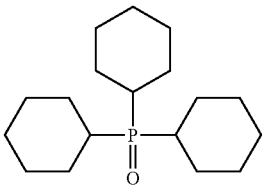

D-7

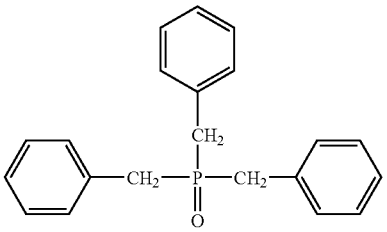

D-8

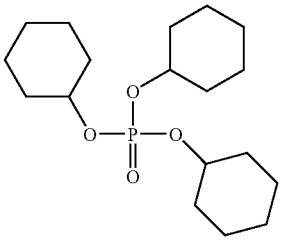

D-9

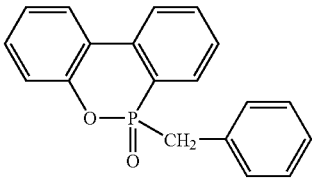

D-10

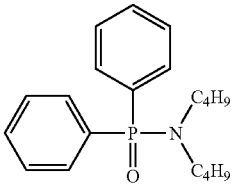

-continued

D-11

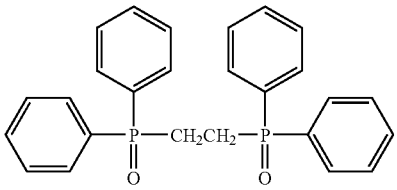

D-12

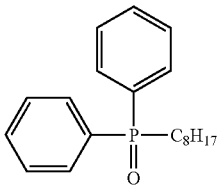

D-13

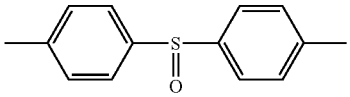

D-14

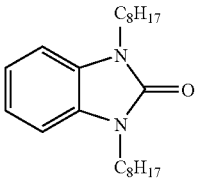

D-15

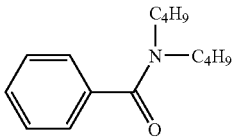

Specific examples of hydrogen bonding compounds other than those enumerated above can be found in those described in EP No. 1,096,310 and in JP-A Nos. 2002-156727 and 2002-318431.

The compound represented by formula (D) according to the invention can be used in the photothermographic material by being incorporated into the coating solution in the form of a solution, an emulsified dispersion, or a solid fine particle dispersion, similar to the case of reducing agent. However, it is preferably used in the form of a solid dispersion. In a solution state, the compound according to the invention forms a hydrogen-bonded complex with a compound having a phenolic hydroxy group or an amino group, and can be isolated as a complex in crystalline state depending on the combination of the reducing agent and the compound represented by formula (D) according to the invention.

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) according to the invention in the form of powder, and dispersing them with a proper dispersing agent using sand grinder mill or the like.

The compound represented by formula (D) according to the invention is preferably used in a range of from 1 mol % to 200 mol %, more preferably from 10 mol % to 150 mol %, and even more preferably, from 20 mol % to 100 mol %, with respect to the reducing agent.

(Binder)

Any hydrophobic polymer may be used as the hydrophobic binder for the image forming layer according to the invention. Suitable as the binder are those that are transparent or translucent, and that are generally colorless, such as natural resin or polymer and their copolymers; synthetic resin or polymer and their copolymer; or media forming a film; for example, included are rubbers, cellulose acetates, cellulose acetate butyrates, poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) and poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent, or emulsion to form a coating solution.

In the present invention, the glass transition temperature (Tg) of the binder which is used in the image forming layer is preferably in a range of from 0° C. to 80° C., more preferably from 10° C. to 70° C., and even more preferably from 15° C. to 60° C.

In the specification, Tg is calculated according to the following equation:

$$1/Tg=\Sigma(Xi/Tgi)$$

where the polymer is obtained by copolymerization of n monomer components (from i=1 to i=n); Xi represents the weight fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more polymers depending on needs. And, the polymer having Tg of 20° C. or higher and the polymer having Tg of lower than 20° C. may be used in combination. In the case where two or more polymers differing in Tg are blended for use, it is preferred that the weight-average Tg is within the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower at 25° C. and 60% RH is used, the performance is enhanced. Most preferred embodiment is such prepared to yield an ion conductivity of 2.5 mS/cm or lower, and as such a preparing method, there is mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As the water-miscible organic solvent, for example, alcohols such as methyl alcohol, ethyl alcohol, propyl alcohol, or the like; cellosolves such as methyl cellosolve, ethyl cellosolve, butyl cellosolve, or the like; ethyl acetate; dimethylformamide, and the like are described.

The term "aqueous solvent" is also used in the case where the polymer is not thermodynamically dissolved, but is present in a so-called dispersed state.

The term "equilibrium water content at 25° C. and 60% RH" as referred herein can be expressed as follows:

$$\text{Equilibrium water content at 25° C. and 60\% RH} = [(W1-W0)/W0]\times 100 \text{ (\% by weight)}$$

wherein W1 is the weight of the polymer in moisture-controlled equilibrium under an atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content at 25° C. and 60% RH is preferably 2% by weight or lower, more preferably in a range of from 0.01% by weight to 1.5% by weight, and even more preferably from 0.02% by weight to 1% by weight.

The binders used in the invention are particularly preferably polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The mean particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodispersed particle diameter distribution. From the viewpoint of controlling the physical properties of the coating solution, preferred mode of usage includes mixing two or more types of dispersed particles each having monodispersed particle diameter distribution.

In the invention, preferred embodiment of the polymers capable of being dispersed in aqueous solvent includes hydrophobic polymers such as acrylic polymer, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small molecular weight exhibit insufficient mechanical strength on forming the image forming layer, and those having too large molecular weight are also not preferred because the resulting film-forming properties are poor. Further, crosslinking polymer latexes are particularly preferred for use.

—Examples of Latex—

Specific examples of preferred polymer latexes are given below, which are expressed by the starting monomers with % by weight given in parenthesis. The molecular weight is given in number average molecular weight. In the case where polyfunctional monomer is used, the concept of molecular weight is not applicable because they build a crosslinked structure. Hence, they are denoted as "crosslinking", and the molecular weight is omitted. Tg represents glass transition temperature.

P-1: Latex of -MMA(70) -EA(27) -MAA(3)—(molecular weight 37000, Tg 61° C.)

P-2: Latex of -MMA(70) -2EHA(20) -St(5) -AA(5)—(molecular weight 40000, Tg 59° C.)

P-3: Latex of -St(50) -Bu(47) -MAA(3)—(crosslinking, Tg -17° C.)

P-4: Latex of -St(68) -Bu(29) -AA(3)—(crosslinking, Tg 17° C.)

P-5: Latex of -St(71) -Bu(26) -AA(3)—(crosslinking, Tg 24° C.)

P-6: Latex of -St(70) -Bu(27) -IA(3)—(crosslinking)

P-7: Latex of -St(75) -Bu(24) -AA(1)—(crosslinking, Tg 29° C.)

P-8: Latex of -St(60) -Bu(35) -DVB(3) -MAA(2)—(crosslinking)

P-9: Latex of -St(70) -Bu(25) -DVB(2) -AA(3)—(crosslinking)

P-10: Latex of -VC(50) -MMA(20) -EA(20) -AN(5)-AA(5)—(molecular weight 80000)

P-11: Latex of -VDC(85) -MMA(5) -EA(5) -MAA(5)—(molecular weight 67000)

P-12: Latex of -Et(90) -MAA(10)—(molecular weight 12000)

P-13: Latex of -St(70) -2EHA(27) -AA(3)—(molecular weight 130000, Tg 43° C.) P-14: Latex of -MMA(63) -EA (35) -AA(2)—(molecular weight 33000, Tg 47° C.) P-15: Latex of -St(70.5) -Bu(26.5) -AA(3)—(crosslinking, Tg 23° C.)

P-16: Latex of -St(69.5) -Bu(27.5) -AA(3)—(crosslinking, Tg 20.5° C.)

P-17: Latex of -St(61.3) -Isoprene(35.5) -AA(3)—(crosslinking, Tg 17° C.)

P-18: Latex of -St(67) -Isoprene(28) -Bu(2) -AA(3)—(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below can be used. As examples of acrylic polymer, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyesters, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethanes, there can be mentioned HYDRAN AP10, 20, 30, and 40 (all manufactured by Dainippon Ink and Chemicals, Inc.), and the like; as examples of rubbers, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chlorides), there can be mentioned G351 and G576 (all manufactured by Nippon Zeon Co., Ltd.), and the like; as examples of poly(vinylidene chlorides), there can be mentioned L502 and L513 (all manufactured by Asahi Chemical Industry Co., Ltd.), and the like; as examples of polyolefins, there can be mentioned Chemipearl S120 and SA100 (all manufactured by Mitsui Petrochemical Industries, Ltd.), and the like.

The polymer latex above may be used alone, or may be used by blending two or more of them depending on needs.

—Preferable Latex—

Particularly preferable as the polymer latex for use in the invention is that of styrene-butadiene copolymer or that of styrene-isoprene copolymer. The weight ratio of the monomer unit of styrene relative to that of butadiene or isoprene constituting the styrene-butadiene copolymer or the styrene-isoprene copolymer is preferably in a range of from 40:60 to 95:5. Further, the monomer unit of styrene and that of butadiene or isoprene preferably account for 60% by weight to 99% by weight with respect to the copolymer. Further, the polymer latex according to the invention preferably contains acrylic acid or methacrylic acid in a range of from 1% by weight to 6% by weight with respect to the sum of styrene and butadiene or isoprene, and more preferably from, 2% by weight to 5% by weight.

The polymer latex according to the invention preferably contains acrylic acid. Preferable range of molecular weight is similar to that described above.

As the latex of styrene-butadiene copolymer preferably used in the invention, there are mentioned P-3 to P-9 and P-15 described above, and commercially available LACSTAR-3307B, 7132C, Nipol Lx416, and the like. And as examples of the latex of styrene-isoprene copolymer, there are mentioned P-17 and P-18 described above.

In the image forming layer of the photothermographic material of the invention, if necessary, there may be added hydrophilic polymer such as gelatin, poly(vinyl alcohol), methyl cellulose, hydroxypropyl cellulose, carboxymethyl cellulose, or the like. The hydrophilic polymer is preferably added in an amount of 30% by weight or less, and more preferably 20% by weight or less, with respect to the total weight of binder incorporated in the image forming layer.

According to the invention, the layer containing organic silver salt (image forming layer) is preferably formed by using polymer latex for the binder. Concerning the amount of the binder for the image forming layer, a weight ratio of total binder to organic silver salt is preferably in a range of from 1/10 to 10/1, more preferably from 1/3 to 5/1, and even more preferably from 1/1 to 3/1.

The image forming layer is, in general, a photosensitive layer containing a photosensitive silver halide, i.e., the photosensitive silver salt; and in such a case, a weight ratio of total binder to silver halide is in a range of from 5 to 400, and more preferably from 10 to 200.

The total amount of binder in the image forming layer according to the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. To the image forming layer according to the invention, there may be added a crosslinking agent for crosslinking, a surfactant to improve coating ability, or the like.

(Antifoggant)

1) Organic Polyhalogen Compound

Preferable organic polyhalogen compound that can be used in the invention is explained specifically below. In the invention, preferred organic polyhalogen compound is the compound represented by the following formula (H).

$$Q\text{-}(Y)n\text{—}C(Z_1)(Z_2)X \qquad \text{Formula (H)}$$

In formula (H), Q represents an alkyl group, an aryl group, or a heterocyclic group; Y represents a divalent linking group; n represents 0 or 1; $Z^1$, and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q is preferably a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like.

As such electron-attracting groups, examples include a halogen atom, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, a sulfamoyl group, and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$, and $Z_2$ each are preferably a bromine atom or an iodine atom, and more preferably a bromine atom.

Y preferably represents —C(=O)—, —SO—, —$SO_2$—, —C(=O)N(R)—, or —$SO_2$N(R)—; more preferably, —C(=O)—, —$SO_2$—, or —C(=O)N(R)—; and particularly preferably, —$SO_2$— or —C(=O)N(R)—.

Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(=O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having, as a substituent, a dissociative group (for example, a COOH group or a salt thereof, an $SO_3H$ group or a salt thereof, a $PO_3H$ group or a salt thereof, or the like), a group containing a quaternary nitrogen cation (for example, an ammonio group, a pyridinio group, or the like), a polyethyleneoxy group, a hydroxy group, or the like as a substituent is also preferable.

Specific examples of the compound represented by formula (H) according to the invention are shown below.

H-1

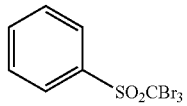

H-2

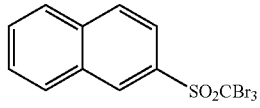

H-3

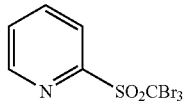

H-4

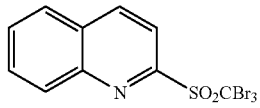

-continued

H-5

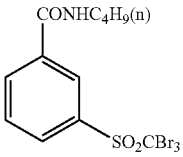

H-6

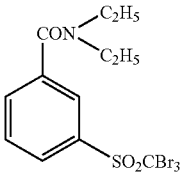

H-7

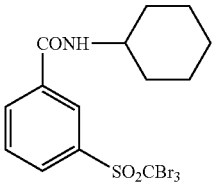

H-8

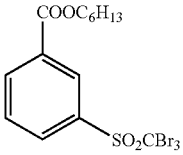

H-9

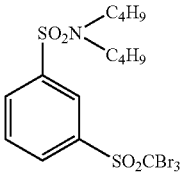

H-10

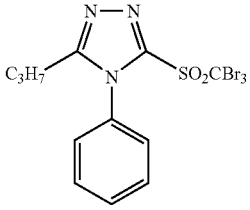

H-11

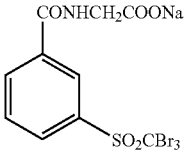

H-12

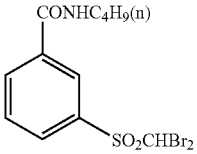

H-13

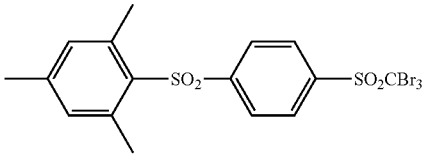

-continued

H-14

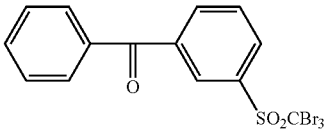

H-15

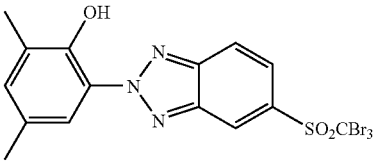

H-16

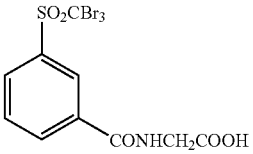

H-17

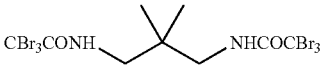

H-18

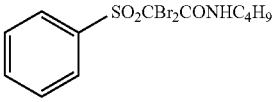

H-19

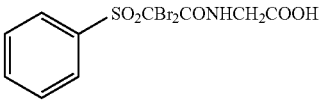

As preferred organic polyhalogen compounds which can be used in the present invention other than those above, there are mentioned compounds disclosed in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 10-197988, 10-197989, 11-242304, 2000-2963, 2000-112070, 2000-284410, 2000-284412, 2001-33911, 2001-31644, 2001-312027, and 2003-50441. Particularly, the compounds specifically illustrated in JP-A Nos. 7-2781, 2001-33911, and 2001-312027 are preferable.

The compound represented by formula (H) according to the invention is preferably used in an amount of from $10^{-4}$ mol to 1 mol, more preferably from $10^{-3}$ mol to 0.5 mol, and even more preferably from $1\times10^{-2}$ mol to 0.2 mol, per 1 mol of non-photosensitive silver salt incorporated in the image forming layer.

In the invention, methods which can be used for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there are mentioned a mercury (11) salt described in paragraph number 0113 of JP-A No. 11-65021, benzoic acids described in paragraph number 0114 of the same literature, a salicylic acid derivative described in JP-A No. 2000-206642, a formalin scavenger compound represented by formula (S) in JP-A No. 2000-221634, a triazine compound related to claim 9 of JP-A No. 11-352624, a compound represented by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound represented by formula (XI) described in JP-A No. 59-193447, a compound described in Japanese Patent Application Publication (JP-B) No. 55-12581, and a compound represented by formula (II) described in JP-A No. 60-153039. The azolium salt may be added to any part of the photothermographic material, but as the layer to be added, it is preferred to select a layer on the side having the image forming layer, and more preferred is to select the image forming layer itself. The azolium salt may be added at any time of the process of preparing the coating solution; in the case where the azolium salt is added into the image forming layer, any time of the process may be selected from the preparation of the organic silver salt to the preparation of the coating solution, but preferred is to add the azolium salt at the time after preparation of the organic silver salt and just before coating. As the method for adding the azolium salt, any method such as in the form of powder, a solution, a fine particle dispersion, or the like may be used.

Furthermore, the azolium salt may be added as a solution having mixed therein other additives such as a sensitizing agent, a reducing agent, a toner, or the like.

In the invention, the azolium salt may be added in any amount, but preferably, it is added in a range of from $1\times10^{-6}$ mol to 2 mol, and more preferably from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storability before development and storability after development. Descriptions can be found in paragraph numbers 0067 to 0069 of JP-A No. 10-62899, as compounds represented by formula (1) of JP-A No. 10-186572 and specific examples thereof shown in paragraph numbers 0033 to 0052, in lines 36 to 56 in page 20 of EP No. 803,764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, addition of a toner is preferred. Description on the toner can be found in JP-A No. 10-62899 (paragraph numbers 0054 and 0055), EP No. 803,764A1 (page 21, lines 23 to 48), and JP-A Nos. 2000-356317 and 2000-187298. Preferred are phthalazinones (phthalazinone, phthalazinone derivatives, and metal salts thereof; for example, 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (for example, phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives, and metal salts thereof; for example, 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); and combinations of phthalazines and phthalic acids. Particularly preferred are combinations of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants which can be used in the image forming layer according to the invention are described in paragraph No. 0117 of JP-A No. 11-65021. Lubricants are described in paragraph Nos. 0061 to 0064 of JP-A No. 11-84573.

4) Dyes and Pigments

From the viewpoints of improving color tone, preventing the generation of interference fringes and preventing irradiation on laser exposure, various dyes and pigments (for instance, C.I. Pigment Blue 60, C.I. Pigment Blue 64, and C.I. Pigment Blue 15:6) can be used in the image forming layer according to the invention. Detailed description can be found in WO No. 98/36322, JP-A Nos. 10-268465 and 11-338098, and the like. Further, it is preferred to use water-insoluble azomethine dye in combination.

5) Nucleator

Concerning the photothermographic material of the invention, it is preferred to add a nucleator into the image forming layer. Details on nucleators, method for their addition, and addition amount can be found in paragraph No. 0118 of JP-A No. 11-65021, paragraph Nos. 0136 to 0193 of JP-A No. 11-223898, as compounds represented by formulae (H), (1) to (3), (A), or (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having the image forming layer containing a photosensitive silver halide in an amount of 5 mmol or less, and more preferably 1 mmol or less, per 1 mol of silver.

In the case of using a nucleator in the photothermographic material of the invention, it is preferred to use an acid obtained by hydration of diphosphorus pentaoxide, or a salt thereof in combination. Acids obtained by hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtained by hydration of diphosphorus pentaoxide or salts thereof include orthophosphoric acid (salt) and hexametaphosphoric acid (salt). Specific examples of the salt include sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably from 0.5 $mg/m^2$ to 100 $mg/m^2$.

(Preparation of Coating Solution and Coating)

The temperature for preparing the coating solution for the image forming layer according to the invention is preferably from 30° C. to 65° C., more preferably, 35° C. or more and less than 60° C., and even more preferably, from 35° C. to 55° C. Furthermore, the temperature of the coating solution for the image forming layer immediately after adding the polymer latex is preferably maintained within the temperature range of from 30° C. to 65° C.

(Layer Constitution and Constituent Components)

The photothermographic material of the invention has a non-photosensitive layer in addition to the image forming layer. Non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the opposite side of the support from the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention can comprise a surface protective layer with an object to prevent adhesion of the image forming layer, and the like. The surface protective layer may be a single layer, or plural layers.

Description on the surface protective layer may be found in paragraph Nos. 0119 and 0120 of JP-A No. 11-65021 and in JP-A No. 2000-171936.

Preferred as the binder of the surface protective layer according to the invention is gelatin, but poly(vinyl alcohol) (PVA) is preferably used instead, or in combination. As gelatin, there can be used inert gelatin (e.g., Nitta gelatin 750), phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified product PVA-205 and PVA-335, as well as modified poly (vinyl alcohol) MP-203 (all of them are trade names of products from Kuraray Ltd.), and the like. The amount of coated poly(vinyl alcohol) (per 1 $m^2$ of support) in the surface protective layer (per one layer) is preferably in a range of from 0.3 $g/m^2$ to 4.0 $g/m^2$, and more preferably from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range of from 0.3 $g/m^2$ to 5.0 $g/m^2$, and more preferably from 0.3 $g/m^2$ to 2.0 $g/m^2$.

2) Matting Agent

A matting agent is preferably added to the photothermographic material of the invention in order to improve transportability. Description on the matting agent can be found in paragraphs Nos. 0126 and 0127 of JP-A No. 11-65021. The addition amount of the matting agent is preferably in a range of from 1 $mg/m^2$ to 400 $mg/m^2$, and more preferably from 5 $mg/m^2$ to 300 $mg/m^2$, on the basis of the coating amount per 1 $m^2$ of the photothermographic material.

The shape of the matting agent that can be used in the invention may be a fixed form or non-fixed form. Preferred is to use those having a fixed form and a spherical shape. The mean particle diameter is preferably in a range of from 0.5 μm to 10 μm, more preferably from 1.0 μm to 8.0 μm, and even more preferably from 2.0 μm to 6.0 μm. Furthermore, the particle size distribution of the matting agent is preferably set as such that the variation coefficient becomes 50% or lower, more preferably 40% or lower, and even more preferably 30% or lower. Herein, the variation coefficient is defined by (the standard deviation of particle diameter)/(mean diameter of the particle)×100. Furthermore, it is preferred to use two types of matting agents having low variation coefficient, in which the ratio of their mean particle diameters being higher than 3, in combination.

The level of matting on the image forming layer surface is not restricted as long as star-dust trouble does not occur, but the level of matting is preferably from 30 sec to 2000 sec, and particularly preferably from 40 sec to 1500 sec, when expressed by a Beck's smoothness. Beck's smoothness can be calculated easily, using Japan Industrial Standard (JIS) P8119 "The method of testing Beck's smoothness for papers and sheets using a Beck's test apparatus", or TAPPI standard method T479.

The level of matting of the back layer in the invention is preferably in a range of 1200 sec or less and 10 sec or more; more preferably, 800 sec or less and 20 sec or more; and even more preferably, 500 sec or less and 40 sec or more, when expressed by a Beck's smoothness.

In the present invention, a matting agent is preferably contained in an outermost layer of the photothermographic material, in a layer which functions as an outermost layer, or in a layer nearer to outer surface, and is also preferably contained in a layer which functions as a so-called protective layer.

3) Polymer Latex

In the present invention, polymer latex is preferably used in the surface protective layer or the back layer of the photothermographic material. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)), and the like. More specifically, there are mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroxyethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there may be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably from 20% by weight to 80% by weight, with respect to the total weight of binder.

4) Film Surface pH

The film surface pH of the photothermographic material according to the invention preferably yields a pH of 7.0 or lower, and more preferably 6.6 or lower, before thermal developing processing. Although there is no particular restriction concerning the lower limit, the lower limit of pH value is about 3. The most preferred film surface pH range is from 4 to 6.2. From the viewpoint of reducing the film surface pH, it is preferred to use an organic acid such as a phthalic acid derivative or a non-volatile acid such as sulfuric acid, or a volatile base such as ammonia for the adjustment of the film surface pH. In particular, ammonia is preferably used for the achievement of low film surface pH, because it can easily vaporize to remove it in the coating step or before applying thermal development.

It is also preferred to use a non-volatile base such as sodium hydroxide, potassium hydroxide, lithium hydroxide, or the like, in combination with ammonia. The method of measuring the film surface pH value is described in paragraph No. 0123 of the specification of JP-A No. 2000-284399.

5) Hardener

A hardener may be used in each of the image forming layer, protective layer, back layer, and the like according to the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salts of 2,4-dichloro-6-hydroxy-s-triazine, N,N-ethylenebis(vinylsulfonacetamide), and N,N-propylenebis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048 and the like.

The hardener is added as a solution, and this solution is added to the coating solution for the protective layer at the time from 180 minutes before coating to just before coating, and preferably at the time from 60 minutes before coating to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer such as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

6) Surfactant

Concerning the surfactant, the solvent, the support, the antistatic or electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573.

In the invention, it is preferred to use a fluorocarbon surfactant. Specific examples of the fluorocarbon surfactant can be found in those described in JP-A Nos. 10-197985, 2000-19680, and 2000-214554. Polymer fluorocarbon surfactants described in JP-A No. 9-281636 are also used preferably.

For the photothermographic material of the invention, the fluorocarbon surfactants described in JP-A Nos. 2002-82411, 2003-57780, and 2001-264110 are preferably used. Especially, the usage of the fluorocarbon surfactants described in JP-A Nos. 2003-57780 and 2001-264110 in an aqueous coating solution is preferred viewed from the standpoints of capacity in static control, stability of the coated surface state, and sliding capability. The fluorocarbon surfactant described in JP-A No. 2001-264110 is most preferred because of high capacity in static control and that it needs small amount to use.

According to the invention, the fluorocarbon surfactant can be used on either side of the image forming layer side or the backside, but it is preferred to use the fluorocarbon surfactant on the two sides. Further, it is particularly preferred to use it in combination with an electrically conductive layer including metal oxides described below. In this case, a sufficient performance is obtained even if the amount of the fluorocarbon surfactant on the side having the electrically conductive layer is reduced or removed.

The addition amount of the fluorocarbon surfactant is preferably in a range of from 0.1 mg/m$^2$ to 100 mg/m$^2$ on each side of the image forming layer side and backside, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2001-264110 is effective, and is used preferably in a range of from 0.01 mg/m$^2$ to 10 mg/m$^2$, and more preferably in a range of from 0.1 mg/m$^2$ to 5 mg/m$^2$.

7) Antistatic Agent

The photothermographic material of the invention preferably contains an electrically conductive layer including metal oxides or electrically conductive polymer. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or introducing different types of metallic atoms into the metal oxides are preferable for use. Examples of the metal oxide preferably include ZnO, $TiO_2$, and $SnO_2$; and the addition of Al, or In with respect to ZnO, the addition of Sb, Nb, P, halogen elements, or the like with respect to $SnO_2$, and the addition of Nb, Ta, or the like with respect to $TiO_2$ are preferred.

Particularly preferred for use is $SnO_2$ combined with Sb. The addition amount of heteroatom is preferably in a range of from 0.01 mol % to 30 mol %, and more preferably in a range of from 0.1 mol % to 10 mol %. The shape of the metal oxide includes, for example, spherical, needle-like, or tabular shape. Needle-like particle, in which (the major axis)/(the minor axis) ratio is 2.0 or higher, and more preferably from 3.0 to 50, is preferred viewed from the standpoint of the electric conductivity effect. The metal oxide is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$.

The antistatic layer according to the invention may be laid on either side of the image forming layer side or the backside, but it is preferred to set between the support and the back layer. Specific examples of the antistatic layer according to the invention are described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

8) Support

As the transparent support, preferably used is polyester, particularly, polyethylene terephthalate, which is subjected to heat treatment in the temperature range of from 130° C. to 185° C. in order to relax the internal strain which is caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. Concerning the support, it is preferred to apply undercoating technology such as water-soluble polyester described in JP-A No. 11-84574, a styrene-butadiene copolymer described in JP-A No. 10-186565, a vinylidene chloride copolymer described in JP-A No. 2000-39684, or the like. The moisture content of the support is preferably 0.5% by weight or lower, when coating for image forming layer or back layer is conducted on the support.

9) Other Additives

Furthermore, an antioxidant, a stabilizer, a plasticizer, a UV absorber, or a film-forming promoting agent may be added to the photothermographic material of the invention. Each of the additives is added to either of the image forming layer or the non-photosensitive layer. Reference can be made to WO No. 98/36322, EP No. 803,764A1, JP-A Nos. 10-186567 and 10-18568, and the like.

10) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating. An example of the shape of the slide coater for use in slide coating is shown in FIG. 11b.1, page 427, of the same literature. If desired, two or more layers can be coated simultaneously by the method described in pages 399 to 536 of the same literature or by the methods described in U.S. Pat. No. 2,761,791 and British Patent No. 837,095. Particularly preferable coating method in the invention is the method described in JP-A Nos. 2001-194748, 2002-153808, 2002-153803, and 2002-182333.

The coating solution for the image forming layer according to the invention is preferably a so-called thixotropic fluid. For the details of this technology, reference can be made to JP-A No. 11-52509. Viscosity of the coating solution for the image forming layer according to the invention at a shear velocity of 0.1 $S^{-1}$ is preferably from 400 mPa·s to 100,000 mPa·s, and more preferably from 500 mPa·s to 20,000 mPa·s. At a shear velocity of 1000 $S^{-1}$, the viscosity is preferably from 1 mPa·s to 200 mPa·s, and more preferably from 5 mPa·s to 80 mPa·s.

In the case of mixing two types of liquids on preparing the coating solution used for the invention, known in-line mixer or in-plant mixer is used preferably. Preferred in-line mixer used for the invention is described in JP-A No. 2002-85948, and preferred in-plant mixer used for the invention is described in JP-A No. 2002-90940.

The coating solution according to the invention is preferably subjected to antifoaming treatment to maintain the coated surface in a good state. Preferred method for antifoaming treatment in the invention is described in JP-A No. 2002-66431.

In the case of applying the coating solution according to the invention to the support, it is preferred to perform diselectrification in order to prevent adhesion of dust, particulates, and the like due to charging of the support. Preferred example of the method of diselectrification for use in the invention is described in JP-A No. 2002-143747.

Since a non-setting coating solution is used for the image forming layer in the invention, it is important to precisely control the drying air and the drying temperature. Preferred drying method for use in the invention is described in detail in JP-A Nos. 2001-194749 and 2002-139814.

In order to improve film-forming properties in the photothermographic material of the invention, it is preferred to apply a heat treatment immediately after coating and drying. The temperature of the heat treatment is preferably in a range of from 60° C. to 100° C. at the film surface, and the time period for heating is preferably in a range of from 1 sec to 60 sec. More preferably, heating is performed in a temperature range of from 70° C. to 90° C. at the film surface, and the time period for heating is from 2 sec to 10 sec. A preferred method of heat treatment for the invention is described in JP-A No. 2002-107872.

Furthermore, the production methods described in JP-A Nos. 2002-156728 and 2002-182333 are preferably employed in order to produce the photothermographic material of the invention stably and successively.

11) Wrapping Material

In order to suppress fluctuation from occurring on photographic property during raw stock storage of the photothermographic material of the invention, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}\ day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}\ day^{-1}$ or lower.

As specific examples of a wrapping material having low oxygen transmittance and/or vapor transmittance, reference can be made to, for instance, the wrapping material described in JP-A Nos. 8-254793 and 2000-206653.

12) Other Applicable Techniques

Techniques which can be used for the photothermographic material of the invention also include those in EP No. 803,764A1, EP No. 883,022A1, WO No. 98/36322, JP-A Nos. 56-62648 and 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

(Image Forming Method)

1) Imagewise Exposure

The photothermographic material of the invention may be subjected to imagewise exposure by any known methods. Preferably, the photothermographic material of the present invention is subjected to scanning exposure using a laser beam. As preferred laser beam which can be used in the invention, He—Ne laser of red through infrared emission, red laser diode, or $Ar^+$, He—Ne, He—Cd laser of blue through green emission, and blue laser diode are described. Preferred is red to infrared laser diode and the peak wavelength of laser beam is 600 nm to 900 nm, and preferably 620 nm to 850 nm.

In recent years, development has been made particularly on a light source module with an SHG (a second harmonic generator) device and a laser diode integrated into a single piece, and a blue laser diode, whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. The time period for development is preferably from 1 sec to 60 sec, more preferably from 3 sec to 30 sec, and even more preferably from 5 sec to 25 sec.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing portion, wherein the heating means comprises a plate heater, and a plurality of pressing rollers are oppositely provided along one surface of the plate heater, and the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C.

Such a process is also described in JP-A No. 54-30032, which allows for passage of moisture and organic solvents included in the photothermographic material out of the system, and also allows for suppressing the change in shapes of the support of the photothermographic material upon rapid heating of the photothermographic material.

For downsizing the thermal developing apparatus and for reducing the time period for thermal development, it is preferred that the heater is more stably controlled, and that a top part of one sheet of the photothermographic material is exposed and thermal development of the exposed part is started before exposure of the end part of the sheet has completed. Preferable imagers which enable a rapid processing according to the invention are described in, for example, JP-A Nos. 2002-289804 and 2002-091114.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques are applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the present invention is preferably employed as photothermographic materials for use in medical diagnosis, through forming black and white images by silver imaging.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

(Preparation of PET Support)

1. Film Manufacturing

PET having IV (intrinsic viscosity) of 0.66 (measured in phenol/tetrachloroethane=6/4 (by weight ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part of the tenter machine was slit off, and both edges of the film were knurled. Then the film was rolled up at the tension of 4 kg/cm$^2$ to obtain a roll having a thickness of 175 μm.

2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3. Undercoating

<Preparation of Coating Solution for Undercoat Layer>

| Formula (1) (for undercoat layer on the image forming layer side) | |
|---|---|
| Pesresin A-520 manufactured by Takamatsu Oil & Fat Co., Ltd. (30% by weight solution) | 59 g |
| Polyethylene glycol monononylphenyl ether (average number of ethylene oxide = 8.5) 10% by weight solution | 5.4 g |

-continued

| | |
|---|---|
| MP-1000 manufactured by Soken Chemical & Engineering Co., Ltd. (polymer fine particles, mean particle diameter of 0.4 μm) | 0.91 g |
| Distilled water | 935 mL |
| Formula (2) (for first layer on the backside) | |
| Styrene-butadiene copolymer latex (solid content of 40% by weight, styrene/butadiene weight ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| Formula (3) (for second layer on the backside) | |
| $SnO_2$/SbO (9/1 by weight ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

<Undercoating>

Both surfaces of the biaxially stretched polyethylene terephthalate support having a thickness of 175 μm were subjected to the corona discharge treatment described above, respectively. Thereafter, the aforementioned formula (1) of the coating solution for the undercoat was coated on one surface (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/$m^2$, and dried at 180° C. for 5 minutes. Furthermore, the aforementioned formula (3) of the coating solution for the undercoat was coated on the reverse side (backside) with a wire bar so that the amount of wet coating became 7.7 mL/$m^2$, and dried at 180° C. for 6 minutes. Thereby, an undercoated support was produced.

(Back Layer)

1) Preparation of Coating Solution for Back Layer

<<Coating Solution 1 for Back Layer>>

A vessel was kept at 40° C., and thereto were added 1000 g of gelatin (PZ gelatin, manufactured by Miyagi Chemical Industry Co., Ltd.), 3.9 g of benzisothiazolinone, and 16 L of water to allow gelatin to be dissolved. Additionally, 430 mL of a 5% by weight aqueous solution of blue dye-2, 70 mL of a 10% by weight aqueous solution of blue dye FRL-SF (trade name, manufactured by Clariant Co.), 800 mL of a 3% by weight aqueous solution of sodium polystyrenesulfonate, and 2000 g of a 10% by weight liquid of SIR latex (styrene/isoprene/acrylic acid=60.4% by weight/36.6% by weight/3.0% by weight) were admixed. Just prior to coating, 500 mL of a 4% by weight aqueous solution of N,N-ethylenebis(vinylsulfone acetamide) was admixed to give coating solution 1 for the back layer. The pH of the resulting coating solution was 6.4 at 40° C. Viscosity of the coating solution was 32 [mPa·s] which was measured with a B type viscometer at 40° C. (No. 1 rotor, 60 rpm).

<<Coating Solution 2 to 7 for Back Layer>>

Preparation of coating solution 2 to 7 for the back layer was conducted in a similar manner to the process in the preparation of the coating solution 1 for the back layer except that the ammonium salt described in Table 1 was added.

2) Preparation of Coating Solution for Back Surface Protective Layer

A vessel was kept at 40° C., and thereto were added 1000 g of gelatin having an isoelectric point of 4.8 (PZ gelatin, manufactured by Miyagi Chemical Industry Co., Ltd.), 6.37 g of benzisothiazolinone, and water to allow gelatin to be dissolved. Additionally, 287 g of gelatin dispersion of fine particles of monodispersed poly(ethylene glycol dimethacrylate-co-methyl methacrylate) (mean particle size of 7.7 μm, standard deviation of particle diameter of 0.3, 20% by weight), 360 g of a 10% by weight emulsified dispersion of dipentaerythritol hexaisostearate, 240 mL of a 5% by weight aqueous solution of di(2-ethylhexyl) sodium sulfosuccinate, 500 mL of a 3% by weight aqueous solution of sodium polystyrenesulfonate, 116 mL of a 1% by weight solution of fluorocarbon surfactant (F-1), 2.4 mL of a 2% by weight solution of fluorocarbon surfactant (F-2), and 721 mL of a 20% by weight liquid of ethyl acrylate/acrylic acid copolymer (weight ratio of the copolymerization of 96.4/3.6) latex were admixed. Just prior to coating, 900 mL of a 4% by weight aqueous solution of N,N-ethylenebis(vinylsulfone acetamide) was admixed to give a coating solution for the back surface protective layer in an amount of 20548 mL. The pH of the resulting coating solution was 6.2. Viscosity of the coating solution was 28 [mPa·s] which was measured with a B type viscometer at 40° C. (No. 1 rotor, 60 rpm).

3) Coating of Back Layer

The backside of the undercoated support described above was subjected to simultaneous double coating so that the coating solution for the back layer gave the coating amount of gelatin of 1.65 g/$m^2$, and so that the coating solution for the back surface protective layer gave the coating amount of gelatin of 0.68 g/$m^2$, followed by drying to produce a back layer. The pH of the coated film surface was 5.5.

(Image Forming Layer, Intermediate Layer, and Surface Protective Layer)

1. Preparation of Coating Materials

1) Silver Halide Emulsion

<<Preparation of Silver Halide Emulsion 1>>

A liquid was prepared by adding 3.1 mL of a 1% by weight solution of potassium bromide, and then 3.5 mL of 0.5 mol/L sulfuric acid and 31.7 g of phthalated gelatin to 1421 mL of distilled water. The liquid was kept at 30° C. while stirring in a stainless-steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, solution C prepared through diluting 51.86 g of silver nitrate by adding distilled water to give the volume of 317.5 mL, and solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, an aqueous solution of potassium hexacyanoferrate (II) was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazolin-3-one, followed by elevating the temperature to 47° C. at 40 minutes thereafter. At 20 minutes after elevating the temperature, sodium benzenethiosulfonate in a methanol solution was added at $7.6\times10^{-5}$ mol per 1 mol of silver. At additional 5 minutes later, tellurium sensitizer C in a methanol solution was added at $2.9\times10^{-4}$ mol per 1 mol of silver, and the mixture was subjected to ripening for 91 minutes. Thereafter, a methanol solution of spectral sensitizing dye A and spectral sensitizing dye B with a molar ratio of 3:1 was added thereto at $1.2\times10^{-3}$ mol in total of the spectral sensitizing dyes A and B per 1 mol of silver. At one minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide emulsion 2 was conducted in a similar manner to the process in the preparation of the silver halide emulsion 1 except that: the temperature of the liquid upon the grain formation was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; the time period for adding the solution C was changed to 30 minutes; and potassium hexacyanoferrate (II) was deleted. Further, precipitation/desalting/water washing/dispersion were carried out similar to the silver halide emulsion 1. Furthermore, spectral sensitization, chemical sensitization, and addition of 5-methyl-2-mercaptobenzimidazole and 1-phenyl-2-heptyl-5-mercapto-1,3,4-triazole were executed similar to those in the preparation of the silver halide emulsion 1 except that: the amount of the tellurium sensitizer C to be added was changed to $1.1\times10^{-4}$ mol per 1 mol of silver; the amount of the methanol solution of spectral sensitizing dye A and spectral sensitizing dye B with a molar ratio of 3:1 to be added was changed to $7.0\times10^{-4}$ mol in total of the spectral sensitizing dyes A and B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver. Thereby, silver halide emulsion 2 was obtained. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide emulsion 3 was conducted in a similar manner to the process in the preparation of the silver halide emulsion 1 except that the temperature of the liquid upon the grain formation was altered from 30° C. to 27° C. Further, precipitation/desalting/water washing/dispersion were carried out similar to the silver halide emulsion 1. Silver halide emulsion 3 was obtained similar to the silver halide emulsion 1 except that: the spectral sensitizing dye A and the spectral sensitizing dye B were added as a solid dispersion (aqueous gelatin solution) at a molar ratio of 1:1 with the amount to be added being $6\times10^{-3}$ mol in total of the spectral sensitizing dyes A and B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

Further, as "a compound that is one-electron-oxidized to provide a one-electron oxidation product which releases one or more electrons", the compounds Nos. 1, 20, and 26 were added respectively in an amount of $2\times10^{-3}$ mol per 1 mol of silver in silver halide.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30°

C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the result of the content of behenic acid being 96 mol %. In addition, lignoceric acid, arachidic acid, and erucic acid were included at 2 mol %, 2 mol %, and 0.001 mol %, respectively.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give solution B of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution B of sodium behenate and the total amount of the aqueous solution of silver nitrate with sufficient stirring at a constant flow rate over 93 minutes and 15 seconds, and 90 minutes, respectively. In this process, during first 11 minutes following the initiation of adding the aqueous solution of silver nitrate, the added material was restricted to the aqueous solution of silver nitrate alone. The addition of the solution B of sodium behenate was thereafter started, and during 14 minutes and 15 seconds following the completion of adding the aqueous solution of silver nitrate, the added material was restricted to the solution B of sodium behenate alone. The temperature inside of the reaction vessel was then set to be 30° C. and the temperature outside was controlled so that the temperature of the liquid could be kept constant. In addition, the temperature of a pipeline for the addition system of the solution B of sodium behenate was kept constant by circulation of warm water outside of a double wall pipe, so that the temperature of the liquid at an outlet in the leading edge of the nozzle for addition was adjusted to be 75° C.

Further, the temperature of a pipeline for the addition system of the aqueous solution of silver nitrate was kept constant by circulation of cool water outside of a double wall pipe. Position at which the solution B of sodium behenate was added and the position at which the aqueous solution of silver nitrate was added were arranged symmetrically with a shaft for stirring located at a center. Moreover, both of the positions were adjusted to avoid contact with the reaction liquid.

After completing the addition of the solution B of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of silver behenate was evaluated by electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b, and c are as defined aforementioned).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling operation, coiled heat exchangers were equipped in front of and behind the interaction chamber respectively, and accordingly, the temperature for the dispersion was set to be 18° C. by regulating the temperature of the cooling medium.

3) Preparation of Reducing Agent Dispersion

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of benzisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less.

The resulting reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resulting hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resulting development accelerator dispersion was subjected to filtration with a polypropylene filter having a pore size of 3.0 μm to remove foreign substances such as dust, and stored.

6) Preparation of Development Accelerator-2 Dispersion and Color-tone-adjusting Agent-1 Dispersion Also concerning solid dispersions of development accelerator-2 and color-tone-adjusting agent-1, dispersion was executed similar to that in the development accelerator-1, and thereby dispersions of 20% by weight and 15% by weight were respectively obtained.

7) Preparation of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP-203), 0.4 kg of a 20% by weight aqueous solution of sodium triisopropylnaphthalenesulfonate, and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resulting organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP-203), and 0.4 kg of a 20% by weight aqueous solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of benzisothiazolinone sodium salt and water were added thereto, thereby adjusting the concentration of the organic polyhalogen compound to be 30% by weight. This dispersion was warmed at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resulting organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparation of Aqueous Solution of Mercapto Compound

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of Solid Dispersion of Azomethine Dye

To 1.0 kg of azomethine dye-A and 3.0 kg of a 10% by weight aqueous solution of modified poly(vinyl alcohol) (manufactured by Kuraray Co., Ltd., Poval MP-203) were added 42 g of a 48% by weight aqueous solution of a surfactant (trade name: PIONIN A-43-S, manufactured by Takemoto Oil & Fat Co., Ltd.) and 3.0 g of an antifoaming agent (trade name: SURFYNOL 104E, manufactured by Nissin Chemical Industry Co., Ltd.), and the mixture was thoroughly mixed to give slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 1.0 g of benzisothiazolinone sodium salt and water were added thereto, thereby adjusting the concentration of the water-insoluble azomethine dye to be 10% by weight. This dispersion was warmed at 40° C. for 2 hours to obtain a solid dispersion of azomethine dye. Particles of the azomethine dye included in the resulting azomethine dye dispersion had a median diameter of 0.49 μm, and a maximum particle diameter of 2.6 μm or less. The resulting azomethine dye dispersion was subjected to filtration with a polypropylene filter having a pore size of 3.0 μm to remove foreign substances such as dust, and stored.

11) Preparation of Dispersion of Silver Salt of Benzotriazole 1 kg of benzotriazole was added to a liquid prepared by dissolving 360 g of sodium hydroxide in 9100 mL of water, and then the mixture was stirred for 60 minutes. Thereby, solution BT of sodium salt of benzotriazole was prepared.

A liquid prepared by dissolving 55.9 g of alkali-processed de-ionized gelatin in 1400 mL of distilled water was kept at 70° C. while stirring in a stainless-steel reaction vessel. And then, solution A prepared through diluting 54.0 g of silver nitrate by adding distilled water to give the volume of 400 mL, and solution B prepared through diluting 397 mL of the solution BT of sodium salt of benzotriazole with distilled water to give the volume of 420 mL were added. A method of double jet was executed through adding 220 mL of the solution B at a constant flow rate of 20 mL/min over 11 minutes to the stainless-steel reaction vessel, and at one minute post initiation of the addition of the solution B, 200 mL of the solution A was added thereto at a constant flow rate of 20 mL/min over 10 minutes. Moreover, at 6 minutes later after completing the addition, the solution A and the solution B were added simultaneously at a constant flow rate of 33.34 mL/min over 6 minutes in an amount of 200 mL respectively. The mixture was cooled to 45° C., and 92 mL of Demol N (10% by weight aqueous solution, manufactured by Kao Corporation) was added to the mixture while stirring. The mixture was adjusted to the pH of 4.1 with 1 mol/L sulfuric acid. After stopping stirring, the mixture was subjected to precipitation/desalting/water washing steps.

Thereafter, the resulting mixture was warmed to 50° C. and 51 mL of 1 mol/L sodium hydroxide was added thereto while stirring, and then 11 mL of a methanol solution (3.5%) of benzisothiazolinone and 7.7 mL of a methanol solution (1%) of sodium benzenethiosulfonate were added thereto. After stirring the mixture for a period of 80 minutes, the mixture was adjusted to the pH of 7.8 with 1 mol/L sulfuric acid. Thereby, dispersion of silver salt of benzotriazole was prepared.

Particles of the prepared dispersion of silver salt of benzotriazole had a mean equivalent circular diameter of 0.172 μm (a variation coefficient of an equivalent circular diameter distribution of 18.5%), a mean length of long side of 0.32 μm, a mean length of short side of 0.09 μm, and a mean ratio of the length of short side to the length of long side of 0.298. Particle size and the like were determined from the average of 300 particles using an electron microscope.

12) Preparation of SBR Latex Liquid

SBR latex (TP-1) was prepared as follows.

Into a polymerization vessel of a gas monomer reaction apparatus (TAS-2J type, manufactured by Taiatsu Techno Corporation) were poured 287 g of distilled water, 7.73 g of a surfactant (PIONIN A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing, of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature of the vessel was elevated to 60° C. Thereto was added a solution obtained by dissolving 1.875 g of ammonium persulfate in 50 mL of water, and the mixture was stirred for 5 hours as it stands. Further, the mixture was heated to 90° C., followed by stirring for 3 hours. After completing the reaction, the inner temperature of the vessel was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.2. Thereafter, filtration with a polypropylene filter having the pore size of 3.0 μm was conducted to remove foreign substances such as dust, and stored. Accordingly, SBR latex TP-1 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid content of 44% by weight, an equilibrium moisture content at 25° C. and 60% RH of 0.6% by weight, and an ionic conductivity of 4.80 mS/cm (measurement of the ionic conductivity was performed using a conductometer CM-30S manufactured by To a Electronics Ltd. for the latex stock solution (44% by weight) at 25° C.).

13) Preparation of SIR Latex Liquid

SIR latex (TP-2) was prepared as follows.

1500 g of distilled water was poured into a polymerization vessel of a gas monomer reaction apparatus (TAS-2J type, manufactured by Taiatsu Techno Corporation), and the vessel was heated for 3 hours at 90° C. to make passive film over the stainless-steel vessel surface and stainless-steel stirring device. Thereafter, 582.28 g of distilled water deaerated by nitrogen gas for one hour, 9.49 g of a surfactant (PIONIN A-43-S (manufactured by TAKEMOTO OIL & FAT CO., LTD.)), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercaptan were added into the pretreated reaction vessel. And then, the reaction vessel was sealed and the mixture was stirred at a stirring rate of 225 rpm, followed by elevating the inner temperature to 65° C. A solution obtained by dissolving 2.61 g of ammonium persulfate in 40 mL of water was added thereto, and the mixture was kept for 6 hours with stirring. At this point, the polymerization ratio was 90% according to the solid content measurement. Thereto, a solution obtained by dissolving 5.22 g of acrylic acid in 46.98 g of water was added, and then 10 g of water was added, and further a solution obtained by dissolving 1.30 g of ammonium persulfate in 50.7 mL of water was added. After the addition, the mixture was heated to 90° C. and stirred for 3 hours. After completing the reaction, the inner temperature of the vessel was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.2. Thereafter, the resulting mixture was filtered with a polypropylene filter having a pore size of 3.0 μm to remove foreign substances such as dust, and stored. Accordingly, 1248 g of SIR latex TP-2 was obtained. Upon the measurement of halogen ion by ion chromatography, concentration of chloride ion was revealed to be 3 ppm. As a result of the measurement of the concentration of the chelating agent by high performance liquid chromatography, it was revealed to be 142 ppm.

The obtained latex had a mean particle diameter of 113 nm, Tg of 15° C., a solid content of 41.3% by weight, an equilibrium moisture content at 25° C. and 60RH % of 0.4% by weight, and an ionic conductivity of 5.23 mS/cm (measurement of the ionic conductivity was performed using a conductometer CM-30S manufactured by To a Electronics Ltd. at 25° C.).

14) Preparation of SIR Latex (TP-3)

SIR latex was synthesized in similar composition and in a similar process to the above-described SIR latex (TP-2). After completing the reaction, the inner temperature of the vessel was lowered to reach to the room temperature. And then, the mixture was treated by adding 1 mol/L sodium hydroxide and ammonium hydroxide to give the molar ratio of $Na^+$ ion: $NH_4^+$ ion=3.2:3.3, and thus, the pH of the mixture was adjusted to 8.2. Thereafter, the resulting mixture was filtered with a polypropylene filter having a pore size of 3.0 μm to remove foreign substances such as dust, and stored. Accordingly, 1248 g of SIR latex TP-3 was obtained. As a result of the measurement of the concentration of the chelating agent by high performance liquid chromatography, it was revealed to be 142 ppm.

15) Preparation of SIR Latex (TP-4)

SIR latex was synthesized in similar composition and in a similar process to the above-described SIR latex (TP-2). After completing the reaction, the inner temperature of the vessel was lowered to reach to the room temperature. And then, the mixture was treated by adding 1 mol/L sodium hydroxide, and thus, the pH of the mixture was adjusted to 8.2. Thereafter, the resulting mixture was filtered with a polypropylene filter having a pore size of 3.0 μm to remove foreign substances such as dust, and stored. Accordingly, 1248 g of SIR latex TP-4 was obtained.

2. Preparation of Coating Solutions

1) Preparation of Coating Solution for Image Forming Layer

To the dispersion of silver salt of a fatty acid in an amount of 1000 g were serially added 135 mL of water, 24 mL of a 5% by weight aqueous solution of blue dye-2, 5 g of the solid dispersion of azomethine dye, 25 g of the organic polyhalogen compound-1 dispersion, 39 g of the organic polyhalogen compound-2 dispersion, 171 g of the phthalazine compound-1 solution, 1067 g of the SIR latex liquid (TP-4), 153 g of the reducing agent-2 dispersion, 22 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution. By adding, just prior to coating, 140 g of the mixed emulsion A for a coating solution thereto and mixing sufficiently, a coating solution for the image forming layer was prepared, and the coating solution was allowed to be transported to a coating die and coated.

2) Preparation of Coating Solution for Intermediate Layer

<<Coating Solution-1 for Intermediate Layer>>

To 1000 g of poly(vinyl alcohol) PVA-205 (manufactured by Kuraray Co., Ltd.), 27 mL of a 5% by weight aqueous solution of di(2-ethylhexyl) sodium sulfosuccinate, 4200 mL of a 19% by weight liquid of methyl methacrylate/styrene/butyl acrylate/hydroxyethyl methacrylate/acrylic acid copolymer (weight ratio of the copolymerization of 57/8/28/5/2) latex, 27 mL of a 5% by weight aqueous solution of aerosol OT (manufactured by American Cyanamid Co.), and 135 mL of a 20% by weight aqueous solution of diammonium phthalate was added water to give the total amount of 10000 g. The mixture was adjusted to the pH of 7.0 with sodium hydroxide. Accordingly, a coating solution for the intermediate layer was prepared, and was fed to a coating die to provide 9.0 mL/m$^2$.

Viscosity of the coating solution was 58 [mPa·s] which was measured with a B type viscometer at 40° C. (No. 1 rotor, 60 rpm).

<<Coating Solution-2 to −8 for Intermediate Layer>>

Preparation of coating solution-2 to −8 for the intermediate layer was conducted in a similar manner to the process in the preparation of the coating solution-1 for the intermediate layer, except that the ammonium salt described in Table 1 was added.

3) Preparation of Coating Solution for First Layer of Surface Protective Layers

In 704 mL of water were dissolved 100 g of inert gelatin and 10 mg of benzisothiazolinone, and thereto were added 146 g of the dispersion of silver salt of benzotriazole, 180 g of a 19% by weight liquid of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid, and 5.4 mL of a 5% by weight aqueous solution of di(2-ethylhexyl)sodium sulfosuccinate, and were mixed. By adding, just prior to coating, 40 mL of a 4% by weight chrome alum thereto and mixing with a static mixer, a coating solution for the first layer of the surface protective layers was prepared, and was fed to a coating die so that the amount of the coating solution became 35 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In 785 mL of water were dissolved 100 g of inert gelatin and 10 mg of benzisothiazolinone, and thereto were added 10 g of a 10% by weight emulsified dispersion of liquid paraffin, 30 g of a 10% by weight emulsified dispersion of dipentaerythritol hexaisostearate, 180 g of a 19% by weight liquid of methyl methacrylate/styrene/butyl acrylate/hydroxyethyl methacrylate/acrylic acid copolymer (weight ratio of the copolymerization of 57/8/28/5/2) latex, 2.3 g of NEOPELEX G-15 (trade name, manufactured by Kao Corporation), 0.3 g of EMALEX 125 (trade name, manufactured by Nihon Emulsion Co., Ltd.), 40 mL of a 15% by weight methanol solution of phthalic acid, 11 mL of a 1% by weight solution of fluorocarbon surfactant (F-1), 11 mL of a 1% by weight aqueous solution of fluorocarbon surfactant (F-2), 28 mL of a 5% by weight aqueous solution of di(2-ethylhexyl) sodium sulfosuccinate, 25 g of poly(methyl methacrylate) fine particles (mean particle diameter of 3.6 μm, distribution of volume-weighted average being 60%), and 37 g of a 30% by weight solution of carnauba wax (Selosol 524, trade name, manufactured by Chukyou Yushi Co., Ltd.), and the mixture was mixed to give a coating solution for the second layer of the surface protective layers, which was fed to a coating die to provide 4.2 mL/m$^2$.

Viscosity of the coating solution was 19 [mPa·s] which was measured with a B type viscometer at 40° C. (No. 1 rotor, 60 rpm).

3. Preparation of Photothermographic Material

1) Preparation of Photothermographic Material 1

Reverse surface to the backside was subjected to simultaneous multilayer coating by a slide bead coating method in order of the image forming layer, intermediate layer, first layer of the surface protective layers, and second layer of the surface protective layers, starting from the undercoated face, and thereby sample of photothermographic material was produced. In the process, the temperature of the coating solution was adjusted to 31° C. for the image forming layer and intermediate layer, to 36° C. for the first layer of the surface protective layers, and to 37° C. for the second layer of the surface protective layers.

The coating amount of each compound (g/m$^2$) for the image forming layer of the photothermographic material 1 is as follows.

| | |
|---|---|
| Silver salt of a fatty acid | 5.27 |
| Blue dye-2 | 0.25 |
| Azomethine dye-A | 0.09 |
| Organic polyhalogen compound-1 | 0.14 |
| Organic polyhalogen compound-2 | 0.28 |
| Phthalazine compound-1 | 0.18 |
| SIR latex (TP-4) | 9.43 |
| Reducing agent-2 | 0.77 |
| Hydrogen bonding compound-1 | 0.112 |
| Development accelerator-1 | 0.019 |
| Development accelerator-2 | 0.016 |
| Color-tone-adjusting agent-1 | 0.006 |
| Mercapto compound-2 | 0.003 |
| Silver halide (on the basis of Ag content) | 0.13 |

Conditions for coating and drying were as follows.

Coating was performed at a speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind before coating. In the subsequent cooling zone, the coating solution was cooled by air having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus. After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the backside as a Beck's smoothness. In addition, measurement of the film surface pH at the image forming layer side gave the result of 6.0.

2) Preparation of Photothermographic Material 2 to 10

Preparation of photothermographic material 2 to 10 was conducted in a similar manner to the process in the preparation of photothermographic material 1, except that: SIR latex (TP-4) was removed from the image forming layer; instead of this, mixture of SBR latex (TP-1), SIR latex (TP-2), and SIR latex (TP-3) was used; and an ammonium salt was added to the intermediate layer to change the total amount of ammonia. The ammonium salt added to the intermediate layer and the amount of ammonia contained in the photothermographic material are shown in Table 1.

TABLE 1

| Sample No. | Back Layer: Coating Solution No. | Back Layer: Ammonium Salt | Backside: Ammonia Content (A2) (mol/m$^2$) | Intermediate Layer: Coating Solution No. | Intermediate Layer: Ammonium Salt | Image Forming Layer Side: Ammonia Content (A1) (mol/m$^2$) | Total: Amount of Ammonia (mol/m$^2$) | Ratio of: Ammonia Content (A2/A1) | Note |
|---|---|---|---|---|---|---|---|---|---|
| 1 | 1 | — | $2.4 \times 10^{-4}$ | 1 | Ammonium | $1.6 \times 10^{-4}$ | $4.00 \times 10^{-4}$ | 1.50 | Comparative |
| 2 | 2 | Ammonium sulfate | $1.2 \times 10^{-2}$ | 2 | Ammonium sulfate | $1.2 \times 10^{-2}$ | $2.40 \times 10^{-2}$ | 1.00 | Comparative |
| 3 | 3 | — | $2.4 \times 10^{-4}$ | 3 | Ammonium sulfate | $1.3 \times 10^{-3}$ | $1.54 \times 10^{-3}$ | 0.18 | Comparative |
| 4 | 4 | Ammonium sulfate | $1.7 \times 10^{-3}$ | 4 | Ammonium sulfate | $2.4 \times 10^{-4}$ | $1.94 \times 10^{-3}$ | 7.08 | Comparative |
| 5 | 4 | Ammonium sulfate | $1.7 \times 10^{-3}$ | 5 | Ammonium sulfate | $1.1 \times 10^{-3}$ | $2.80 \times 10^{-3}$ | 1.55 | Invention |
| 6 | 5 | Ammonium sulfate | $1.2 \times 10^{-3}$ | 6 | Ammonium sulfate | $7.3 \times 10^{-4}$ | $1.93 \times 10^{-3}$ | 1.64 | Invention |
| 7 | 6 | Ammonium sulfate | $1.2 \times 10^{-3}$ | 7 | Ammonium phthalate | $1.3 \times 10^{-3}$ | $2.50 \times 10^{-3}$ | 0.92 | Invention |
| 8 | 6 | Ammonium sulfate | $1.2 \times 10^{-3}$ | 8 | Ammonium phthalate | $7.3 \times 10^{-4}$ | $1.93 \times 10^{-3}$ | 1.64 | Invention |
| 9 | 7 | Ammonium sulfate | $8.0 \times 10^{-4}$ | 7 | Ammonium phthalate | $1.3 \times 10^{-3}$ | $2.10 \times 10^{-3}$ | 0.62 | Invention |
| 10 | 5 | Ammonium sulfate | $1.2 \times 10^{-3}$ | 7 | Ammonium phthalate | $1.3 \times 10^{-3}$ | $2.50 \times 10^{-3}$ | 0.92 | Invention |

Chemical structures of the compounds used in Examples of the invention are shown below.

Blue dye-2

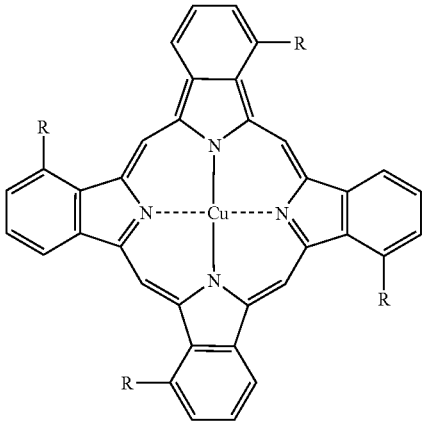

Azomethine dye-A

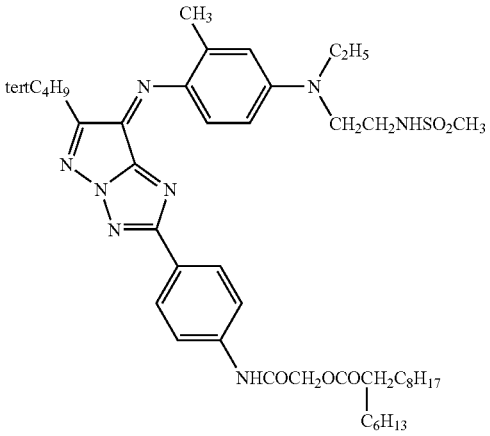

-continued

Tellurium sensitizer C

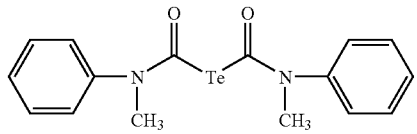

Spectral sensitizing dye A

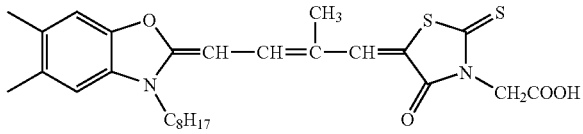

Spectral sensitizing dye B

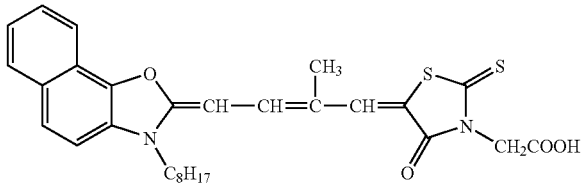

Compound 1 that is one-electron-oxidized to provide a one-electron oxidation product which releases one or more electrons

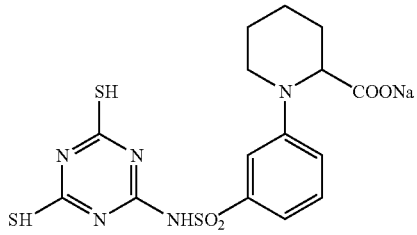

Compound 20 that is one-electron-oxidized to provide a one-electron oxidation product which releases one or more electrons

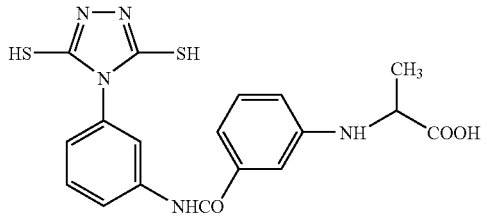

Compound 26 that is one-electron-oxidized to provide a one-electron oxidation product which releases one or more electrons

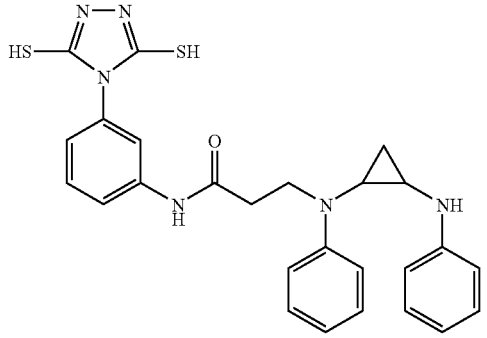

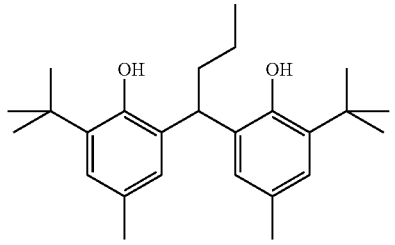

Reducing agent-2

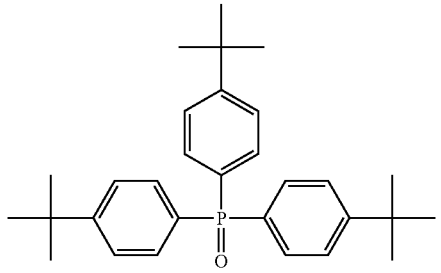

Hydrogen bonding compound-1

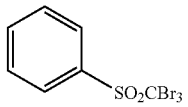

Organic polyhalogen compound-1

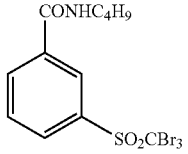

Organic polyhalogen compound-2

-continued

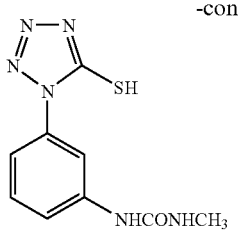

Mercapto compound-2

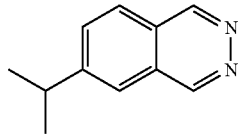

Phthalazine compound-1

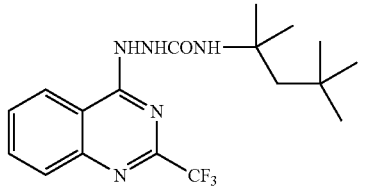

Development accelerator-1

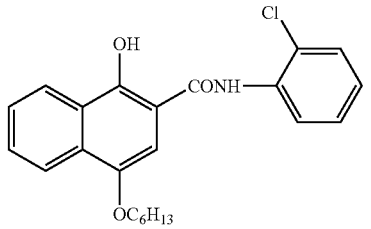

Development accelerator-2

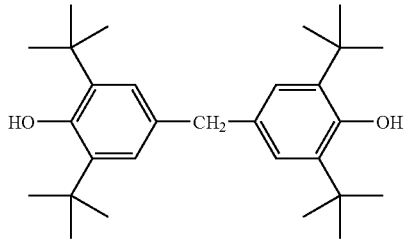

Color-tone-adjusting agent-1

(F-1)

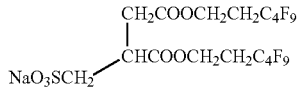

(F-2)

Mixture of 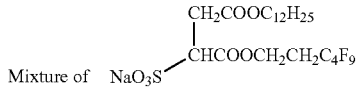 and 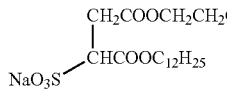

4. Evaluation of Photographic Performance

<Preparation>

The obtained sample was cut into a half-cut size and was wrapped with the following packaging material under an environment of 25° C. and 50% RH, and stored for 2 weeks at an ambient temperature. Thereafter, the evaluation described below was performed.

<Packaging Material>

A film laminated with PET 10 μm/PE 12 μm/aluminum foil 9 μm/Ny 15 μm/polyethylene 50 μm containing carbon at 2% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

<Exposure and Development of Photothermographic Material>

To each sample, imagewise exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation of the obtained image was performed with a densitometer.

4-1. Evaluation Terms

1) Measurement of Ammonia Content

The ammonia content according to the present invention is a value measured by the following procedure.

<Measuring Method>

Photothermographic material of a size suitable to the measurement was prepared. Concerning the side of the support opposite from the side to be measured, film thereon was peeled off or the side was protected by an adhesive tape or the like. As an extracting solution, a solution obtained by diluting 1 g of acetic acid (90% by weight) with 148 mL of water was prepared. The photothermographic material described above was soaked in the extracting solution for 2 hours to extract the ammonia contained therein. Thereafter, the amount of ammonia in the resulting solution after the extraction was determined by using ion chromatography.

2) Photographic Properties

The photothermographic material prepared above was subjected to exposure while changing the exposure value of a laser beam step by step. The density of the image obtained after development was measured by a Macbeth densitometer. A photographic characteristic curve was prepared by plotting the density against the exposure value.

<Fog>

Fog is expressed in terms of a density of an unexposed portion.

<Sensitivity>

Sensitivity is an inverse of the exposure value giving a density of fog+1.0. The sensitivities of samples are shown as relative values, with the sensitivity of sample No. 1 designated as 100.

<Image Tone>

With regard to the highlight portion of the obtained image, image tone was subjected to sensory evaluation by five persons. Relatively favorable evaluation was designated as 10 points, the points were averaged, and the averaged point color tone evaluation was classified into five levels as follows: [5] is an excellent level; [1] is the most inferior level; and [3] is a level inferior to [5] but not problematic for practical use. The evaluation results are shown in Table 2.

3) Evaluation of Raw Stock Storage Stability

As a compulsory storage condition, each sample was stored under a condition of 40° C. for 20 days while keeping the sample in the packaging mentioned above. Thereafter, the sample was taken out from the packaging and subjected to evaluation with respect to photographic properties.

4) Evaluation of Image Storage Stability

<<Print-out Resistance>>

Images obtained by thermally developing the samples were stored under an environment of 30° C. and 70% RH and an illumination of 1,000 lux under a white fluorescent lamp for 3 days. Thereafter, changes in color tone of the fog portion and the image portion were observed, evaluated and classified into five levels as follows: [5] is an excellent level; [1] is the most inferior level; and [3] is a level inferior to [5] but not problematic for practical use. The evaluation results are shown in Table 2.

<<Change in Image Tone during Dark and Thermal Storage>>

An image obtained after thermal development was placed under conditions of 25° C. and 70% RH for 3 hours, and was wrapped in the packaging mentioned above and stored under an environment of 50° C. for two weeks. Thereafter, changes in color tone of the fog portion and the image portion were observed, evaluated and classified into five levels as follows: [5] is an excellent level; [1] is the most inferior level; and [3] is a level inferior to [5] but not problematic for practical use. The evaluation results are shown in Table 2.

4-2. Evaluation Results

The obtained results are shown in Table 2.

The samples of the present invention exhibit high sensitivity, favorable image tone, excellent raw stock storage stability, little increase in fog, little change in sensitivity, and little change in image tone. Moreover, the samples of the present invention exhibit excellent image storage stability.

Especially, sample Nos. 7 and 8 provide excellent results in each performance mentioned above.

In contrast, comparative sample No. 1 exhibits unfavorable image tone, inferior raw stock storage stability, and great increase in fog. Comparative sample No. 2 exhibits unfavorable bluish image tone, inferior raw stock storage stability, and great change in sensitivity.

Moreover, although comparative sample No. 3 exhibits favorable image tone, it exhibits inferior raw stock storage stability and deterioration in image tone during storage. Comparative sample No. 4 provides unfavorable results such as unfavorable image tone.

TABLE 2

| | Photographic Properties | | | Raw Stock Storage Stability | | | Image Storage Stability | | |
|---|---|---|---|---|---|---|---|---|---|
| Sample No. | Fog | Sensitivity | Image Tone | Fog | Sensitivity | Image Tone | Print-out Resistance | Change in Image Tone during Dark and Thermal Storage | Note |
| 1 | 0.17 | 100 | 1 | 0.25 | 97 | 1 | 1 | 1 | Comparative |
| 2 | 0.17 | 89 | 2 | 0.23 | 126 | 3 | 2 | 2 | Comparative |
| 3 | 0.17 | 107 | 4 | 0.20 | 135 | 2 | 4 | 2 | Comparative |
| 4 | 0.17 | 103 | 2 | 0.19 | 97 | 3 | 2 | 2 | Comparative |
| 5 | 0.17 | 110 | 4 | 0.19 | 123 | 4 | 4 | 4 | Invention |
| 6 | 0.17 | 110 | 4 | 0.19 | 123 | 4 | 4 | 4 | Invention |
| 7 | 0.17 | 110 | 5 | 0.19 | 123 | 5 | 4 | 5 | Invention |

TABLE 2-continued

| Sample No. | Photographic Properties Fog | Photographic Properties Sensitivity | Photographic Properties Image Tone | Raw Stock Storage Stability Fog | Raw Stock Storage Stability Sensitivity | Raw Stock Storage Stability Image Tone | Image Storage Stability Print-out Resistance | Image Storage Stability Change in Image Tone during Dark and Thermal Storage | Note |
|---|---|---|---|---|---|---|---|---|---|
| 8 | 0.17 | 110 | 5 | 0.19 | 123 | 5 | 4 | 5 | Invention |
| 9 | 0.17 | 110 | 5 | 0.19 | 127 | 5 | 4 | 4 | Invention |
| 10 | 0.17 | 110 | 5 | 0.19 | 123 | 5 | 4 | 4 | Invention |

Example 2

1. Preparation of Samples

Samples were prepared similar to Example 1, except that the blue dye-2 contained in the back layer and image forming layer in Example 1 was changed to Dye No. 2, 10, 12, 20, 43, 45, or 53.

2. Results of Performance Evaluation

The obtained samples were evaluated similar to Example 1. As a result, the samples of the present invention were found to exhibit excellent performances similar to Example 1.

Example 3

1. Preparation of Sample Nos. 31 to 37

Preparation of sample Nos. 31 to 37 was conducted in a similar manner to the process in the preparation of sample No. 7 of Example 1, except that 1 mol/L sodium hydroxide aqueous solution and 1 mol/L acetic acid aqueous solution were added to the back layer in an amount necessary for adjusting the film surface pH at the backside to a desired value.

2. Results of Performance Evaluation

The obtained samples were evaluated similar to Example 1, and the obtained results are shown in Table 3.

In the case where the film surface pH at the backside is lower than 4.5, raw stock storage stability is deteriorated, and change in image tone becomes great. On the other hand, when the film surface pH at the backside exceeds 6.0, increase in fog and deterioration in image tone are seen. When the film surface pH at the backside is in a range of from 4.5 to 6.0, particularly excellent performance is obtained.

Example 4

(Preparation of PET Support)

1. Film Manufacturing

PET having IV (intrinsic viscosity) of 0.66 (measured in phenol/tetrachloroethane=6/4 (by weight ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part of the tenter machine was slit off, and both edges of the film were knurled. Then the film was rolled up at the tension of 4 kg/cm$^2$ to obtain a roll having a thickness of 175 μm.

2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

TABLE 3

| Sample No. | Film Surface pH Backside | Film Surface pH Image Forming Layer Side | Photographic Properties Fog | Photographic Properties Sensitivity | Photographic Properties Image Tone | Raw Stock Storage Stability Fog | Raw Stock Storage Stability Sensitivity | Raw Stock Storage Stability Image Tone | Image Storage Stability Print-out Resistance | Image Storage Stability Change in Image Tone during Dark and Thermal Storage | Note |
|---|---|---|---|---|---|---|---|---|---|---|---|
| 31 | 4.0 | 5.5 | 0.17 | 110 | 5 | 0.19 | 123 | 3 | 4 | 5 | Invention |
| 32 | 4.5 | 5.5 | 0.17 | 110 | 5 | 0.19 | 123 | 5 | 4 | 5 | Invention |
| 33 | 5.0 | 5.5 | 0.17 | 110 | 5 | 0.19 | 123 | 5 | 4 | 5 | Invention |
| 34 | 5.5 | 5.5 | 0.17 | 110 | 5 | 0.19 | 123 | 5 | 4 | 5 | Invention |
| 35 | 6.0 | 5.5 | 0.17 | 110 | 5 | 0.19 | 123 | 5 | 4 | 5 | Invention |
| 36 | 6.5 | 5.5 | 0.17 | 110 | 5 | 0.20 | 132 | 4 | 4 | 5 | Invention |
| 37 | 7.0 | 5.5 | 0.17 | 110 | 5 | 0.22 | 138 | 3 | 4 | 5 | Invention |

3. Undercoating

<Preparation of Coating Solution for Undercoat Layer>

| Formula (1) (for undercoat layer on the image forming layer side) | |
|---|---|
| Pesresin A-520 manufactured by Takamatsu Oil & Fat Co., Ltd. (30% by weight solution) | 59 g |
| Polyethylene glycol monononylphenyl ether (average number of ethylene oxide = 8.5) 10% by weight solution | 5.4 g |
| MP-1000 manufactured by Soken Chemical & Engineering Co., Ltd. (polymer fine particles, mean particle diameter of 0.4 μm) | 0.91 g |
| Distilled water | 935 mL |
| **Formula (2) (for first layer on the backside)** | |
| Styrene-butadiene copolymer latex (solid content of 40% by weight, styrene/butadiene weight ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| **Formula (3) (for second layer on the backside)** | |
| $SnO_2$/SbO (9/1 by weight ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

<Undercoating>

Both surfaces of the biaxially stretched polyethylene terephthalate support having a thickness of 175 μm were subjected to the corona discharge treatment described above, respectively. Thereafter, the aforementioned formula (1) of the coating solution for the undercoat was coated on one surface (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/$m^2$, and dried at 180° C. for 5 minutes. Furthermore, the aforementioned formula (3) of the coating solution for the undercoat was coated on the reverse side (backside) with a wire bar so that the amount of wet coating became 7.7 mL/$m^2$, and dried at 180° C. for 6 minutes. Thereby, an undercoated support was produced.

(Back Layer)

1) Preparation of Coating Solution for Back Layer

<<Coating Solution 101 for Back Layer>>

A vessel was kept at 40° C., and thereto were added 100 g of gelatin, 400 mg of benzisothiazolinone, 43 mL of a 5% by weight aqueous solution of blue dye-2, 5.7 mL of a 10% by weight aqueous solution of blue dye FRL-SF (trade name, manufactured by Clariant Co.), and 1600 mL of water to allow gelatin to be dissolved. Additionally, 80 mL of a 3% by weight aqueous solution of sodium polystyrenesulfonate, and 200 g of a 10% by weight liquid of isoprene latex (TP-2) were admixed. Just prior to coating, 50 mL of a 4% by weight aqueous solution of N,N-ethylenebis(vinylsulfone acetamide) was admixed. Viscosity of the coating solution was 32 [mPa·s] which was measured with a B type viscometer at 40° C. (No. 1 rotor, 60 rpm). The pH of the coating solution was 6.4 at 40° C.

<<Coating Solution 102 to 113 for Back Layer>>

Preparation of coating solution 102 to 113 for the back layer was conducted in a similar manner to the process in the preparation of the coating solution 101 for the back layer except that the ammonium salt described in Table 4 was added.

2) Preparation of Coating Solution for Back Surface Protective Layer

A vessel was kept at 40° C., and thereto were added 100 g of gelatin, 5.7 g of monodispersed poly(methyl methacrylate) fine particles (mean particle size of 8 μm, standard deviation of particle diameter of 0.4), 600 mg of benzisothiazolinone, and 1700 mL of water to allow gelatin to be dissolved. Additionally, liquid paraffin emulsion at 36 g equivalent to liquid paraffin, 24 mL of a 5% by weight aqueous solution of di(2-ethylhexyl) sodium sulfosuccinate, 50 mL of a 3% by weight aqueous solution of sodium polystyrenesulfonate, 12 mL of a 1% by weight solution of fluorocarbon surfactant (F-1), 2.4 mL of a 2% by weight solution of fluorocarbon surfactant (F-2), and 72 g of a 20% by weight liquid of ethyl acrylate/acrylic acid copolymer (weight ratio of the copolymerization of 96.4/3.6) latex were admixed. Just prior to coating, 90 mL of a 4% by weight aqueous solution of N,N-ethylenebis(vinylsulfone acetamide) was admixed to give a coating solution for the back surface protective layer. Viscosity of the coating solution was 28 [mPa·s] which was measured with a B type viscometer at 40° C. (No. 1 rotor, 60 rpm). The pH of the coating solution was 6.1 at 40° C.

3) Coating of Back Layer

The backside of the undercoated support described above was subjected to simultaneous double coating so that the coating solution for the back layer gave the coating amount of gelatin of 1.7 g/m$^2$, and so that the coating solution for the back surface protective layer gave the coating amount of gelatin of 0.52 g/m$^2$, followed by drying to produce a back layer.

(Image Forming Layer, Intermediate Layer, and Surface Protective Layer)

1. Preparation of Coating Materials

1) Silver Halide Emulsion

<<Preparation of Silver Halide Emulsion 1>>

A liquid was prepared by adding 3.1 mL of a 1% by weight solution of potassium bromide, and then 3.5 mL of 0.5 mol/L sulfuric acid and 31.7 g of phthalated gelatin to 1421 mL of distilled water. The liquid was kept at 30° C. while stirring in a stainless-steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, solution C prepared through diluting 51.86 g of silver nitrate by adding distilled water to give the volume of 317.5 mL, and solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (111) was added in its entirely to give $1\times10^{-4}$ mol per 1 mol of silver, at 10 minutes post initiation of the addition of the solution C and the solution D. Moreover, at 5 seconds after completing the addition of the solution C, an aqueous solution of potassium hexacyanoferrate (11) was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazolin-3-one, followed by elevating the temperature to 47° C. at 40 minutes thereafter. At 20 minutes after elevating the temperature, sodium benzenethiosulfonate in a methanol solution was added at $7.6\times10^{-5}$ mol per 1 mol of silver. At additional 5 minutes later, tellurium sensitizer C in a methanol solution was added at $2.0\times10^{-4}$ mol per 1 mol of silver and the mixture was subjected to ripening for 91 minutes. Thereafter, a methanol solution of spectral sensitizing dye A and spectral sensitizing dye B with a molar ratio of 3:1 was added thereto at $0.8\times10^{-3}$ mol in total of the spectral sensitizing dyes A and B per 1 mol of silver. At one minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce silver halide emulsion 1.

Grains in thus prepared silver halide emulsion were silver iodobromide grains having a mean equivalent spherical diameter of 0.037 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide emulsion 2 was conducted in a similar manner to the process in the preparation of the silver halide emulsion 1 except that: the temperature of the liquid upon the grain formation was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; the time period for adding the solution C was changed to 30 minutes; and potassium hexacyanoferrate (11) was deleted. Further, precipitation/desalting/water washing/dispersion were carried out similar to the silver halide emulsion 1. Furthermore, spectral sensitization, chemical sensitization, and addition of 5-methyl-2-mercaptobenzimidazole and 1-phenyl-2-heptyl-5-mercapto-1,3,4-triazole were executed similar to those in the preparation of the silver halide emulsion 1 except that: the amount of the tellurium sensitizer C to be added was changed to $1.1\times10^{-4}$ mol per 1 mol of silver; the amount of the methanol solution of spectral sensitizing dye A and spectral sensitizing dye B with a molar ratio of 3:1 to be added was changed to $7.0\times10^{-4}$ mol in total of the spectral sensitizing dyes A and B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver. Thereby, silver halide emulsion 2 was obtained. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide emulsion 3 was conducted in a similar manner to the process in the preparation of the silver halide emulsion 1 except that the temperature of the liquid upon the grain formation was altered from 30° C. to 27° C. Further, precipitation/desalting/water washing/dispersion were carried out similar to the silver halide emulsion 1. Silver halide emulsion 3 was obtained similar to the silver halide emulsion 1 except that: the spectral sensitizing dye A and the spectral sensitizing dye B were added as a solid dispersion (aqueous gelatin solution) at a molar ratio of 1:1 with the amount to be added being $6\times10^{-3}$ mol in total of the spectral sensitizing dyes A and B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

Further, as "a compound that is one-electron-oxidized to provide a one-electron oxidation product which releases one or more electrons", the compounds Nos. 1, 20, and 26 were added respectively in an amount of $2\times10^{-3}$ mol per 1 mol of silver in silver halide.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the result of the content of behenic acid being 96 mol %. In addition, lignoceric acid, arachidic acid, and erucic acid were included at 2 mol %, 2 mol %, and 0.001 mol %, respectively.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give solution B of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution B of sodium behenate and the total amount of the aqueous solution of silver nitrate with sufficient stirring at a constant flow rate over 93 minutes and 15 seconds, and 90 minutes, respectively. In this process, during first 11 minutes following the initiation of adding the aqueous solution of silver nitrate, the added material was restricted to the aqueous solution of silver nitrate alone. The addition of the solution B of sodium behenate was thereafter started, and during 14 minutes and 15 seconds following the completion of adding the aqueous solution of silver nitrate, the added material was restricted to the solution B of sodium behenate alone. The temperature inside of the reaction vessel was then set to be 30° C., and the temperature outside was controlled so that the temperature of the liquid could be kept constant. In addition, the temperature of a pipeline for the addition system of the solution B of sodium behenate was kept constant by circulation of warm water outside of a double wall pipe, so that the temperature of the liquid at an outlet in the leading edge of the nozzle for addition was adjusted to be 75° C.

Further, the temperature of a pipeline for the addition system of the aqueous solution of silver nitrate was kept constant by circulation of cool water outside of a double wall pipe. Position at which the solution B of sodium behenate was added and the position at which the aqueous solution of silver nitrate was added were arranged symmetrically with a shaft for stirring located at a center. Moreover, both of the positions were adjusted to avoid contact with the reaction liquid.

After completing the addition of the solution B of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of silver behenate was evaluated by electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b, and c are as defined aforementioned).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling operation, coiled heat exchangers were equipped in front of and behind the interaction chamber respectively, and accordingly, the temperature for the dispersion was set to be 18° C. by regulating the temperature of the cooling medium.

3) Preparation of Reducing Agent Dispersion

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm-pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of benzisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less.

The resulting reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resulting hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resulting development accelerator dispersion was subjected to filtration with a polypropylene filter having a pore size of 3.0 μm to remove foreign substances such as dust, and stored.

6) Preparation of Development Accelerator-2 Dispersion and Color-tone-adjusting Agent-1 Dispersion Also concerning solid dispersions of development accelerator-2 and color-tone-adjusting agent-1, dispersion was executed similar to that in the development accelerator-1, and thereby dispersions of 20% by weight and 15% by weight were respectively obtained.

7) Preparation of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP-203), 0.4 kg of a 20% by weight aqueous solution of sodium triisopropylnaphthalenesulfonate, and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resulting organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP-203), and 0.4 kg of a 20% by weight aqueous solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of benzisothiazolinone sodium salt and water were added thereto, thereby adjusting the concentration of the organic polyhalogen compound to be 30% by weight. This dispersion was warmed at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resulting organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparation of Aqueous Solution of Mercapto Compound

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of Solid Dispersion of Azomethine Dye

To 1.0 kg of azomethine dye-A and 3.0 kg of a 10% by weight aqueous solution of modified poly(vinyl alcohol) (manufactured by Kuraray Co., Ltd., Poval MP-203) were added 42 g of a 48% by weight aqueous solution of a surfactant (trade name: PIONIN A-43-S, manufactured by Takemoto Oil & Fat Co., Ltd.) and 3.0 g of an antifoaming agent (trade name: SURFYNOL 104E, manufactured by Nissin Chemical Industry Co., Ltd.), and the mixture was thoroughly mixed to give slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 1.0 g of benzisothiazolinone sodium salt and water were added thereto, thereby adjusting the concentration of the water-insoluble azomethine dye to be 10% by weight. This dispersion was warmed at 40° C. for 2 hours to obtain a solid dispersion of azomethine dye. Particles of the azomethine dye included in the resulting azomethine dye dispersion had a median diameter of 0.49 μm, and a maximum particle diameter of 2.6 μm or less. The resulting azomethine dye dispersion was subjected to filtration with a polypropylene filter having a pore size of 3.0 μm to remove foreign substances such as dust, and stored.

11) Preparation of Dispersion of Silver Salt of Benzotriazole 1 kg of benzotriazole was added to a liquid prepared by dissolving 360 g of sodium hydroxide in 9100 mL of water, and then the mixture was stirred for 60 minutes. Thereby, solution BT of sodium salt of benzotriazole was prepared.

A liquid prepared by dissolving 55.9 g of alkali-processed de-ionized gelatin in 1400 mL of distilled water was kept at 70° C. while stirring in a stainless-steel reaction vessel. And then, solution A prepared through diluting 54.0 g of silver nitrate by adding distilled water to give the volume of 400 mL, and solution B prepared through diluting 397 mL of the solution BT of sodium salt of benzotriazole with distilled water to give the volume of 420 mL were added. A method of double jet was executed through adding 220 mL of the solution B at a constant flow rate of 20 mL/min over 11 minutes to the stainless-steel reaction vessel, and at one minute post initiation of the addition of the solution B, 200 mL of the solution A was added thereto at a constant flow rate of 20 mL/min over 10 minutes. Moreover, at 6 minutes later after completing the addition, the solution A and the solution B were added simultaneously at a constant flow rate of 33.34 mL/min over 6 minutes in an amount of 200 mL respectively. The mixture was cooled to 45° C., and 92 mL of Demol N (10% by weight aqueous solution, manufactured by Kao Corporation) was added to the mixture while stirring. The mixture was adjusted to the pH of 4.1 with 1 mol/L sulfuric acid. After stopping stirring, the mixture was subjected to precipitation/desalting/water washing steps.

Thereafter, the resulting mixture was warmed to 50° C. and 51 mL of 1 mol/L sodium hydroxide was added thereto while stirring, and then 11 mL of a methanol solution (3.5%) of benzisothiazolinone and 7.7 mL of a methanol solution (1%) of sodium benzenethiosulfonate were added thereto. After stirring the mixture for a period of 80 minutes, the mixture was adjusted to the pH of 7.8 with 1 mol/L sulfuric acid. Thereby, dispersion of silver salt of benzotriazole was prepared.

Particles of the prepared dispersion of silver salt of benzotriazole had a mean equivalent circular diameter of 0.172 μm (a variation coefficient of an equivalent circular diameter distribution of 18.5%), a mean length of long sides of 0.32 μm, a mean length of short sides of 0.09 μm, and a mean ratio of the length of short sides to the length of long sides of 0.298. Particle size and the like were determined from the average of 300 particles using an electron microscope.

12) Preparation of SBR Latex Liquid

SBR latex (TP-1) was prepared as follows.

Into a polymerization vessel of a gas monomer reaction apparatus (manufactured by Taiatsu Techno Corporation, TAS-2J type) were poured 287 g of distilled water, 7.73 g of a surfactant (PIONIN A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution obtained by dissolving 1.875 g of ammonium persulfate in 50 mL of water, and the mixture was stirred for 5 hours as it stands. Further, the mixture was heated to 90° C., followed by stirring for 3 hours. After completing the reaction, the inner temperature of the vessel was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 3.0 μm was conducted to remove foreign substances such as dust and stored. Accordingly, SBR latex TP-1 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid content of 44% by weight, an equilibrium moisture content at 25° C. and 60% RH of 0.6% by weight, and an ionic conductivity of 4.80 mS/cm (measurement of the ionic conductivity was performed using a conductometer CM-30S manufactured by To a Electronics Ltd. for the latex stock solution (44% by weight) at 25° C.).

13) Preparation of Isoprene Latex Liquid

Isoprene latex (TP-2) was prepared as follows.

1500 g of distilled water was poured into the polymerization vessel of a gas monomer reaction apparatus (TAS-2J type, manufactured by Taiatsu Techno Corporation), and the vessel was heated for 3 hours at 90° C. to make passive film over the stainless-steel vessel surface and stainless-steel stirring device. Thereafter, 582.28 g of distilled water deaerated by nitrogen gas for one hour, 9.49 g of a surfactant (PIONIN A-43-S (manufactured by Takemoto Oil & Fat Co., Ltd.)), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercaptan were added into the pretreated reaction vessel. And then, the reaction vessel was sealed and the mixture was stirred at a stirring rate of 225 rpm, followed by elevating the inner temperature to 65° C. A solution obtained by dissolving 2.61 g of ammonium persulfate in 40 mL of water was added thereto and the mixture was kept for 6 hours with stirring. At this point, the polymerization ratio was 90% according to the solid content measurement. Thereto, a solution obtained by dissolving 5.22 g of acrylic acid in 46.98 g of water was added, and then 10 g of water was added, and further a solution obtained by dissolving 1.30 g of ammonium persulfate in 50.7 mL of water was added. After the addition, the mixture was heated to 90° C. and stirred for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, the resulting mixture was filtered with a polypropylene filter having a pore size of 3.0 μm to remove foreign substances such as dust, and stored. Thereby, 1248 g of isoprene latex TP-2 was obtained. Upon the measurement of halogen ion by ion chromatography, concentration of chloride ion was revealed to be 3 ppm. As a result of the measurement of the concentration of the chelating agent by high performance liquid chromatography, it was revealed to be 142 ppm.

The obtained latex had a mean particle diameter of 113 nm, Tg of 15° C., a solid content of 41.3% by weight, an equilibrium moisture content at 25° C. and 60RH % of 0.4% by weight, and an ionic conductivity of 5.23 mS/cm (measurement of the ionic conductivity was performed using a conductometer CM-30S manufactured by To a Electronics Ltd. at 25° C.).

2. Preparation of Coating Solutions

1) Preparation of Coating Solution A for Image Forming Layer

To the dispersion of silver salt of a fatty acid in an amount of 1000 g were serially added 135 mL of water, 6 mL of a 5% by weight aqueous solution of blue dye-2, 4 g of the solid dispersion of azomethine dye, 25 g of the organic polyhalogen compound-1 dispersion, 47 g of the organic polyhalogen compound-2 dispersion, 177 g of the phthalazine compound-1 solution, 318 g of the SBR latex liquid (TP-1), 742 g of the isoprene latex liquid (TP-2), 153 g of the reducing agent-2 dispersion, 22 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution. By adding, just prior to coating, 140 g of the mixed emulsion A for a coating solution thereto and mixing sufficiently, coating solution A for the image forming layer was prepared, and allowed to be transported to a coating die and coated.

2) Preparation of Coating Solution B for Image Forming Layer

To the dispersion of silver salt of a fatty acid in an amount of 1000 g were serially added 207 mL of water, 25 mL of a 5% by weight aqueous solution of blue dye-2, 4.7 g of the solid dispersion of azomethine dye, 28 g of the organic polyhalogen compound-1 dispersion, 47 g of the organic polyhalogen compound-2 dispersion, 177 g of the phthalazine compound-1 solution, 340 g of the SBR latex liquid (TP-1), 780 g of the isoprene latex liquid (TP-2), 155 g of the reducing agent-2 dispersion, 22 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution. By adding, just prior to coating, 140 g of the mixed emulsion A for a coating solution thereto and mixing sufficiently, coating solution B for the image forming layer was prepared, and allowed to be transported to a coating die and coated.

3) Preparation of Coating Solution A for Intermediate Layer

To 1000 g of poly(vinyl alcohol) PVA-205 (manufactured by Kuraray Co., Ltd.), 27 mL of a 5% by weight aqueous solution of di(2-ethylhexyl) sodium sulfosuccinate, 4200 mL of a 19% by weight liquid of methyl methacrylate/styrene/butyl acrylate/hydroxyethyl methacrylate/acrylic acid copolymer (weight ratio of the copolymerization of 57/8/28/5/2) latex, 53.2 g of NEOPELEX G-15 (trade name, manufactured by Kao Corporation), 8.0 g of EMALEX 125 (trade name, manufactured by Nihon Emulsion Co., Ltd.), 27 mL of a 5% by weight aqueous solution of aerosol OT (manufactured by American Cyanamid Co.), 115 mL of a 10% by weight aqueous solution of blue dye FRL-SF (trade name, manufactured by Clariant Co.), and 135 mL of a 20% by weight aqueous solution of diammonium phthalate was added water to give the total amount of 10000 g. The mixture was adjusted to the pH of 7.0 with sodium hydroxide. Thereby, coating solution A for the intermediate layer was prepared and was fed to a coating die to provide 8.9 mL/$m^2$.

Viscosity of the coating solution was 58 [mPa·s] which was measured with a B type viscometer at 40° C. (No. 1 rotor, 60 rpm).

4) Preparation of Coating Solution B for Intermediate Layer

To 1000 g of poly(vinyl alcohol) PVA-205 (manufactured by Kuraray Co., Ltd.), 27 mL of a 5% by weight aqueous solution of di(2-ethylhexyl) sodium sulfosuccinate, 9800 mL of a 19% by weight liquid of methyl methacrylate/styrene/butyl acrylate/hydroxyethyl methacrylate/acrylic acid copolymer (weight ratio of the copolymerization of 57/8/28/5/2) latex, 124 g of NEOPELEX G-15 (trade name, manufactured by Kao Corporation), 18.7 g of EMALEX 125 (trade name, manufactured by Nihon Emulsion Co., Ltd.), 27 mL of a 5% by weight aqueous solution of aerosol OT (manufactured by American Cyanamid Co.), 58 mL of a 10% by weight aqueous solution of blue dye FRL-SF (trade name, manufactured by Clariant Co.), and 135 mL of a 20% by weight aqueous solution of diammonium phthalate was added water to give the total amount of 15700 g. The mixture was adjusted to the pH of 7.0 with sodium hydroxide. Thereby, coating solution B for the intermediate layer was prepared and was fed to a coating die to provide 7.1 mL/$m^2$.

Viscosity of the coating solution was 58 [mPa·s] which was measured with a B type viscometer at 40° C. (No. 1 rotor, 60 rpm).

5) Preparation of Coating Solution A for First Layer of Surface Protective Layers In 830 mL of water were dissolved 100 g of inert gelatin and 100 mg of benzisothiazolinone, and thereto were added 180 g of a 19% by weight liquid of methyl methacrylate/styrene/butyl acrylate/hydroxyethyl methacrylate/acrylic acid copolymer (weight ratio of the copolymerization of 57/8/28/5/2) latex, 2.3 g of NEOPELEX G-15 (trade name, manufactured by Kao Corporation), 0.3 g of EMALEX 125 (trade name, manufactured by Nihon Emulsion Co., Ltd.), 53 mL of a 15% by weight methanol solution of phthalic acid, and 5.4 mL of a 5% by weight aqueous solution of di(2-ethylhexyl) sodium sulfosuccinate, and were mixed. By adding, just prior to coating, 40 mL of a 4% by weight chrome alum thereto and mixing with a static mixer, coating solution A for the first layer of the surface protective layers was prepared, and was fed to a coating die so that the amount of the coating solution became 25 mL/$m^2$.

Viscosity of the coating solution was 20 [mPa·s] which was measured with a B type viscometer at 40° C. (No. 1 rotor, 60 rpm).

6) Preparation of Coating Solution B for First Layer of Surface Protective Layers In 800 mL of water were dissolved 100 g of inert gelatin and 100 mg of benzisothiazolinone, and thereto were added 160 g of the dispersion of silver salt of benzotriazole, 200 g of a 19% by weight liquid of methyl methacrylate/styrene/butyl acrylate/hydroxyethyl methacrylate/acrylic acid copolymer (weight ratio of the copolymerization of 57/8/28/5/2) latex, 2.6 g of NEOPELEX G-15 (trade name, manufactured by Kao Corporation), 0.3 g of EMALEX 125 (trade name, manufactured by Nihon Emulsion Co., Ltd.), 67 mL of a 15% by weight methanol solution of phthalic acid, and 6.2 mL of a 5% by weight aqueous solution of di(2-ethylhexyl)sodium sulfosuccinate, and were mixed. By adding, just prior to coating, 36 mL of a 4% by weight chrome alum thereto and mixing with a static mixer, coating solution B for the first layer of the surface protective layers was prepared, and was fed to a coating die so that the amount of the coating solution became 27 mL/$m^2$.

Viscosity of the coating solution was 20 [mPa·s] which was measured with a B type viscometer at 40° C. (No. 1 rotor, 60 rpm).

7) Preparation of Coating Solution A for Second Layer of Surface Protective Layers In 800 mL of water were dissolved 100 g of inert gelatin and 100 mg of benzisothiazolinone, and thereto were added 40 mL of a 15% by weight methanol solution of phthalic acid, 13 mL of a 1% by weight solution of fluorocarbon surfactant (F-1), 23 mL of a 1% by weight aqueous solution of fluorocarbon surfactant (F-2), 23 mL of a 10% by weight aqueous solution of surfactant (F-3), 28 mL of a 5% by weight aqueous solution of di(2-ethylhexyl)sodium sulfosuccinate, 16 g of poly(methyl methacrylate) fine particles (mean particle diameter of 4.5 μm), 1.6 g of other poly(methyl methacrylate) fine particles (mean particle diameter of 8.0 μm), 18 g of a 30% by weight aqueous solution of carnauba wax (Selosol 524D, trade name, manufactured by Chukyou Yushi Co., Ltd.), 180 g of a 19% by weight liquid of methyl methacrylate/styrene/butyl acrylate/hydroxyethyl methacrylate/acrylic acid copolymer (weight ratio of the copolymerization of 57/8/28/5/2) latex, 2.3 g of NEOPELEX G-15 (trade name, manufactured by Kao Corporation), 0.3 g of EMALEX 125 (trade name, manufactured by Nihon Emulsion Co., Ltd.), and the obtained mixture was mixed to give coating solution A for the second layer of the surface protective layers, which was fed to a coating die to provide 8.3 mL/m$^2$.

Viscosity of the coating solution was 19 [mPa·s] which was measured with a B type viscometer at 40° C. (No. 1 rotor, 60 rpm).

8) Preparation of Coating Solution B for Second Layer of Surface Protective Layers In 660 mL of water were dissolved 100 g of inert gelatin and 100 mg of benzisothiazolinone, and thereto were added 40 mL of a 15% by weight methanol solution of phthalic acid, 25 mL of a 1% by weight solution of fluorocarbon surfactant (F-1), 23 mL of a 1% by weight aqueous solution of fluorocarbon surfactant (F-2), 50 mL of a 10% by weight aqueous solution of surfactant (F-3), 57 mL of a 5% by weight aqueous solution of di(2-ethylhexyl) sodium sulfosuccinate, 33 g of poly(methyl methacrylate) fine particles (mean particle diameter of 4.5 μm), 3.3 g of other poly(methyl methacrylate) fine particles (mean particle diameter of 8.0 μm), 37 g of a 30% by weight aqueous solution of carnauba wax (Selosol 524D, trade name, manufactured by Chukyou Yushi Co., Ltd.), 180 g of a 19% by weight liquid of methyl methacrylate/styrene/butyl acrylate/hydroxyethyl methacrylate/acrylic acid copolymer (weight ratio of the copolymerization of 57/8/28/5/2) latex, 2.3 g of NEOPELEX G-15 (trade name, manufactured by Kao Corporation), 0.3 g of EMALEX 125 (trade name, manufactured by Nihon Emulsion Co., Ltd.), and the obtained mixture was mixed to give coating solution B for the second layer of the surface protective layers, which was fed to a coating die to provide 3.7 mL/m$^2$.

Viscosity of the coating solution was 19 [mPa·s] which was measured with a B type viscometer at 40° C. (No. 1 rotor, 60 rpm).

3. Preparation of Photothermographic Material 101 to 113

Reverse surface to the backside was subjected to simultaneous multilayer coating by a slide bead coating method in order of the image forming layer A, intermediate layer A, first layer A of the surface protective layers, and second layer A of the surface protective layers, starting from the undercoated face, and thereby samples of photothermographic material were produced. In the process, the temperature of the coating solution was adjusted to 31° C. for the image forming layer and intermediate layer, to 36° C. for the first layer of the surface protective layers, and to 37° C. for the second layer of the surface protective layers.

The coating amount of each compound (g/m$^2$) for the image forming layer is as follows.

| | |
|---|---|
| Silver salt of a fatty acid | 5.35 |
| Blue dye-2 | 0.006 |
| Azomethine dye-A | 0.009 |
| Organic polyhalogen compound-1 | 0.14 |
| Organic polyhalogen compound-2 | 0.28 |
| Phthalazine compound-1 | 0.18 |
| SBR latex (TP-1) | 2.74 |
| Isoprene latex (TP-2) | 6.19 |
| Reducing agent-2 | 0.77 |
| Hydrogen bonding compound-1 | 0.112 |
| Development accelerator-1 | 0.019 |
| Development accelerator-2 | 0.011 |
| Color-tone-adjusting agent-1 | 0.006 |
| Mercapto compound-2 | 0.003 |
| Silver halide (on the basis of Ag content) | 0.13 |

Conditions for coating and drying were as follows.

Coating was performed at a speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind before coating. In the subsequent cooling zone, the coating solution was cooled by air having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus. After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 350 seconds on the image forming layer side, and 110 seconds on the backside as a Beck's smoothness. In addition, measurement of the film surface pH at the image forming layer side gave the result of 5.4.

TABLE 4

| | | Ammonia | Photographic Properties | | | After Compulsory Storage | | | |
|---|---|---|---|---|---|---|---|---|---|
| Sample No. | Ammonium Salt | Content (mg/m$^2$) | Fog | Sensitivity | Image Tone | Fog | Sensitivity | Image Tone | Note |
| 101 | — | 0.3 | 0.18 | 100 | 4 | 0.19 | 110 | 1 | Comparative |
| 102 | Ammonium sulfate | 0.5 | 0.18 | 100 | 4 | 0.19 | 109 | 2 | Comparative |
| 103 | Ammonium sulfate | 5.0 | 0.18 | 100 | 5 | 0.19 | 107 | 3 | Invention |
| 104 | Ammonium sulfate | 15.0 | 0.18 | 100 | 5 | 0.19 | 107 | 4 | Invention |
| 105 | Ammonium sulfate | 30.0 | 0.18 | 100 | 5 | 0.20 | 107 | 4 | Invention |
| 106 | Ammonium sulfate | 70.0 | 0.18 | 98 | 5 | 0.20 | 105 | 3 | Invention |
| 107 | Ammonium sulfate | 150.0 | 0.18 | 95 | 5 | 0.24 | 100 | 2 | Comparative |

TABLE 4-continued

| Sample No. | Ammonium Salt | Ammonia Content ($mg/m^2$) | Photographic Properties Fog | Sensitivity | Image Tone | After Compulsory Storage Fog | Sensitivity | Image Tone | Note |
|---|---|---|---|---|---|---|---|---|---|
| 108 | Ammonium phthalate | 0.5 | 0.18 | 100 | 4 | 0.18 | 109 | 1 | Comparative |
| 109 | Ammonium phthalate | 5.0 | 0.18 | 100 | 5 | 0.18 | 106 | 4 | Invention |
| 110 | Ammonium phthalate | 15.0 | 0.18 | 100 | 5 | 0.18 | 106 | 5 | Invention |
| 111 | Ammonium phthalate | 30.0 | 0.18 | 100 | 5 | 0.19 | 106 | 5 | Invention |
| 112 | Ammonium phthalate | 70.0 | 0.18 | 98 | 5 | 0.19 | 102 | 4 | Invention |
| 113 | Ammonium phthalate | 150.0 | 0.18 | 95 | 5 | 0.22 | 96 | 3 | Comparative |

Chemical structures of the compounds used in Examples of the invention are shown below.

Blue dye-2

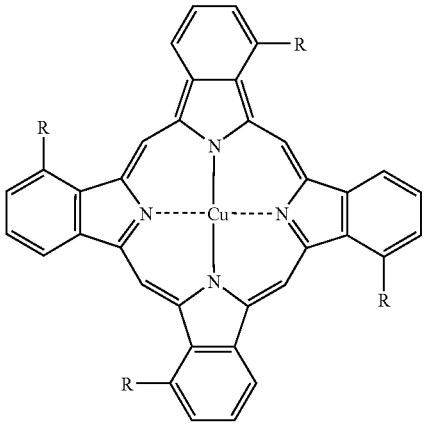

R = $SO_2CH_2CH_2CH_2SO_3Na$

Azomethine dye-A

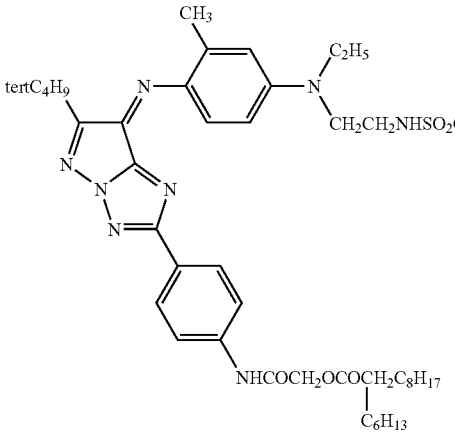

Tellurium sensitizer C

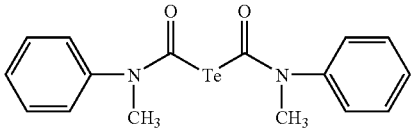

-continued

Spectral sensitizing dye A

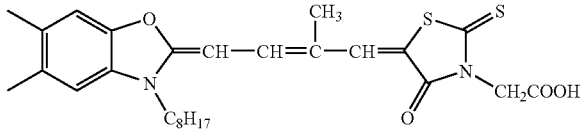

Spectral sensitizing dye B

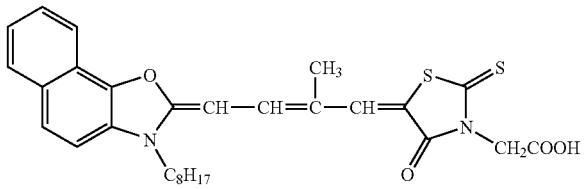

Compound 1 that is one-electron-oxidized to provide a one-electron oxidation product which releases one or more electrons

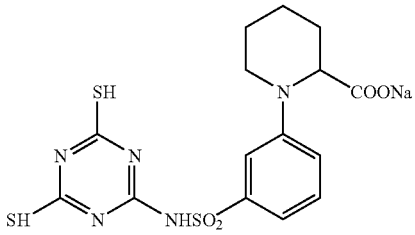

Compound 20 that is one-electron-oxidized to provide a one-electron oxidation product which releases one or more electrons

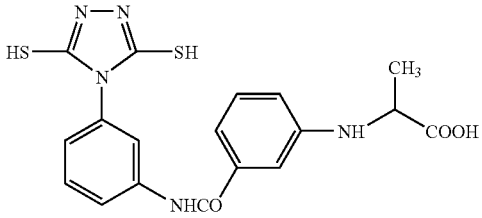

Compound 26 that is one-electron-oxidized to provide a one-electron oxidation product which releases one or more electrons

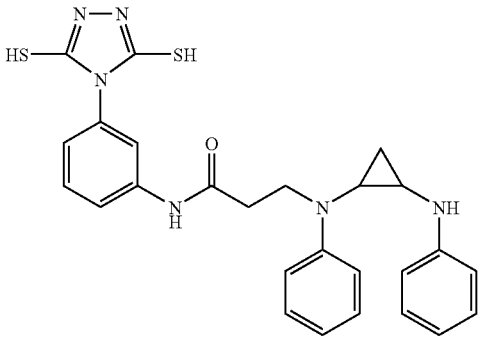

Reducing agent-2

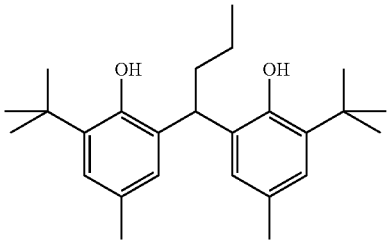

Hydrogen bonding compound-1

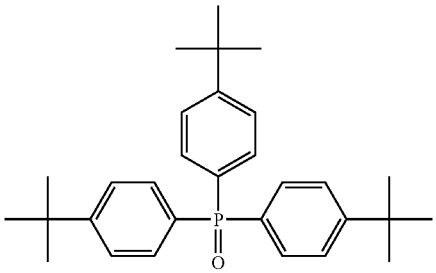

Organic polyhalogen compound-1

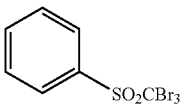

Organic polyhalogen compound-2

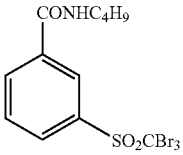

Mercapto compound-2

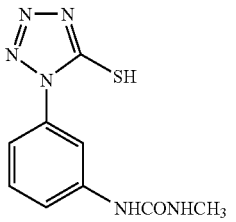

Phthalazine compound-1

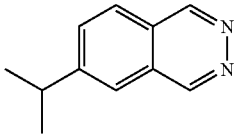

-continued

Development accelerator-1

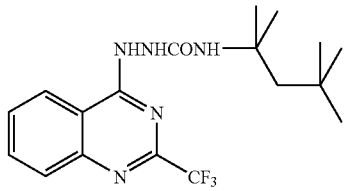

Development accelerator-2

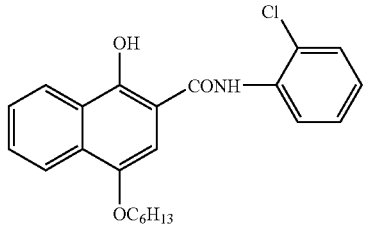

Color-tone-adjusting agent-1

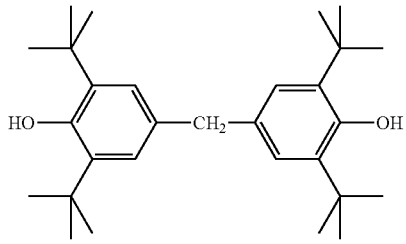

(F-1)

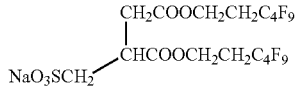

(F-2)

Mixture of 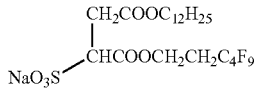 and 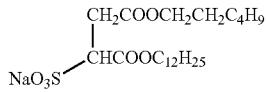

(F-3)

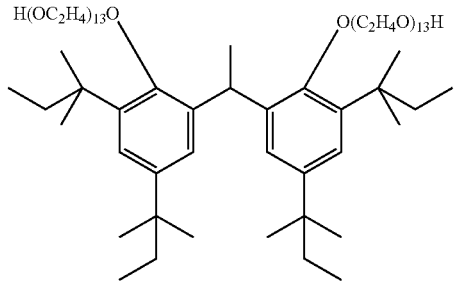

4. Evaluation of Photographic Performance

<Preparation>

The obtained sample was cut into a half-cut size and was wrapped with the following packaging material under an environment of 25° C. and 50% RH, and stored for 2 weeks at an ambient temperature. Thereafter, the evaluation described below was performed.

<Packaging Material>

A film laminated with PET 10 μm/PE 12 μm/aluminum foil 9 μm/Ny 15 μm/polyethylene 50 μm containing carbon at 2% by weight:

oxygen permeability at 25° C.: 0.02 mL·atm$^{-1}$m$^{-2}$day$^{-1}$;

vapor permeability at 25° C.: 0.10 g·atm$^{-1}$m$^{-2}$day$^{-1}$.

<Exposure and Development of Photothermographic Material>

To each sample, imagewise exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation of the obtained image was performed with a densitometer.

4-1. Evaluation Terms

1) Measurement of Ammonia Content

The prepared photothermographic material was cut into a size of 35 mm×10 mm, and the film on the image forming layer side was peeled off by a suitable solvent. As an extracting solution, a solution obtained by diluting 1 g of acetic acid (90%) with 148 mL of water was prepared. The sample was soaked in the extracting solution for 2 hours to extract the ammonia contained therein. Thereafter, the amount of ammonia in the resulting solution after the extraction was determined using ion chromatography.

2) Photographic Properties

The photothermographic material prepared above was subjected to exposure while changing the exposure value of a laser beam step by step. The density of the image obtained after development was measured by a Macbeth densitometer. A photographic characteristic curve was prepared by plotting the density against the exposure value.

<Fog>

Fog is expressed in terms of a density of an unexposed portion.

<Sensitivity>

Sensitivity is the inverse of the exposure value giving a density of fog+1.0. The sensitivities of samples are shown as relative values, with the sensitivity of sample No. 101 designated as 100.

<Image Tone>

With regard to the highlight portion of the obtained image, image tone was subjected to sensory evaluation by five persons. Relatively favorable evaluation was designated as 10 points, the points were averaged, and the averaged point color tone evaluation was classified into five levels as follows: [5] is an excellent level; [1] is the most inferior level; and [3] is a level inferior to [5] but not problematic for practical use. The evaluation results are shown in Table 4.

3) Evaluation of Storage Stability

As a compulsory storage condition, each sample was stored under an environment of 50° C. and 40% RH for 3 days while keeping the sample in the packaging mentioned above. Thereafter, the sample was taken out from the packaging and subjected to evaluation with respect to photographic properties.

4-2. Evaluation Results

The obtained results are shown in Table 4.

The samples of the present invention provide favorable results such as low fog, little change in sensitivity, and little change in image tone after storage under the compulsory condition.

In contrast, comparative sample Nos. 101, 102, and 108 provide unfavorable results such as great change in image tone, and comparative sample Nos. 107 and 113 provide unfavorable results such as low sensitivity and great change in fog after storage under the compulsory condition.

Example 5

1. Preparation of Photothermographic Material 121 to 133

<Coating of Back Layer>

Using the coating solution 101 to 113 for the back layer similar to Example 4, the backside of the undercoated support was subjected to simultaneous double coating so that the coating solution for the back layer gave the coating amount of gelatin of 1.8 g/m$^2$, and so that the coating solution for the back surface protective layer gave the coating amount of gelatin of 0.52 g/m$^2$, followed by drying to produce a back layer.

Photothermographic material 121 to 133 was prepared similar to Example 4, except that reverse surface to the backside was subjected to simultaneous multilayer coating by a slide bead coating method in order of the image forming layer B, intermediate layer B, first layer B of the surface protective layers, and second layer B of the surface protective layers, starting from the undercoated face. The coating amount of each compound (g/m$^2$) for the image forming layer is as follows.

| | |
|---|---|
| Silver salt of a fatty acid | 6.04 |
| Blue dye-2 | 0.028 |
| Azomethine dye-A | 0.011 |
| Organic polyhalogen compound-1 | 0.16 |
| Organic polyhalogen compound-2 | 0.32 |
| Phthalazine compound-1 | 0.20 |
| SBR latex (TP-1) | 3.22 |
| Isoprene latex (TP-2) | 7.38 |
| Reducing agent-2 | 0.87 |
| Hydrogen bonding compound-1 | 0.112 |
| Development accelerator-1 | 0.022 |
| Development accelerator-2 | 0.016 |
| Color-tone-adjusting agent-1 | 0.007 |
| Mercapto compound-2 | 0.007 |
| Silver halide (on the basis of Ag content) | 0.13 |

The obtained results are shown in Table 5. It was found that results similar to Example 4 were obtained.

That means the samples of the present invention provide favorable results such as low fog, little change in sensitivity, and little change in image tone after storage under the compulsory condition.

In contrast, comparative sample Nos. 121, 122, and 128 provide unfavorable results such as great change in image tone, and comparative sample Nos. 127 and 133 provide unfavorable results such as low sensitivity and great change in fog after storage under the compulsory condition.

TABLE 5

| | | Ammonia | Photographic Properties | | | After Compulsory Storage | | | |
|---|---|---|---|---|---|---|---|---|---|
| Sample No. | Ammonium Salt | Content (mg/m$^2$) | Fog | Sensitivity | Image Tone | Fog | Sensitivity | Image Tone | Note |
| 121 | — | 0.3 | 0.2 | 100 | 4 | 0.21 | 110 | 1 | Comparative |
| 122 | Ammonium sulfate | 0.5 | 0.2 | 100 | 4 | 0.21 | 109 | 2 | Comparative |

TABLE 5-continued

| Sample No. | Ammonium Salt | Ammonia Content ($mg/m^2$) | Photographic Properties Fog | Sensitivity | Image Tone | After Compulsory Storage Fog | Sensitivity | Image Tone | Note |
|---|---|---|---|---|---|---|---|---|---|
| 123 | Ammonium sulfate | 5.0 | 0.2 | 100 | 5 | 0.21 | 107 | 3 | Invention |
| 124 | Ammonium sulfate | 15.0 | 0.2 | 100 | 5 | 0.21 | 107 | 4 | Invention |
| 125 | Ammonium sulfate | 30.0 | 0.2 | 100 | 5 | 0.22 | 107 | 4 | Invention |
| 126 | Ammonium sulfate | 70.0 | 0.2 | 98 | 5 | 0.22 | 105 | 3 | Invention |
| 127 | Ammonium sulfate | 150.0 | 0.2 | 95 | 5 | 0.26 | 100 | 2 | Comparative |
| 128 | Ammonium phthalate | 0.5 | 0.2 | 100 | 4 | 0.20 | 109 | 1 | Comparative |
| 129 | Ammonium phthalate | 5.0 | 0.2 | 100 | 5 | 0.20 | 106 | 4 | Invention |
| 130 | Ammonium phthalate | 15.0 | 0.2 | 100 | 5 | 0.20 | 106 | 5 | Invention |
| 131 | Ammonium phthalate | 30.0 | 0.2 | 100 | 5 | 0.21 | 106 | 5 | Invention |
| 132 | Ammonium phthalate | 70.0 | 0.2 | 98 | 5 | 0.21 | 102 | 4 | Invention |
| 133 | Ammonium phthalate | 150.0 | 0.2 | 95 | 5 | 0.24 | 96 | 3 | Comparative |

Example 6

1. Preparation of Samples

Samples were prepared similar to Example 4, except that the back layer and the back surface protective layer were changed to the following formulae.

(Back Layer)

1) Preparation of Coating Solution for Back Layer (Preparation of Dispersion of Solid Fine Particles (a) of Base Precursor)

2.5 kg of base precursor-1, 300 g of a surfactant (trade name: DEMOL N, manufactured by Kao Corporation), 800 g of diphenyl sulfone, and 1.0 g of benzisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). The process of dispersion includes feeding the mixed liquid to UVM-2 packed with zirconia beads having a mean particle diameter of 0.5 mm with a diaphragm pump, followed by dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The resulting dispersion was diluted with distilled water so that the concentration of the base precursor became 25% by weight, and filtrated (with a polypropylene filter having a mean fine pore diameter of 3 μm) for eliminating dust to put into practical use.

(Preparation of Solid Fine Particle Dispersion of Dye)

Cyanine dye-1 in an amount of 6.0 kg, 3.0 kg of sodium p-dodecylbenzenesulfonate, 0.6 kg of surfactant DEMOL SNB (manufactured by Kao Corporation), and 0.15 kg of an antifoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. The resulting dispersion was diluted with distilled water so that the concentration of the cyanine dye became 6% by weight, and filtrated with a filter (mean fine pore diameter: 1 μm) for eliminating dust to put into practical use.

(Preparation of Coating Solution for Back Layer)

<<Preparation of Coating Solution 141 for Back Layer>>

A vessel was kept at 40° C., and thereto were added 40 g of gelatin, 20 g of monodispersed poly(methyl methacrylate) fine particles (mean particle size of 8.0 μm, standard deviation of particle diameter of 0.4), 0.1 g of benzisothiazolinone, and 490 mL of water to allow gelatin to be dissolved. Additionally, 2.3 mL of 1 mol/L sodium hydroxide aqueous solution, 40 g of the above-mentioned dispersion of the solid fine particles of the dye, 90 g of the above-mentioned dispersion of the solid fine particles (a) of the base precursor, 12 mL of a 3% by weight aqueous solution of sodium polystyrenesulfonate, and 180 g of a 10% by weight liquid of SBR latex were admixed. Just prior to coating, 80 mL of a 4% by weight aqueous solution of N,N-ethylenebis(vinylsulfone acetamide) was admixed to give coating solution 141 for the back layer.

<<Coating Solution 142 to 153 for Back Layer>>

Preparation of coating solution 142 to 153 for the back layer was conducted in a similar manner to the process in the preparation of the coating solution 141 for the back layer, except that the ammonium salt described in Table 6 was added.

2) Preparation of Coating Solution for Back Surface Protective Layer

A vessel was kept at 40° C., and thereto were added 40 g of gelatin, 35 mg of benzisothiazolinone, and 840 mL of water to allow gelatin to be dissolved. Additionally, 5.8 mL of 1 mol/L sodium hydroxide aqueous solution, liquid paraffin emulsion at 1.5 g equivalent to liquid paraffin, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of fluorocarbon surfactant (F-1), 2.4 mL of a 2% by weight solution of fluorocarbon surfactant (F-2), and 32 g of a 19% by weight liquid of acryl latex A (methyl methacrylate/styrene/butyl acrylate/hydroxyethyl methacrylate/acrylic acid copolymer (weight ratio of the copolymerization of 57/8/28/5/2) latex) were admixed. Just prior to coating, 25 mL of a 4% by weight aqueous solution of N,N-ethylenebis(vinylsulfone acetamide) was admixed to give a coating solution for the back surface protective layer.

2) Coating of Back Layer and Back Surface Protective Layer

The backside of the undercoated support similar to Example 4 was subjected to simultaneous double coating so that the coating solution for the back layer gave the coating amount of gelatin of 0.52 g/m$^2$, and so that the coating solution for the back surface protective layer gave the coating amount of gelatin of 1.7 g/m$^2$, followed by drying to produce a back layer.

Cyanine dye-1

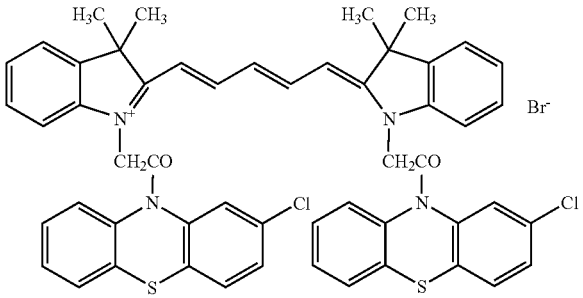

-continued

Base precursor-1

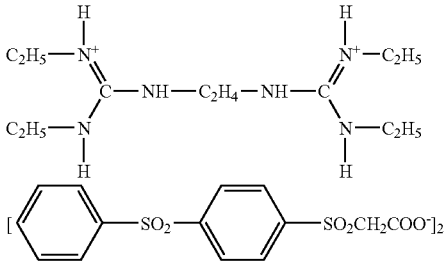

2. Evaluation Results

Evaluation was performed similar to Example 4.

The obtained results are shown in Table 6.

Concerning the samples of the present invention, cyan density hardly depends on the storage humidity, and the difference in image tone between the central portion and the edge portion is extremely little that uniform image tone is obtained. In contrast, concerning the comparative samples, cyan density after thermal development changes depending on the storage humidity, and degree of discoloration differs between the central portion and the edge portion at developing processing to cause density unevenness.

The samples of the present invention provide favorable results such as low fog, little change in sensitivity, and little change in image tone after storage under the forced condition.

In contrast, comparative sample Nos. 141, 142, and 148 provide unfavorable results such as great change in image tone, and comparative sample Nos. 147 and 153 provide unfavorable results such as low sensitivity and great change in fog after storage under the forced condition.

TABLE 6

| | | Ammonia | Photographic Properties | | | After Compulsory Storage | | | |
|---|---|---|---|---|---|---|---|---|---|
| Sample No. | Ammonium Salt | Content (mg/m$^2$) | Fog | Sensitivity | Image Tone | Fog | Sensitivity | Image Tone | Note |
| 141 | — | 0.3 | 0.19 | 100 | 4 | 0.20 | 110 | 1 | Comparative |
| 142 | Ammonium sulfate | 0.5 | 0.19 | 100 | 4 | 0.20 | 109 | 2 | Comparative |
| 143 | Ammonium sulfate | 5.0 | 0.19 | 100 | 5 | 0.20 | 107 | 3 | Invention |
| 144 | Ammonium sulfate | 15.0 | 0.19 | 100 | 5 | 0.20 | 107 | 4 | Invention |
| 145 | Ammonium sulfate | 30.0 | 0.19 | 100 | 5 | 0.21 | 107 | 4 | Invention |
| 146 | Ammonium sulfate | 70.0 | 0.20 | 98 | 5 | 0.21 | 105 | 3 | Invention |
| 147 | Ammonium sulfate | 150.0 | 0.22 | 95 | 5 | 0.30 | 100 | 2 | Comparative |
| 148 | Ammonium phthalate | 0.5 | 0.19 | 100 | 4 | 0.20 | 109 | 1 | Comparative |
| 149 | Ammonium phthalate | 5.0 | 0.19 | 100 | 5 | 0.20 | 106 | 4 | Invention |
| 150 | Ammonium phthalate | 15.0 | 0.19 | 100 | 5 | 0.20 | 106 | 5 | Invention |
| 151 | Ammonium phthalate | 30.0 | 0.19 | 100 | 5 | 0.21 | 106 | 5 | Invention |
| 152 | Ammonium phthalate | 70.0 | 0.20 | 98 | 5 | 0.21 | 102 | 4 | Invention |
| 153 | Ammonium phthalate | 150.0 | 0.22 | 95 | 5 | 0.30 | 96 | 3 | Comparative |

What is claimed is:

1. A photothermographic material comprising, on one side of a support, an image forming layer comprising at least a photosensitive silver halide, a non-photosensitive organic silver salt, a reducing agent for the organic silver salt, and a binder, and at least one non-photosensitive layer and, on the other side of the support, a non-photosensitive back layer, wherein both of at least one layer on the side having the image forming layer and the non-photosensitive back layer comprise an ammonium salt of an organic acid, a total amount of ammonia contained in the two sides is from $5\times10^{-4}$ mol/m$^2$ to $2\times10^{-2}$ mol/m$^2$, and a molar ratio (A2/A1) of an ammonia content of the non-photosensitive back layer (A2) relative to an ammonia content of the at least one layer on the side having the image forming layer (A1) is from 0.3 to 5.0.

2. The photothermographic material according to claim 1, wherein the total amount of ammonia is from $1\times10^{-3}$ mol/m$^2$ to $1\times10^{2}$ mol/m$^2$.

3. The photothermographic material according to claim 1, wherein the molar ratio (A2/A1) is from 0.5 to 4.0.

4. The photothermographic material according to claim 1 wherein the ammonium salt of an organic acid is an ammonium salt of a carboxylic acid.

5. The photothermographic material according to claim 4, wherein the ammonium salt of an organic acid is an ammonium salt of a dicarboxylic acid.

6. The photothermo graphic material according to claim 1, wherein the ammonium salt of an organic acid is a monoammonium salt or a diammonium salt of a compound represented by formula (PA):

Formula (PA)

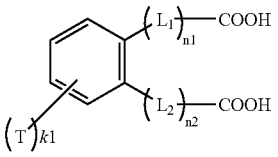

wherein $L_1$ and $L_2$ each independently represent a divalent linking group; n1 and n2 each independently represent an integer of from 0 to 30; T represents a monovalent substituent; k1 represents an integer of from 0 to 4; and when k1 is 2 or more, plural Ts may be identical or different from each other, or may bond to each other to form a ring.

7. The photothermographic material according to claim 6, wherein the ammonium salt of an organic acid is a compound represented by formula (PM):

Formula (PM)

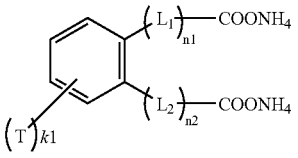

wherein $L_1$ and $L_2$ each independently represent a divalent linking group; n1 and n2 each independently represent an integer of from 0 to 30; T represents a monovalent substituent; k1 represents an integer of from 0 to 4; and when k1 is 2 or more, plural Ts may be identical or different from each other, or may bond to each other to form a ring.

8. The photothermographic material according to claim 1, wherein the ammonium salt comprises an inorganic ammonium salt.

9. The photothermographic material according to claim 8, wherein the inorganic ammonium salt is ammonium sulfate, ammonium nitrate, or ammonium phosphate.

10. The photothermographic material according to claim 1, wherein the non-photosensitive back layer comprises a metal phthalocyanine dye represented by formula (PC-1), and a film surface pH at the backside of the photothermographic material is from 4.5 to 6.0:

Formula (PC-1)

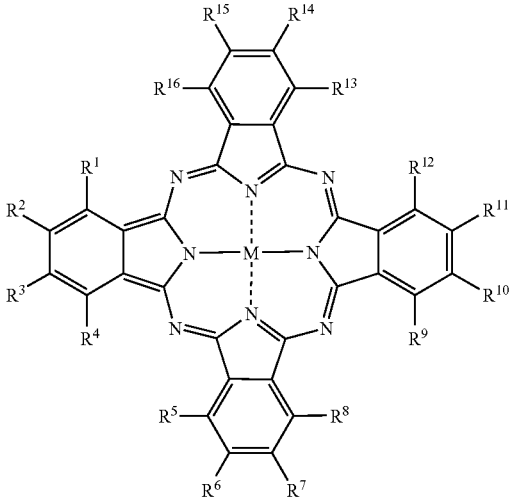

wherein M represents a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ is an electronattracting group; and $R^2$, $R^3$, $R^6$, $R^7$, $R^{10}$, $R^{11}$, $R^{14}$, and $R^{15}$ each independently represent a hydrogen atom or a substituent.

11. The photothermographic material according to claim 10, wherein at least one of $R^1$, $R^4$, $R^5$, $B^8$, $R^9$, $R^{12}$, $R^{13}$, and $R^{16}$ in the metal phthalocyanine dye represented by formula (PC-1) is a group represented by formula (II):

$-L^1-R^{17}$ Formula (II)

wherein $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—* or **—$COCONR_N$—*; ** denotes a bond with a phthalocyanine skeleton at this position; * denotes a bond with $R^{17}$ at this position; $R_N$ represents a hydrogen atom, an alkyl group, an aryl group, a heterocyclic group, an acyl group, an alkoxycarbonyl group, a carbamoyl group, a sulfonyl group, or a sulfamoyl group; and $R^{17}$ represents a hydrogen atom, an alkyl group, an aryl group, or a heterocyclic group.

12. The photothermographic material according to claim 11, wherein four or more from among $R^1$, $R^4$, $R^5$, $R^8$, $R^9$, $R^{12}$, $R^{13}$, and $R^{16}$ in the metal phthalocyanine dye represented by formula (PC-1) are each independently a group represented by formula (II).

13. The photothermographic material according to claim 11, wherein $R^2$, $R^3$, $R^6$, $R^7$, $R^{10}$, $R^{11}$, $R^{14}$, and $R^{15}$ are each a hydrogen atom, and four or more from among $R^1$, $R^4$, $R^5$, $R^8$, $R^9$, $R^{12}$, $R^{13}$, and $R^{16}$ are each independently a group represented by formula (II).

14. A photothermographic material comprising, on one side of a support, an image forming layer comprising at least a photosensitive silver halide, a non-photosensitive organic silver salt, a reducing agent for the organic silver salt, and a binder, and a non-photosensitive back layer on the other side of the support, wherein the non-photosensitive back layer comprises an ammonium salt of an organic acid, and an ammonia content of the non-photosensitive back layer is from 2 mg/m$^2$ to 100 mg/m$^2$.

15. The photothermographic material according to claim 14, wherein the ammonia content of the non-photosensitive back layer is from 5 mg/m$^2$ to 50 mg/m$^2$.

16. The photothermographic material according to claim 14, wherein the ammonium salt of an organic acid is an ammonium salt of a carboxylic acid.

17. The photothermographic material according to claim 16, wherein the ammonium salt of an organic acid is an ammonium salt of a dicarboxylic acid.

18. The photothermographic material according to claim 14, wherein the ammonium salt of an organic acid is a monoammonium salt or a diammonium salt of a compound represented by formula (PA):

Formula (PA)

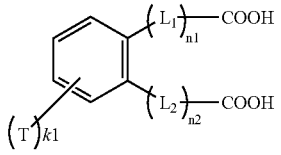

wherein $L_1$ and $L_2$ each independently represent a divalent linking group; n1 and n2 each independently represent an integer of from 0 to 30; T represents a monovalent substituent; k1 represents an integer of from 0 to 4; and when k1 is 2 or more, plural Ts may be identical or different from each other, or may bond to each other to form a ring.

19. The photothermographic material according to claim 18, wherein the ammonium salt of an organic acid is a compound represented by formula (PM):

Formula (PM)

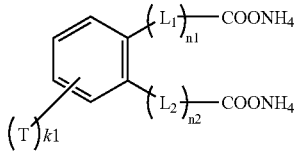

wherein $L_1$ and $L_2$ each independently represent a divalent linking group; n1 and n2 each independently represent an integer of from 0 to 30; T represents a monovalent substituent; k1 represents an integer of from 0 to 4; and when k1 is 2 or more, plural Ts may be identical or different from each other, or may bond to each other to form a ring.

20. The photothermographic material according to claim 14, wherein the ammonium salt comprises an inorganic ammonium salt.

21. The photothermographic material according to claim 20, wherein the inorganic ammonium salt is ammonium sulfate, ammonium nitrate, or ammonium phosphate.

22. The photothermographic material according to claim 14, wherein the non-photosensitive back layer comprises a metal phthalocyanine dye represented by formula (PC-1):

Formula (PC-1)

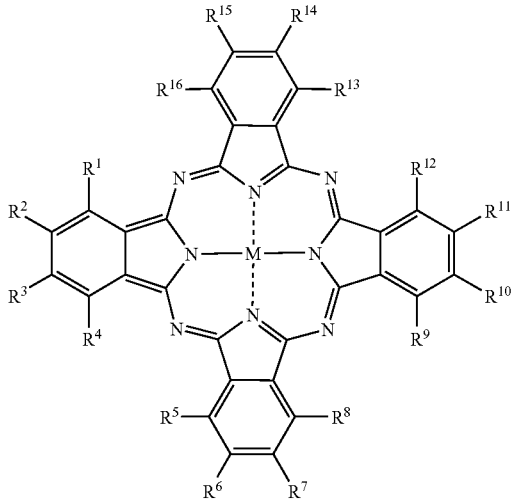

wherein M represents a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ is an electron-attracting group; and $R^2$, $R^3$, $R^6$, $R^7$, $R^{10}$, $R^{11}$, $R^{14}$and $R^{15}$ each independently represent a hydrogen atom or a substituent.

23. The photothermographic material according to claim 22, wherein at least one of $R^1$, $R^4$, $R^5$, $R^8$, $R^9$, $R^{12}$, $R^{13}$, and $R^{16}$ in the metal phthalocyanine dye represented by formula (PC-1) is a group represented by formula (II):

$-L^1-R^{17}$ Formula (II)

wherein $L_1$ represents **—$SO_2$—*, **—$SO_3$—*, **—$SO_2NR_N$—*, **—SO—*, **—$CONR_N$—*, **—COO—*, **—COCO—*,**—$COCO_2$—*, or **—$COCONR_N$—*; ** denotes a bond with a phthalocyanine skeleton at this position; * denotes a bond with $R^{17}$ at this position; $R_N$ represents a hydrogen atom, an alkyl group, an aryl group, a heterocyclic group, an acyl group, an alkoxycarbonyl group, a carbamoyl group, a sulfonyl group, or a sulfamoyl group; and $R^{17}$ represents a hydrogen atom, an alkyl group, an aryl group, or a heterocyclic group.

24. The photothermographic material according to claim 23, wherein four or more from among $R^1$, $R^4$, $R^5$, $R^8$, $R^9$, $R^{12}$, $R^{13}$, and $R^{16}$ in the metal phthalocyanine dye represented by formula (PC-1) are each independently a group represented by formula (II).

25. The photothermographic material according to claim 23, wherein $R^2$, $R^3$, $R^6$, $R^7$, $R^{10}$, $R^{11}$, $R^{14}$, and $R^{15}$ are each a hydrogen atom, and four or more from among $R^1$, $R^4$, $R^5$, $R^8$, $R^9$, $R^{12}$, $R^{13}$, and $R^{16}$ are each independently a group represented by formula (II).

26. The photothermographic material according to claim 14, wherein 50% by weight or more of the binder in the image forming layer is a polymer latex.

* * * * *